US010451224B2

(12) United States Patent
Van De Ven et al.

(10) Patent No.: US 10,451,224 B2
(45) Date of Patent: Oct. 22, 2019

(54) LIGHTING DEVICES THAT COMPRISE ONE OR MORE SOLID STATE LIGHT EMITTERS

(71) Applicant: CREE, INC., Durham, NC (US)

(72) Inventors: Antony Paul Van De Ven, Hong Kong (CN); Paul Thieken, Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 16/246,899

(22) Filed: Jan. 14, 2019

(65) Prior Publication Data

US 2019/0145585 A1 May 16, 2019

Related U.S. Application Data

(63) Continuation of application No. 15/788,376, filed on Oct. 19, 2017, now Pat. No. 10,222,004, which is a (Continued)

(51) Int. Cl.
*F21K 9/238* (2016.01)
*F21V 29/70* (2015.01)
(Continued)

(52) U.S. Cl.
CPC ..... *F21K 9/238* (2016.08); *F21K 9/20* (2016.08); *F21K 9/232* (2016.08); *F21K 9/27* (2016.08);
(Continued)

(58) Field of Classification Search
CPC . F21K 9/238; F21K 9/20; F21K 9/232; F21K 9/27; F21K 9/278; F21V 3/02; F21V 19/003; F21V 23/005; F21V 23/006
See application file for complete search history.

(56) References Cited

U.S. PATENT DOCUMENTS 3,755,697 A 8/1973 Miller
3,787,752 A 1/1974 Delay
(Continued)

FOREIGN PATENT DOCUMENTS

CA 2651224 8/2007
CN 101295854 A 10/2008
(Continued)

OTHER PUBLICATIONS

2011/0075411 (U.S. Appl. No. 12/566,857), Mar. 31, 2011 (filed Sep. 25, 2009), Van de Ven.
(Continued)

*Primary Examiner* — Joseph L Williams
(74) *Attorney, Agent, or Firm* — Burr & Brown, PLLC

(57) ABSTRACT

Light engine modules comprise a support member and a solid state light emitter, in which (1) the emitter is mounted on the support member, (2) a region of the support member has a surface with a curved cross-section, (3) the emitter and a compensation circuit are mounted on the support member, (4) an electrical contact element extends to at least two surfaces of the support member, and/or (5) a substantial entirety of the module is located on one side of a plane and the emitter emits light into another side of the plane. Also, a module comprising means for supporting a light emitter and a light emitter. Also, a lighting device comprising a housing member and a light emitter mounted on a removable support member. Also, a lighting device comprising a module mounted in a lighting device element. Also, a method comprising mounting a module to a lighting device element.

21 Claims, 41 Drawing Sheets

Related U.S. Application Data continuation of application No. 15/434,516, filed on Feb. 16, 2017, now Pat. No. 10,119,660, which is a continuation of application No. 14/278,600, filed on May 15, 2014, now Pat. No. 9,605,812, which is a continuation of application No. 13/022,978, filed on Feb. 8, 2011, now Pat. No. 8,773,007, and a continuation-in-part of application No. 12/704,995, filed on Feb. 12, 2010, now Pat. No. 9,518,715.

(60) Provisional application No. 61/354,373, filed on Jun. 14, 2010, provisional application No. 61/350,733, filed on Jun. 2, 2010, provisional application No. 61/312,918, filed on Mar. 11, 2010, provisional application No. 61/308,979, filed on Feb. 28, 2010.

(51) Int. Cl.

| | |
|---|---|
| ***F21K 9/20*** | (2016.01) |
| ***F21V 19/00*** | (2006.01) |
| ***F21V 23/00*** | (2015.01) |
| ***F21V 29/74*** | (2015.01) |
| ***F21K 9/232*** | (2016.01) |
| ***F21K 9/27*** | (2016.01) |
| ***F21K 9/278*** | (2016.01) |
| ***F21V 3/02*** | (2006.01) |
| ***F21V 23/06*** | (2006.01) |
| *F21V 29/76* | (2015.01) |
| *F21V 3/00* | (2015.01) |
| *F21V 29/505* | (2015.01) |
| *F21V 29/75* | (2015.01) |
| *F21V 29/77* | (2015.01) |
| *F21Y 101/00* | (2016.01) |
| *F21Y 115/10* | (2016.01) |
| *F21Y 107/00* | (2016.01) |
| *F21Y 107/30* | (2016.01) |

(52) U.S. Cl.

CPC ..... *F21K 9/278* (2016.08); *F21V 3/02* (2013.01); *F21V 19/003* (2013.01); *F21V 23/005* (2013.01); *F21V 23/006* (2013.01); *F21V 23/06* (2013.01); *F21V 29/70* (2015.01); *F21V 29/74* (2015.01); *F21V 3/00* (2013.01); *F21V 19/0055* (2013.01); *F21V 23/002* (2013.01); *F21V 29/505* (2015.01); *F21V 29/745* (2015.01); *F21V 29/75* (2015.01); *F21V 29/763* (2015.01); *F21V 29/767* (2015.01); *F21V 29/773* (2015.01); *F21Y 2101/00* (2013.01); *F21Y 2107/00* (2016.08); *F21Y 2107/30* (2016.08); *F21Y 2115/10* (2016.08)

(56) References Cited

U.S. PATENT DOCUMENTS

| | | | |
|---|---|---|---|
| 4,090,189 | A | 5/1978 | Fisler |
| 4,717,868 | A | 1/1988 | Peterson |
| 4,727,289 | A | 2/1988 | Uchida |
| 4,918,487 | A | 4/1990 | Coulter, Jr. |
| 5,151,679 | A | 9/1992 | Dimmick |
| 5,175,528 | A | 12/1992 | Choi et al. |
| 5,345,167 | A | 9/1994 | Hasegawa et al. |
| 5,577,832 | A | 11/1996 | Lodhie |
| 5,631,190 | A | 5/1997 | Negley |
| 5,661,645 | A | 8/1997 | Hochstein |
| 5,736,881 | A | 4/1998 | Ortiz |
| 5,844,377 | A | 12/1998 | Anderson et al. |
| 5,912,477 | A | 6/1999 | Negley |
| 5,912,568 | A | 6/1999 | Kiley |
| 6,150,771 | A | 11/2000 | Perry |
| 6,161,910 | A | 12/2000 | Reisenauer et al. |
| 6,222,172 | B1 | 4/2001 | Fossum et al. |
| 6,285,139 | B1 | 9/2001 | Ghanem |
| 6,329,760 | B1 | 12/2001 | Bebenroth |
| 6,340,868 | B1 | 1/2002 | Lys et al. |
| 6,362,578 | B1 | 3/2002 | Swanson et al. |
| 6,388,393 | B1 | 5/2002 | Illingworth |
| 6,400,101 | B1 | 6/2002 | Biebl et al. |
| 6,528,954 | B1 | 3/2003 | Lys et al. |
| 6,577,072 | B2 | 6/2003 | Saito et al. |
| 6,586,890 | B2 | 7/2003 | Min et al. |
| 6,614,358 | B1 | 9/2003 | Hutchison et al. |
| 6,636,003 | B2 | 10/2003 | Rahm et al. |
| 6,724,376 | B2 | 4/2004 | Sakura et al. |
| 6,747,420 | B2 | 6/2004 | Barth et al. |
| 6,808,287 | B2 | 10/2004 | Lebens et al. |
| 6,836,081 | B2 | 12/2004 | Swanson et al. |
| 6,841,947 | B2 | 1/2005 | Berg-johansen |
| 6,873,203 | B1 | 3/2005 | Latham, II et al. |
| 6,987,787 | B1 | 1/2006 | Mick |
| 6,995,518 | B2 | 2/2006 | Havlik et al. |
| 7,038,399 | B2 | 5/2006 | Lys et al. |
| 7,071,762 | B2 | 7/2006 | Xu et al. |
| 7,119,498 | B2 | 10/2006 | Baldwin et al. |
| 7,180,487 | B2 | 2/2007 | Kamikawa et al. |
| 7,202,608 | B2 | 4/2007 | Robinson et al. |
| 7,213,940 | B1 | 5/2007 | Van De Ven et al. |
| 7,344,279 | B2 | 3/2008 | Mueller et al. |
| 7,976,211 | B2 | 7/2011 | Cao |
| 8,083,038 | B2 | 12/2011 | Reisel et al. |
| 8,545,052 | B2 | 10/2013 | Hu |
| 8,773,007 | B2 | 7/2014 | Van De Ven et al. |
| 8,967,836 | B2 | 3/2015 | Min et al. |
| 9,157,624 | B2 | 10/2015 | Nourbakhsh et al. |
| 9,518,715 | B2 | 12/2016 | Van De Ven |
| 9,605,812 | B2 | 3/2017 | Van De Ven et al. |
| 2003/0156425 | A1 | 8/2003 | Turnbull et al. |
| 2004/0095738 | A1 | 5/2004 | Juang |
| 2005/0174780 | A1 | 8/2005 | Park |
| 2006/0126319 | A1 | 6/2006 | Pohlert et al. |
| 2006/0238136 | A1 | 10/2006 | Johnson, III et al. |
| 2007/0183156 | A1 | 8/2007 | Shan |
| 2007/0253198 | A1 | 11/2007 | Pelegrin |
| 2008/0062703 | A1 | 3/2008 | Cao |
| 2009/0045562 | A1 | 2/2009 | Reisel et al. |
| 2009/0140285 | A1 | 6/2009 | Lin et al. |
| 2009/0185373 | A1 | 7/2009 | Grajcar |
| 2009/0186516 | A1 | 7/2009 | Nall et al. |
| 2010/0008086 | A1 | 1/2010 | Broitzman |
| 2010/0026157 | A1 | 2/2010 | Tanaka et al. |
| 2010/0027258 | A1 | 2/2010 | Maxik et al. |

FOREIGN PATENT DOCUMENTS

| | | | |
|---|---|---|---|
| CN | 201129689 | Y | 10/2008 |
| CN | 101356858 | A | 1/2009 |
| DE | 202006000973 | U1 | 6/2006 |
| EP | 1 416 219 | | 5/2004 |
| EP | 2 149 742 | | 2/2010 |
| JP | 2007-527599 | A | 9/2007 |
| JP | 2009-093926 | | 4/2009 |
| TW | 200801387 | A | 1/2008 |
| TW | M349157 | | 1/2009 |
| TW | 200923262 | A | 6/2009 |
| TW | M358919 | | 6/2009 |
| WO | 2006/047059 | | 5/2006 |

OTHER PUBLICATIONS

2011/0075414 (U.S. Appl. No. 12/621,970), Mar. 31, 2011 (filed Nov. 19, 2009), Van de Ven.

2008-0130298 (U.S. Appl. No. 11/947,392), Jun. 5, 2008 (filed Nov. 29, 2007), Negley.

2011-0068702 (U.S. Appl. No. 12/566,195), Mar. 24, 2011 (filed Sep. 24, 2009), Van de Ven.

2011-0068701 (U.S. Appl. No. 12/704,730), Mar. 24, 2011 (filed Feb. 12, 2010), Van de Ven.

(56) References Cited

OTHER PUBLICATIONS 2008-0309255 (U.S. Appl. No. 12/117,280), Dec. 18, 2008 (filed May 8, 2008), Myers.
2011/0068696 (U.S. Appl. No. 12/566,142), Mar. 24, 2011 (filed Sep. 24, 2009), Van de Ven.
U.S. Appl. No. 12/704,995, filed Feb. 12, 2010, Van de Ven.
U.S. Appl. No. 12/852,849, filed Aug. 9, 2010, Van de Ven.
2007-0139923 (U.S. Appl. No. 11/613,692), Jun. 21, 2007 (filed Dec. 20, 2006), Negley.
2007-0236911 (U.S. Appl. No. 11/614,180), Oct. 11, 2007 (filed Dec. 21, 2006), Negley.
2010/0020532 (U.S. Appl. No. 12/570,712), Jan. 28, 2010 (filed Sep. 30, 2009), Negley.
2007-0139920 (U.S. Appl. No. 11/613,714), Jun. 21, 2007 (filed Dec. 20, 2006), Van de Ven.
2007-0137074 (U.S. Appl. No. 11/613,733), Jun. 21, 2007 (filed Dec. 20, 2006), Van de Ven.
2007-0170447 (U.S. Appl. No. 11/624,811), Jul. 26, 2007 (filed Jan. 19, 2007), Negley.
2007-0171145 (U.S. Appl. No. 11/626,483), Jul. 26, 2007 filed Jan. 24, 2007, Coleman.
2007-0263393 (U.S. Appl. No. 11/743,754), Nov. 15, 2007 (filed May 3, 2007), Van de Ven.
2007-0274080 (U.S. Appl. No. 11/751,982), Nov. 29, 2007 (filed May 22, 2007), Negley.
2007-0280624 (U.S. Appl. No. 11/753,103), Dec. 6, 2007 (filed May 24, 2007), Negley.
2007-0274063 (U.S. Appl. No. 11/751,990), Nov. 29, 2007 (filed May 22, 2007), Negley.
2007-0278934 (U.S. Appl. No. 11/736,761), Dec. 6, 2007 (filed Apr. 18, 2007), Van de Ven.
2007-0267983 (U.S. Appl. No. 11/736,799), Nov. 22, 2007 (filed Apr. 18, 2007), Van de Ven.
2007-0278503 (U.S. Appl. No. 11/737,321), Dec. 6, 2007 (filed Apr. 19, 2007), Van de Ven.
2007-0278974 (U.S. Appl. No. 11/755,149), Dec. 6, 2007 (filed May 30, 2007), Van de Ven.
2007-0279903 (U.S. Appl. No. 11/755,153), Dec. 6, 2007 (filed May 30, 2007), Negley.
2007-0279440 (U.S. Appl. No. 11/755,162), Dec. 6, 2007 (filed May 30, 2007), Negley.
2008-0084700 (U.S. Appl. No. 11/856,421), Apr. 10, 2008 (filed Sep. 17, 2007), Van de Ven.
2008-0088248 (U.S. Appl. No. 11/854,744), Apr. 17, 2008 (filed Sep. 13, 2007), Myers.
2008-0084701 (U.S. Appl. No. 11/859,048), Apr. 10, 2008 (filed Sep. 21, 2007), Van de Ven.
2008-0112183 (U.S. Appl. No. 11/939,047), May 15, 2008 (filed Nov. 13, 2007), Negley.
2008-0106895 (U.S. Appl. No. 11/936,163), May 8, 2008 (filed Nov. 7, 2007), Van de Ven.
2008-0304260 (U.S. Appl. No. 12/117,122), Dec. 11, 2008 (filed May 8, 2008), Van de Ven.
2008-0278940 (U.S. Appl. No. 12/117,131), Nov. 13, 2008 (filed May 8, 2008), Van de Ven.
2008-0278928 (U.S. Appl. No. 12/117,136), Nov. 13, 2008 (filed May 8, 2008), Van de Ven.
2008-0084685 (U.S. Appl. No. 11/843,243), Apr. 10, 2008 (filed Aug. 22, 2007), Van de Ven.
2008-0130285 (U.S. Appl. No. 11/948,021), Jun. 5, 2008 (filed Nov. 30, 2007), Negley.
2009-0296384 (U.S. Appl. No. 12/475,850), Dec. 3, 2009 filed Jun. 1, 2009, Van de Ven.
2008-0112168 (U.S. Appl. No. 11/939,052), May 15, 2008 (filed Nov. 13, 2007), Pickard.
2008-0112170 (U.S. Appl. No. 11/939,059), May 15, 2008 (filed Nov. 13, 2007), Trott.
2008-0106907 (U.S. Appl. No. 11/877,038), May 8, 2008 (filed Oct. 23, 2007), Trott.
2009-0184616 (U.S. Appl. No. 12/248,220), Jul. 23, 2009 (filed Oct. 9, 2008), Van de Ven.
2008-0089053 (U.S. Appl. No. 11/870,679), Apr. 17, 2008 (filed Oct. 11, 2007), Negley.
2008-0136313 (U.S. Appl. No. 11/951,626), Jun. 12, 2008 (filed Dec. 6, 2007), Van de Ven.
2008-0137347 (U.S. Appl. No. 11/948,041), Jun. 12, 2008 (filed Nov. 30, 2007), Trott.
2008-0259589 (U.S. Appl. No. 12/035,604), Oct. 23, 2008 (filed Feb. 22, 2008), Van de Ven.
2008-0304269 (U.S. Appl. No. 12/114,994), Dec. 11, 2008 (filed May 5, 2008), Pickard.
2008-0278952 (U.S. Appl. No. 12/116,341), Nov. 13, 2008 (filed May 7, 2008), Trott.
2008-0304261 (U.S. Appl. No. 12/117,148), Dec. 11, 2008 (filed May 8, 2008), Van de Ven.
2009-0108269 (U.S. Appl. No. 12/017,676), Apr. 30, 2009 (filed Jan. 22, 2008), Negley.
2009-0161356 (U.S. Appl. No. 12/277,745), Jun. 25, 2009 (filed Nov. 25, 2008), Negley.
2009-0160363 (U.S. Appl. No. 12/257,804), Jun. 25, 2009 (filed Oct. 24, 2008), Negley.
2009-0184666 (U.S. Appl. No. 12/328,144), Jul. 23, 2009 (filed Dec. 4, 2008), Myers.
2008-0278950 U.S. Appl. No. 12/116,346), Nov. 13, 2008 (filed May 7, 2008), Pickard.
2008/0278957 (U.S. Appl. No. 12/116,348), Nov. 13, 2008 (filed May 7, 2008), Pickard.
2011-0031894 (U.S. Appl. No. 12/535,319), Feb. 10, 2011 (filed Aug. 4, 2009), Van de Ven.
2010/0246177 (U.S. Appl. No. 12/411,905), Sep. 30, 2010 (filed Mar. 26, 2009), Van de Ven.
2010/0290222 (U.S. Appl. No. 12/467,467), Nov. 18, 2010 (filed May 28, 2009), Pickard.
2010/0102697 (U.S. Appl. No. 12/512,653), Apr. 29, 2010 (filed Jul. 30, 2009), Van de Ven.
2010-0290208 (U.S. Appl. No. 12/465,203), Nov. 18, 2010 (filed May 13, 2009), Pickard.
2010/0102199 (U.S. Appl. No. 12/469,819), Apr. 29, 2010 (filed May 21, 2008), Negley.
2010/0103678 (U.S. Appl. No. 12/469,828), Apr. 29, 2010 (filed May 21, 2008), Van de Ven.
2009/0184662 (U.S. Appl. No. 12/328,115), Jul. 23, 2009 (filed Dec. 4, 2008), Given.
2011/0050070 (U.S. Appl. No. 12/551,921), Mar. 3, 2011 (filed Sep. 1, 2009), Pickard.
2011/0037409 (U.S. Appl. No. 12/541,215), Feb. 17, 2011 (filed Aug. 14, 2009), Van de Ven.
U.S. Appl. No. 61/245,683, filed Sep. 25, 2009, Van de Ven.
2011-0074270 (U.S. Appl. No. 12/886,718), Mar. 31, 2011 (filed Sep. 21, 2010), Van de Ven.
U.S. Appl. No. 61/245,688, filed Sep. 25, 2009, Pickard.
(U.S. Appl. No. 13/022,142), (filed Feb. 7, 2011), Van de Ven.
(U.S. Appl. No. 13/022,180), (filed Feb. 7, 2011), Van de Ven.
2011/0075423 (U.S. Appl. No. 12/566,936), Mar. 31, 2011 (filed Sep. 25, 2009), Van de Ven.
2011/0074265 (U.S. Appl. No. 12/566,850), Mar. 31, 2011 (filed Sep. 25, 2009), Van de Ven.
2011/0075422 (U.S. Appl. No. 12/566,861), Mar. 31, 2011 (filed Sep. 25, 2009), Van de Ven.
(U.S. Appl. No. 12/582,206), (filed Oct. 20, 2009), Pickard.
(U.S. Appl. No. 12/607,355), (filed Oct. 28, 2009), Pickard.
(U.S. Appl. No. 12/683,886), (filed Jan. 7, 2010), Pickard.
2011/0211351, Sep. 1, 2011, Van de Ven.
2015/0009670, Jan. 8, 2015, Van de Ven.
2017/0159892, Jun. 8, 2017, Van de Ven.
European Office Action from a corresponding European patent application bearing a dated Apr. 8, 2015, 7 pages.
Taiwan Office Action (and translation provided by foreign counsel) from a corresponding Taiwan patent application bearing a dated Apr. 22, 2015, 37 pages.
U.S. Appl. No. 15/434,516/ 2017/0159892, filed Feb. 16, 2017/ Jun. 8, 2017, Van De Ven et al.

(56) References Cited

OTHER PUBLICATIONS

U.S. Appl. No. 15/788,376/ 2018/0045381 A1, filed Oct. 19, 2017/
Feb. 15, 2018, Van de Ven et al.

LIGHTING DEVICES THAT COMPRISE ONE OR MORE SOLID STATE LIGHT EMITTERS

CROSS-REFERENCE TO RELATED APPLICATIONS

This application is a continuation of U.S. patent application Ser. No. 15/788,376, filed Oct. 19, 2017 (U.S. Patent Application Publication No. 2018-0045381, published on Feb. 15, 2018), now U.S. Pat. No. 10,222,004, and it claims the benefit of U.S. patent application Ser. No. 15/788,376, filed Oct. 19, 2017 (U.S. Patent Application Publication No. 2018-0045381 (published on Feb. 15, 2018), the entirety of which is incorporated herein by reference.

This application claims the benefit of U.S. patent application Ser. No. 15/434,516, filed Feb. 16, 2017 (now U.S. Pat. No. 10,119,660 (granted Nov. 6, 2018), the entirety of which is incorporated herein by reference.

This application claims the benefit of U.S. patent application Ser. No. 14/278,600, filed May 15, 2014 (now U.S. Pat. No. 9,605,812 (granted Mar. 28, 2017), the entirety of which is incorporated herein by reference.

This application claims the benefit of U.S. patent application Ser. No. 13/022,978, filed Feb. 8, 2011 (now U.S. Pat. No. 8,773,007 (granted Jul. 8, 2014), the entirety of which is incorporated herein by reference.

This application claims the benefit of U.S. patent application Ser. No. 14/704,995, filed Feb. 12, 2010 (now U.S. Pat. No. 9,518,715 (granted Dec. 13, 2016), the entirety of which is incorporated herein by reference.

This application claims the benefit of U.S. Provisional Patent Application No. 61/308,979, filed Feb. 28, 2010, the entirety of which is incorporated herein by reference.

This application claims the benefit of U.S. Provisional Patent Application No. 61/312,918, filed Mar. 11, 2010, the entirety of which is incorporated herein by reference.

This application claims the benefit of U.S. Provisional Patent Application No. 61/350,733, filed Jun. 2, 2010, the entirety of which is incorporated herein by reference.

This application claims the benefit of U.S. Provisional Patent Application No. 61/354,373, filed Jun. 14, 2010, the entirety of which is incorporated herein by reference.

FIELD OF THE INVENTIVE SUBJECT MATTER

The present inventive subject matter is directed to lighting devices that comprise one or more solid state light emitters, e.g., one or more light emitting diodes.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes have typical lifetimes between 50,000 and 70,000 hours. Fluorescent bulbs generally have lifetimes (e.g., 10,000-20,000 hours) that are longer than those of incandescent lights, but they typically provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

There are a number of challenges presented with using solid state light emitters in lighting devices. In many cases, additional components are added to the lighting devices in order to address these challenges. It would be desirable to provide a lighting device that comprises one or more solid state light emitters, in which such challenges are addressed and yet the lighting device can fit within the same or substantially the same space that is provided for comparable conventional lighting devices (e.g., the space occupied by conventional incandescent light sources and/or fluorescent light sources). The ability for a lighting device that includes one or more solid state light emitters to fit in a space that is similar to (or identical to) a space that would be occupied by conventional devices is important when retro-fitting a lighting device, as well when installing a lighting device in new construction.

One such challenge results from the fact that the emission spectrum of any particular light emitting diode is typically concentrated around a single wavelength (as dictated by the light emitting diode's composition and structure), which is desirable for some applications, but not desirable for others, (e.g., for providing general illumination, such an emission spectrum generally does not provide light that appears white, and/or provides a very low CRI). As a result, in many cases (e.g., to make devices that emit light perceived as white or near-white, or to make devices that emit light that is not highly saturated) it is necessary to employ light sources (e.g., one or more solid state light emitters and optionally also one or more other types of light sources, e.g., additional light emitting diodes, luminescent materials, incandescent lights, etc.) that emit light of different colors. There are a variety of reasons that one or more solid state light emitters might cease emitting light and/or vary in their intensity of light emission, which can throw off the balance of color output and cause the lighting device to emit light that is perceived as being of a color that differs from the desired color of light output. As a result, in many of such devices, one challenge that necessitates the inclusion of additional components is that there may be a desire to provide additional circuitry that can adjust the current supplied to respective solid state light emitters (and/or other light emitters) in order to maintain the balance of color output among the light emitters that emit light of different colors in order to achieve the desired color output.

Another such challenge is that there may be a desire to mix the light of different colors emitted from the different solid state light emitters by providing additional structure to assist in such mixing.

One example of a reason that one or more solid state light emitters might vary in their intensity of light emission is temperature change (resulting, e.g., from change in ambient temperature and/or heating up of the solid state light emitters and/or surrounding components or structures). Some types of solid state light emitters (e.g., solid state light emitters that emit light of different colors) experience differences in intensity of light emission (if supplied with the same current) at different temperatures, and frequently such changes in intensity occur to differing extents for emitters that emit light of different colors as temperature changes. For example, some light emitting diodes that emit red light have a very strong temperature dependence in at least some temperature ranges (e.g., AlInGaP light emitting diodes can reduce in optical output by ~20% when heated up by ~40 degrees C., that is, approximately −0.5% per degree C.; some blue light emitting InGaN+YAG:Ce light emitting diodes can reduce in optical output by about −0.15%/degree C.). Various heat sinking schemes have been developed to dissipate at least some of the heat that is generated by the LED. See, for example, Application Note: CLD-APO6.006, entitled *Cree® XLamp® XR Family* & 4550 *LED Reliability*, published at cree.com/xlamp, September 2008.

Another example of a reason that one or more solid state light emitters might vary in their intensity of light emission is aging. Some solid state light emitters (e.g., solid state light emitters that emit light of different colors) experience decreases in intensity of light emission (if supplied with the same current) as they age, and frequently such decreases in intensity occur at differing rates.

Another example of a reason that one or more solid state light emitters might vary in their intensity of light emission is damage to the solid state light emitter(s) and/or damage to circuitry that supplies current to the solid state light emitter(s).

Another challenge presented in making a lighting device with light emitting diodes, that often necessitates the inclusion of additional components, is that the performance of many solid state light emitters may be reduced when they are subjected to elevated temperatures. For example, many light emitting diode light sources have average operating lifetimes of decades as opposed to just months or 1-2 years for many incandescent bulbs, but some light emitting diodes' lifetimes can be significantly shortened if they are operated at elevated temperatures. A common manufacturer recommendation is that the junction temperature of a light emitting diode should not exceed 85 degrees C. if a long lifetime is desired. There may be a desire to counteract such problems, in many instances, by providing additional structure (or structures) to provide a desired degree of heat dissipation.

Another challenge presented in making a lighting device with light emitting diodes, that often necessitates the inclusion of additional components, arises from the relatively high light output from a relatively small area provided by solid state emitters. Such a concentration of light output may present challenges in providing solid state lighting systems for general illumination in that, in general, a large difference in brightness in a small area may be perceived as glare and may be distracting to occupants. In many instances, therefore, there is a desire to provide additional structure to assist in mixing the emitted light and/or creating the perception that the emitted light is output through a larger area.

Another challenge presented in making a lighting device with light emitting diodes, that often necessitates the inclusion of additional components, is that light emitting diodes are typically operated most effectively on low voltage DC current, while line voltage is typically much higher voltage AC current. As a result, there is often a desire to provide circuitry that converts line voltage, e.g., from AC to DC and/or that reduces voltage.

In addition, in some circumstances, there is a desire either to retrofit or install a lighting device in a circuit that has a conventional dimmer. Some dimmers operate based on signals contained in the current supplied to the lighting device (for example, duty cycle of an AC signal, e.g., from a triac), for which additional circuitry is generally needed.

It would be desirable to be able to make a variety of lighting devices that include different numbers of solid state light emitters (and which thereby generate heat at a variety of different rates), and to be able to address the effects caused by such different rates of heat generation (including elevated rates of heat generation), and/or to be able to make such lighting devices in a wide variety of shapes and sizes, including those that correspond to conventional lighting devices.

There exist conventional lighting devices that have light intensity outputs and/or power inputs that would require a wide variety of circuitry in order to provide equivalent output from a lighting device comprising one or more solid state light emitters, and it would be desirable to be able to easily make a variety of solid state light emitter lighting devices that can provide such light intensity outputs and/or that can be powered by such power inputs.

BRIEF SUMMARY OF THE INVENTIVE SUBJECT MATTER

In accordance with one aspect of the present inventive subject matter, there is provided a light engine module that comprises at least a first solid state light emitter support member and at least a first solid state light emitter mounted on the first solid state light emitter support member. The light engine module can be inserted into any of a wide variety of lighting device elements (each of which can comprise one or more lighting device components) to make a lighting device.

In accordance with this aspect of the present inventive subject matter, a number of light engine modules can be made that correspond to a single design, and the modules can then be incorporated into a variety of different lighting device elements (some or all of which can correspond to conventional shapes and sizes, i.e., "form factors", of lighting devices) to form lighting devices that are of different shapes and/or sizes but which include similar light engine modules.

Alternatively, in accordance with this aspect of the present inventive subject matter, a number of light engine modules can be made that each correspond to different designs (e.g., that include different types (and/or numbers) of solid state light emitters, and/or that emit light of different hues or color temperature, and/or that emit light of different intensity, and/or that have different types of compensation circuitry), and the different modules can then be incorporated into lighting device elements that correspond to a single design, to form lighting devices that are of the same shape and size (and possibly other characteristics) and which have different light engine modules.

Alternatively, in accordance with this aspect of the present inventive subject matter, a number of light engine modules can be made that each correspond to different designs (e.g., that include different types (and/or numbers) of solid state light emitters, and/or that emit light of different hues or color temperature, and/or that emit light of different intensity, and/or that have different types of compensation circuitry), and the different modules can then be incorporated into lighting device elements that are of different shapes and/or sizes, to form lighting devices that are of different shapes and/or sizes (and possibly other characteristics) and which have different light engine modules.

In addition, in accordance with this aspect of the present inventive subject matter, a number of light engine modules can be provided that are of different designs (e.g., that include different types of solid state light emitters, and/or that emit light of different hues or color temperature, and/or that emit light of different intensity, and/or that have different types of compensation circuitry) and a number of lighting device elements can be provided that are of different designs (e.g., that are of different shapes and/or sizes, and/or that have other different features), and some or all of the different light engine modules can be interchangeable, and some or all of the different lighting device elements can also be interchangeable, whereby the number of different designs for the overall lighting device can be as high as the product of the number of different light engine modules times the number of different lighting device elements.

In accordance with an aspect of the present inventive subject matter, there are provided light engine modules that can be used in the existing form factor of conventional lighting devices, e.g., any of the wide variety of form factors known to those skilled in the art, some of which are referred to herein (such as A lamps, e.g., A19 bulbs, or standard fluorescent tubes, etc.). In other words, the light engine modules can be inserted into any of a wide variety of other lighting device elements to provide lighting devices that correspond to a form factor of a conventional lighting device.

In accordance with another aspect of the present inventive subject matter, there are provided light engine modules that can be used to replace a module contained in a lighting device of the type described in the preceding paragraph, i.e., a lighting device comprising one or more lighting device elements and a light engine module. Such replacement can be carried out in the event that a module burns out or becomes less efficacious, or if different color or performance is desired.

As noted above, one very attractive quality of solid state lighting is its efficiency and hence its low operating cost. A quality of solid state lighting that has hindered its use, however, is its equipment cost. One way to make solid state lighting more attractive would be to extend the already superior useful life of at least some of the components of lighting devices that employ solid state lighting, whereby the equipment cost over time is even further reduced in comparison with other lighting options.

In many cases, the equipment cost for solid state lighting is roughly one-third power conversion, one-third light emitting diodes and one-third mechanical parts.

As noted above, solid state lighting devices typically degrade over time (although such degradation generally takes much longer to occur than in the cases of other lighting options, such as incandescent lights and fluorescent lights). Such degradation is typically more rapid when the solid state light emitter(s) in the solid state lighting device is/are subjected to higher temperatures.

In accordance with another aspect of the present inventive subject matter, there is provided a lighting device that comprises a removable light engine module, e.g., that comprises a support member on which at least one solid state light emitter is mounted. With such a lighting device, it is possible to periodically replace the support member (along with the one or more solid state light emitters mounted thereon), according to a predetermined schedule, whenever desired or whenever deemed necessary. In such a way, the lifetime of the other components of the lighting device can be extended, and/or the lighting device can be operated at higher temperature (i.e., to generate more light) than would otherwise be possible, and/or different color output can be achieved by swapping out one or more support members (along with the solid state light emitter or solid state light emitters mounted thereon).

For example, in satisfying a given lighting requirement (e.g., overall brightness in a particular room, e.g., a dining area in a restaurant), equipment cost can be reduced by using fewer lighting devices and supplying higher current to the at least one solid state light emitter to make up for the fewer number of lighting devices. In such a case, it is recognized that the higher operating temperatures generated by operating the at least one solid state light emitter at higher current may cause the solid state light emitters to degrade more rapidly (due primarily to degradation of encapsulant), but that the effects of such degradation can be addressed by replacing the light engine module (including the one or more solid state light emitters that is/are part of that module) at the onset of degradation (or at any other stage of degradation).

Alternatively or additionally, equipment cost can be reduced (or further reduced) by eliminating one or more heat sink elements that would otherwise be provided in order for the operating temperature of the at least one solid state light emitter to be held to a level at which degradation of the at least one solid state light emitter is kept below a threshold level ordinarily deemed to be unacceptable, recognizing that the effects of more rapid degradation of the at least one solid state light emitter resulting from such higher operating temperatures can be addressed by replacing the light engine module (or one or more of plural light engine modules), including the one or more solid state light emitters that is/are part of that module, at the onset of degradation (or at any other stage of degradation).

In accordance with another aspect of the present inventive subject matter, there is provided a light engine module that comprises at least a first solid state light emitter support member and at least a first solid state light emitter.

In accordance with another aspect of the present inventive subject matter, there is provided a light engine module that comprises at least a first solid state light emitter support member and at least a first compensation circuit.

In accordance with another aspect of the present inventive subject matter, there is provided a light engine module that comprises at least a first solid state light emitter support member and at least a first solid state light emitter, with the first solid state light emitter being mounted on the first solid state light emitter support member, and at least a first region of the first solid state light emitter support member comprising a surface that has a curved cross-section. In some embodiments according to this aspect of the present inventive subject matter, at least a portion of the curved cross-section is arc-shaped (i.e., defines a portion of a circle).

In accordance with another aspect of the present inventive subject matter, there is provided a light engine module that comprises at least a first solid state light emitter support member, at least a first solid state light emitter, and at least a first compensation circuit, with the first solid state light emitter and the first compensation circuit being mounted on the first solid state light emitter support member. In some embodiments according to this aspect of the present inventive subject matter, (1) the first solid state light emitter is mounted on a first surface of the first solid state light emitter support member and the first compensation circuit is mounted on a second surface of the first solid state light emitter support member, and/or (2) the first compensation circuit comprises a temperature compensation circuit, and/or (3) the first compensation circuit comprises a color emission intensity compensation circuit.

In accordance with another aspect of the present inventive subject matter, there is provided a light engine module that comprises at least a first solid state light emitter support member, at least a first solid state light emitter, and at least a first contact element, the first solid state light emitter being mounted on a first surface of the first solid state light emitter support member, the first contact element extending at least from the first surface of the solid state light emitter support member to a second surface of the solid state light emitter support member. In some embodiments according to this aspect of the present inventive subject matter, the second surface of the solid state light emitter support member comprises a surface that has a curved cross-section (e.g., in which at least a portion of the curved cross-section is substantially arc-shaped).

In accordance with another aspect of the present inventive subject matter, there is provided a light engine module that comprises at least a first solid state light emitter support member and at least a first solid state light emitter, the first solid state light emitter being mounted on the first solid state light emitter support member, a substantial entirety of the light engine module being located on a first side of an emission plane of the first solid state light emitter, and at least 80% (and in some embodiments at least 90% or substantially all) of the light emitted by the first solid state light emitter being emitted into a second side of the emission plane of the first solid state light emitter.

In some embodiments according to this aspect of the present inventive subject matter:

a first dimension of the light engine module (the first dimension being the largest dimension of the light engine module extending in a first plane parallel to the emission plane of the first solid state light emitter), is at least as large as the largest dimension of the light engine module extending in any plane that is farther from the emission plane of the first solid state light emitter than the first plane and that is parallel to the emission plane of the first solid state light emitter. In some of such embodiments, a second dimension of the light engine module is smaller than the first dimension of the light engine module, the second dimension being the largest dimension of the light engine module extending in a second plane parallel to the emission plane of the first solid state light emitter, the second plane being farther from the emission plane of the first solid state light emitter than the first plane.

In some embodiments according to this aspect of the present inventive subject matter:

a first dimension of the light engine module (the first dimension extending in a first direction in a first plane parallel to the emission plane of the first solid state light emitter), is at least as large as the dimension of the light engine module extending in any direction that is parallel to the first direction and that is in a second plane, the second plane being farther from the emission plane of the first solid state light emitter than the first plane and the second plane being parallel to the emission plane of the first solid state light emitter. In some of such embodiments, a second dimension of the light engine module is smaller than the first dimension of the light engine module, the second dimension being a dimension of the light engine module extending in the second plane parallel to the emission plane of the first solid state light emitter.

In some embodiments according to this aspect of the present inventive subject matter, a plurality of solid state light emitters are mounted on the first solid state light emitter support member, and substantially all of the light emitted by the plurality of solid state light emitters is emitted into the second side of the emission plane of the first solid state light emitter.

In accordance with another aspect of the present inventive subject matter, there is provided a lighting device that comprises at least one housing member, at least a first solid state light emitter support member and at least a first solid state light emitter, the first solid state light emitter being mounted on the first solid state light emitter support member, and the first solid state light emitter support member being removably supported by the at least one housing member. In some of such embodiments, the lighting device can be configured to occupy substantially the same space as an A lamp, e.g., an A19 lamp.

In accordance with another aspect of the present inventive subject matter, there is provided a light engine module that comprises a first circuit board (on which one or more solid state light emitters is/are provided, a second circuit board, a first support structure, and at least a first electrical connection structure that electrically connects the first circuit board to the second circuit board, in which the creepage distance between the first electrical connection structure and at least one other electrically conductive element is increased by increasing the distance between the first electrical connection structure and the at least one other electrically conductive element along the surface of insulation that insulates the first electrical connection structure.

In accordance with another aspect of the present inventive subject matter, there is provided a light engine module that is of reduced size. In some embodiments, where the light engine module fits into a lighting device element (or elements) (e.g., a housing member, a lens and/or an electrical connector) having specific internal cross-sectional areas and shapes in planes perpendicular to and at specific locations along an axis of the lighting device element(s), the dimension of the light engine module along the axis of the lighting device element(s) is reduced.

In accordance with another aspect of the present inventive subject matter, there is provided a light engine module that can be easily placed inside and/or attached or supported within a lighting device element (or elements) (e.g., a housing member, a lens and/or an electrical connector) having specific internal cross-sectional areas and shapes in planes perpendicular to and at specific locations along an axis of the lighting device element(s).

In accordance with another aspect of the present inventive subject matter, there is provided a light engine element that comprises a light engine module and an interface element connected to the light engine module. In some embodiments according to this aspect of the present inventive subject matter, (1) the interface element is removably attached to the light engine module, (2) the interface element is configured to be removably attached to at least one lighting device element, and/or (3) the interface element is configured to be attached to at least one lighting device element.

In accordance with another aspect of the present inventive subject matter, there is provided a lighting device that comprises a light engine element and at least one lighting device element. In some embodiments according to this aspect of the present inventive subject matter, the light engine element is removably attached to the lighting device element.

The inventive subject matter may be more fully understood with reference to the accompanying drawings and the following detailed description of the inventive subject matter.

BRIEF DESCRIPTION OF THE DRAWING FIGURES

Figure 23:
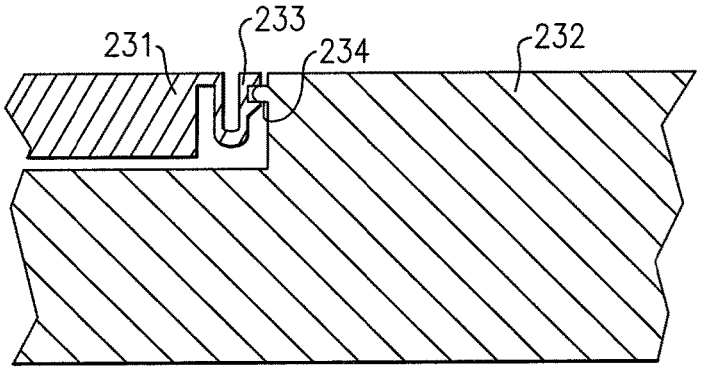

FIG. 23 is a sectional view depicting a portion of a circuit board 231 that includes an integral clip 233, and a support structure 232 that includes a protrusion 234 that is engageable with the clip 233.

Figure 24:
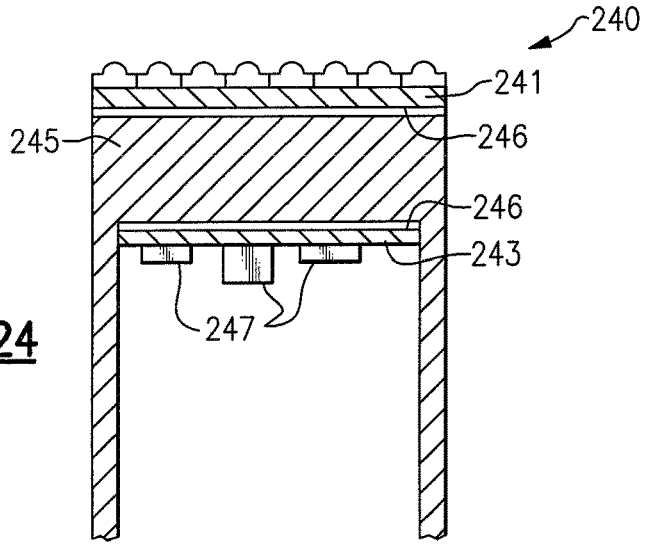

FIG. 24 is a sectional view depicting a portion of a light engine module 240.

Figure 25:
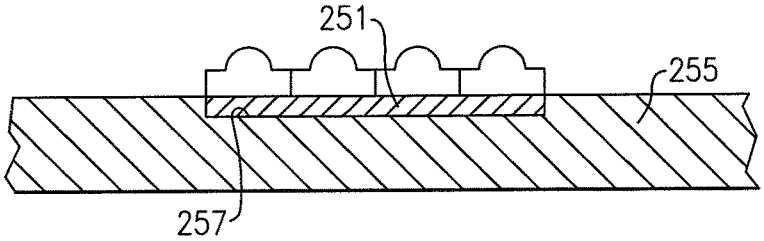

FIG. 25 is a sectional view depicting a first circuit board 251 which is positioned in a recess 257 in a first support structure 255.

Figure 26:
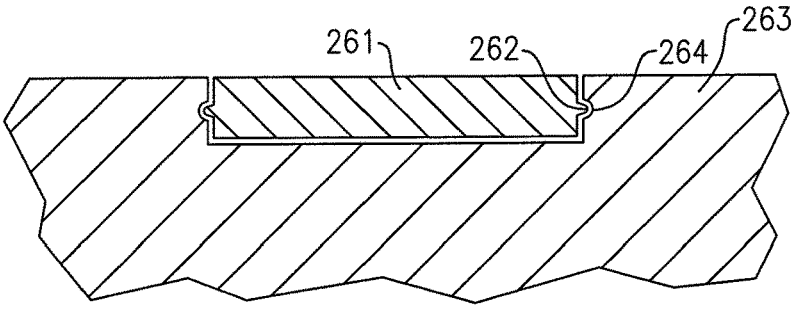

FIG. 26 is a sectional view depicting a first circuit board 261 that has a ridge 262 (on an edge thereof) that fits into a groove 264 in a first support structure 263.

Figure 27:
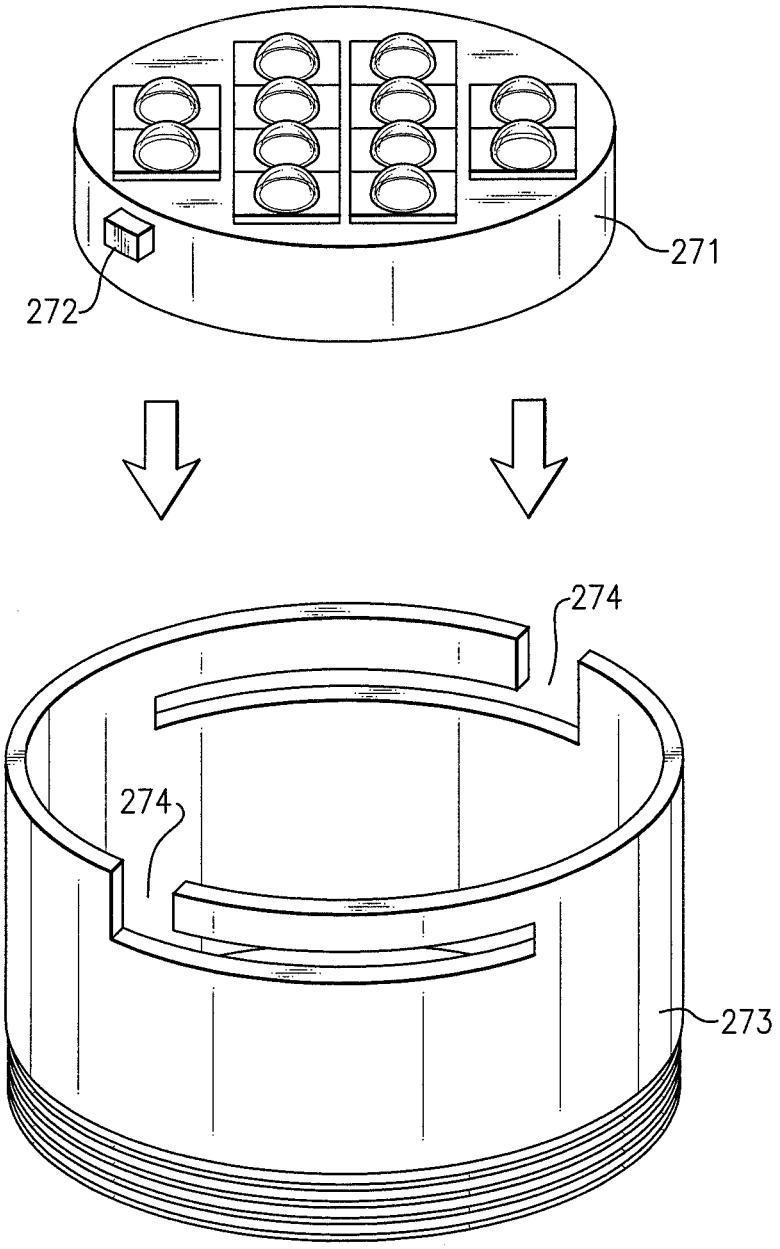

FIG. 27 is a sectional view depicting a first circuit board 271 that has two tabs 272 on an edge thereof, that fit into respective slots 274 in a first support structure 273.

Figure 28:
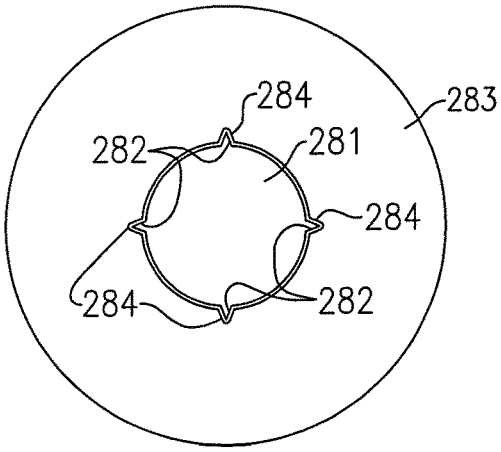

FIG. 28 is a top view depicting a first circuit board 281 that has tabs 282 that fit into respective grooves 284 in a first support structure 283.

Figure 29:
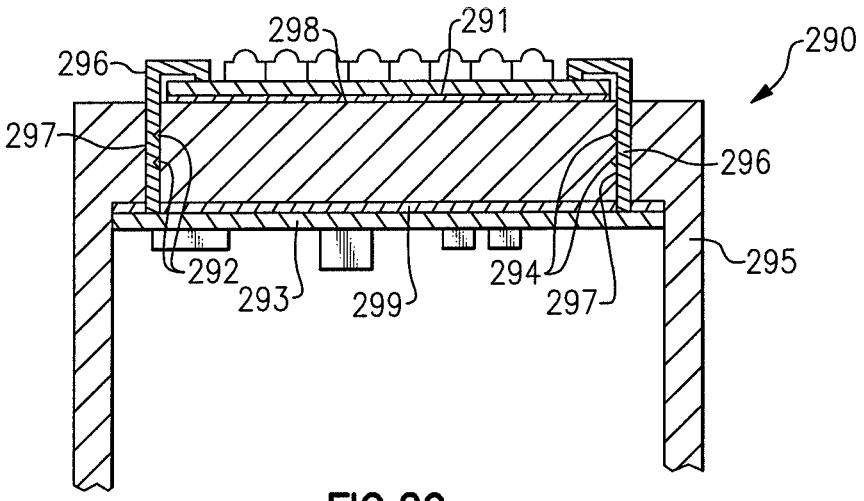

FIG. 29 is a sectional view depicting a portion of a light engine module 290 that comprises a first circuit board 291 which is attached to one side of a first support structure 295, and a second circuit board 293 which is attached to an opposite side of the first support structure 295.

Figure 30:
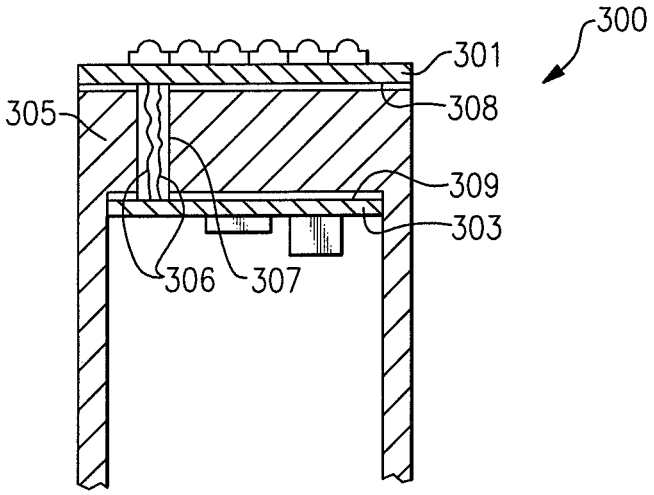

FIG. 30 is a sectional view depicting a portion of a light engine module 300 that comprises a first circuit board 301 which is attached to one side of a first support structure 305, and a second circuit board 303 which is attached to an opposite side of the first support structure 305.

Figure 31:
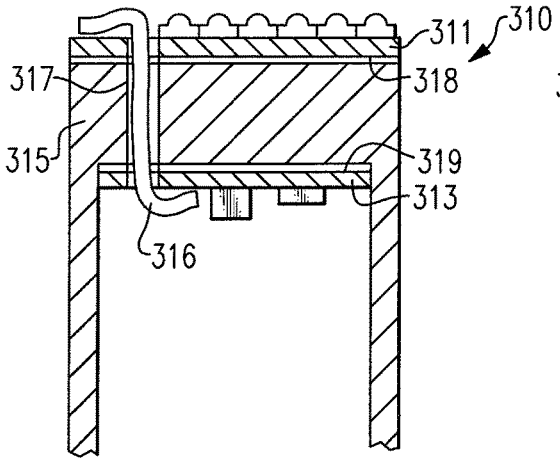

FIG. 31 is a sectional view depicting a portion of a light engine module 310 that comprises a first circuit board 311 which is attached to one side of a first support structure 315, and a second circuit board 313 which is attached to an opposite side of the first support structure 315.

Figure 32:
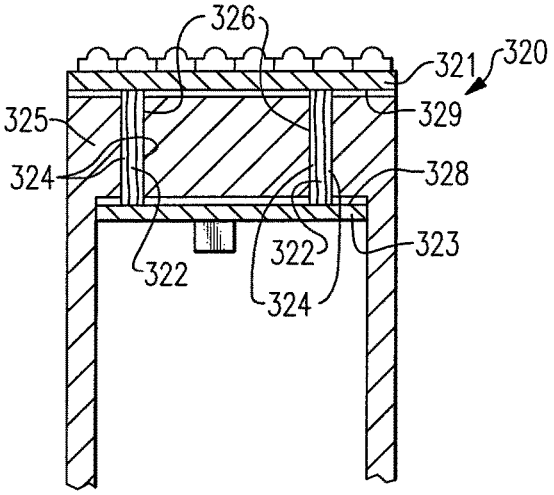

FIG. 32 is a sectional view depicting a portion of a light engine module 320 that comprises a first circuit board 321 which is attached to one side of a first support structure 325, and a second circuit board 323 which is attached to an opposite side of the first support structure 325.

Figure 33:
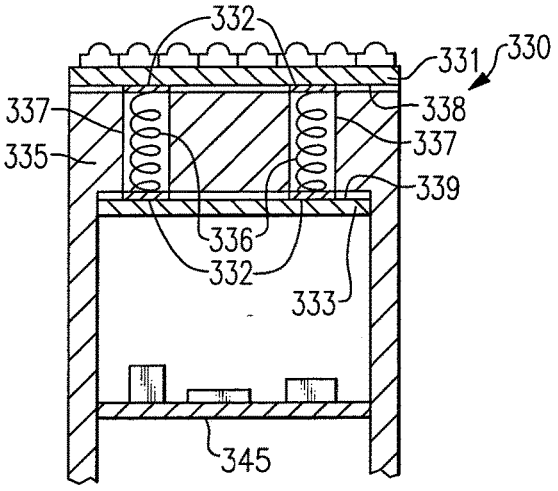

FIG. 33 is a sectional view depicting a portion of a light engine module 330 that comprises a first circuit board 331 which is attached to one side of a first support structure 335, and a second circuit board 333 which is attached to an opposite side of the first support structure 335.

Figure 34:
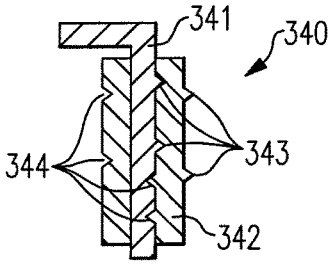

FIG. 34 is a sectional view of a pin 340 that comprises a conductive portion 341 and an insulating portion 342.

Figure 35:
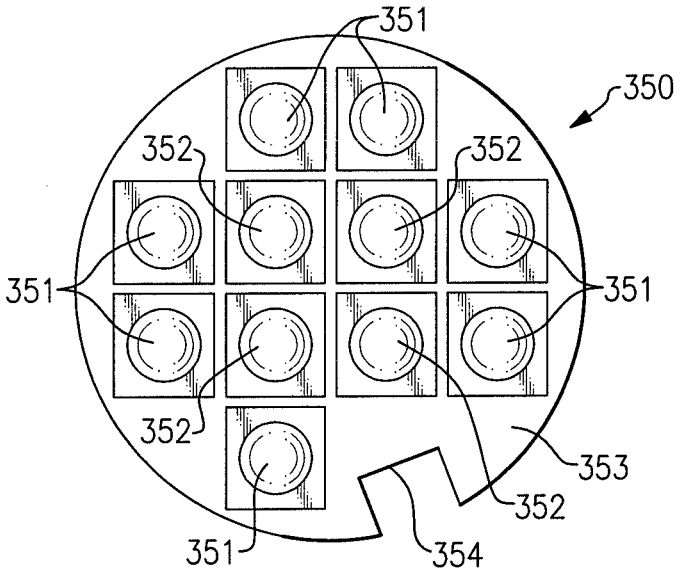

FIG. 35 is a top view of a light engine module 350 that comprises a first circuit board 353 and eleven solid state light emitters (351 and 352), and in which a slot 354 is provided in the first circuit board 353.

Figure 36:
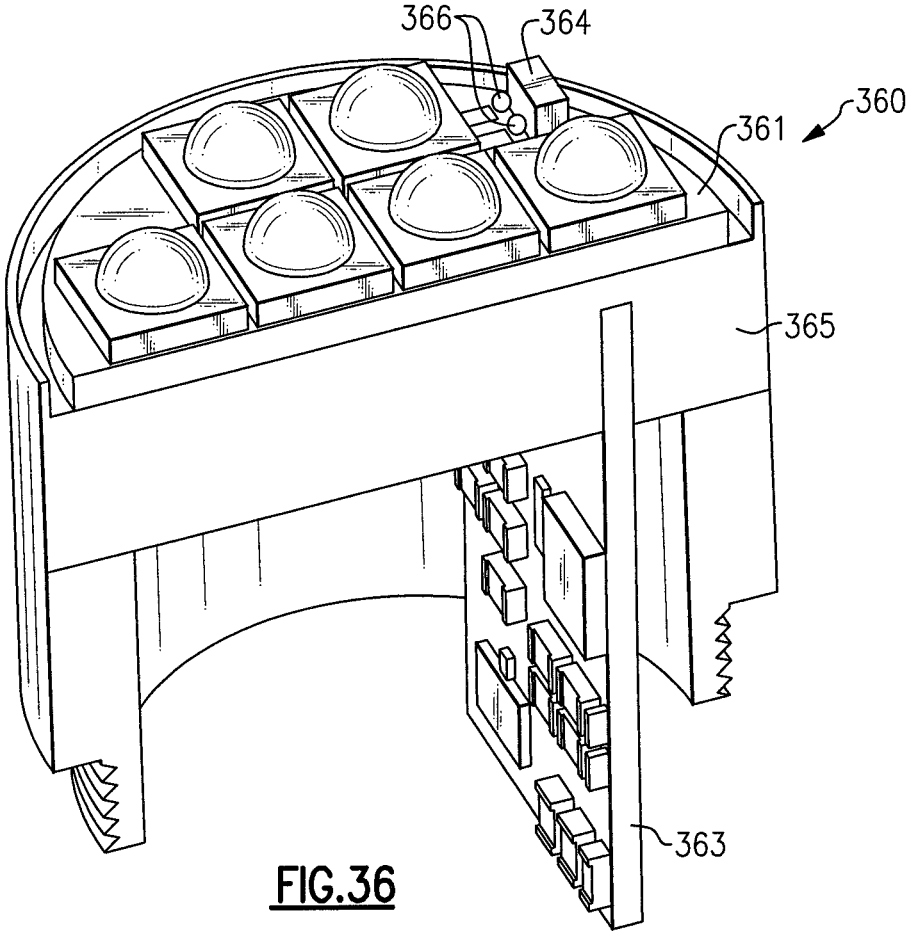

FIG. 36 is a perspective cross-sectional view of a portion of a light engine module 360 that comprises a first circuit board 361 which is attached to one side of a first support structure 365, and a second circuit board 363 which is positioned such that its major surfaces are substantially perpendicular to those of the first circuit board 361.

Figure 37:
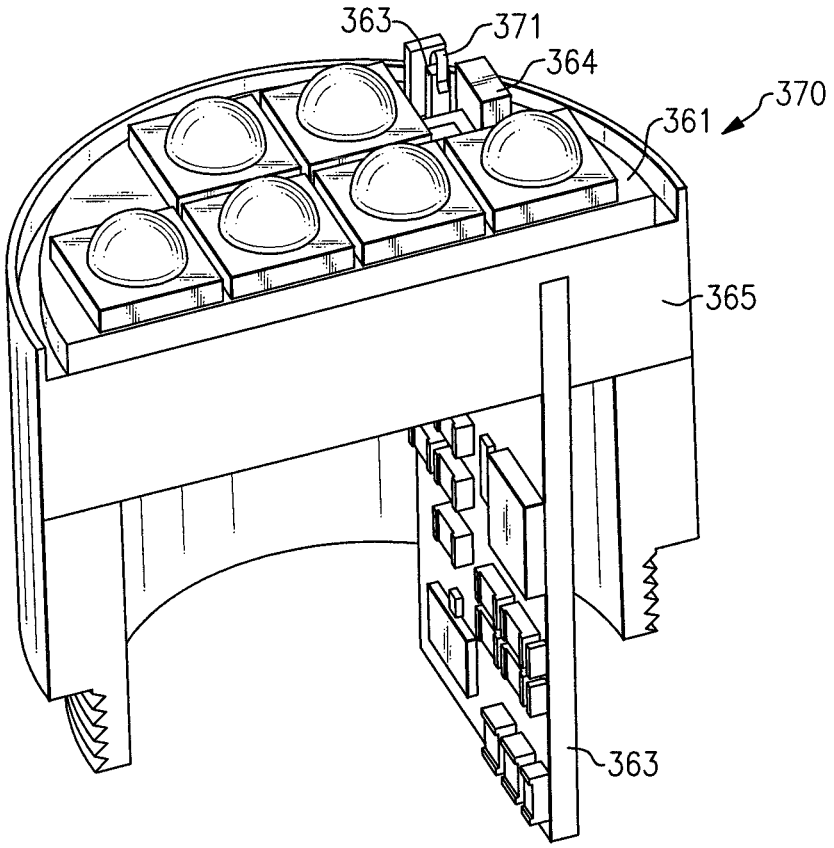

FIG. 37 is a perspective cross-sectional view of a portion of a light engine module 370.

Figure 38:
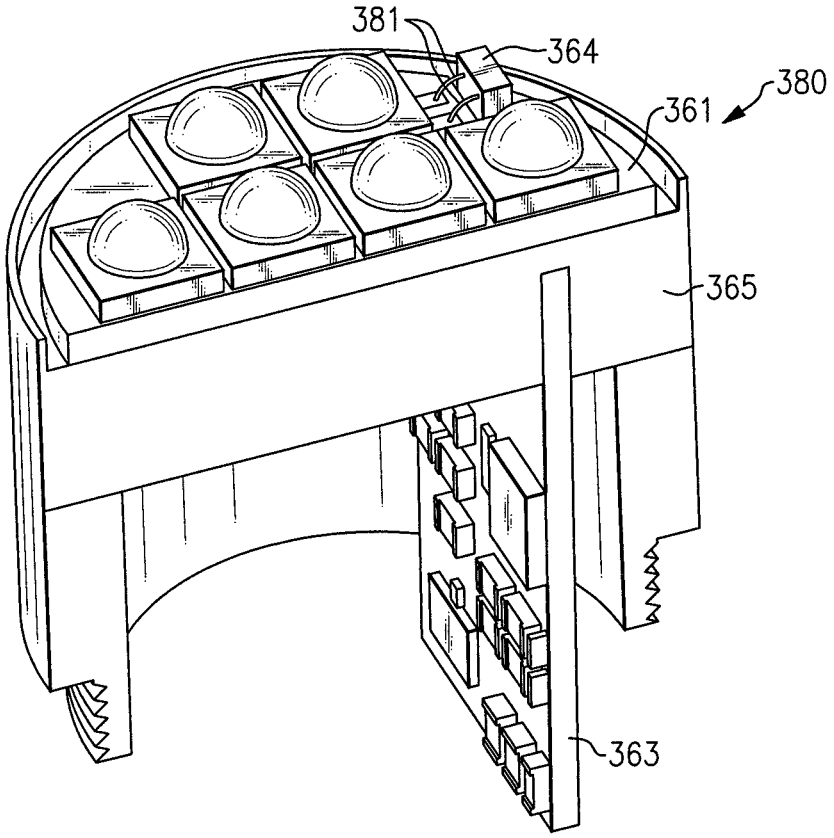

FIG. 38 is a perspective cross-sectional view of a portion of a light engine module 380.

Figure 39:
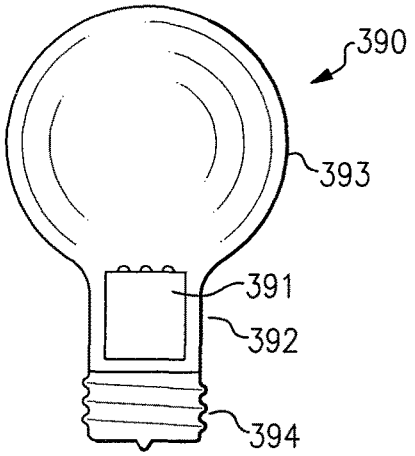

FIG. 39 is a sectional view of a lighting device 390 that comprises a light engine module 391, a housing member 392, a lens 393 and an electrical connector 394.

Figure 40:
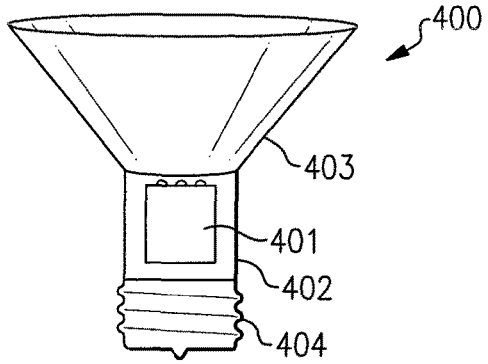

FIG. 40 is a sectional view of a lighting device 400 that comprises a light engine module 401, a housing member 402, a reflector 403 and an electrical connector 404.

Figure 41:
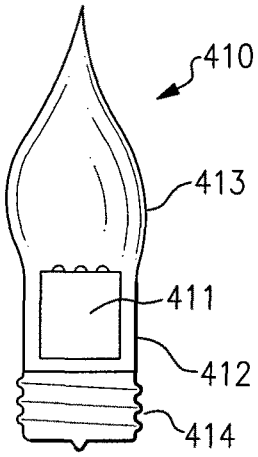

FIG. 41 is a sectional view of a lighting device 410 that comprises a light engine module 411, a housing member 412, a lens 413 and an electrical connector 414.

Figure 42:
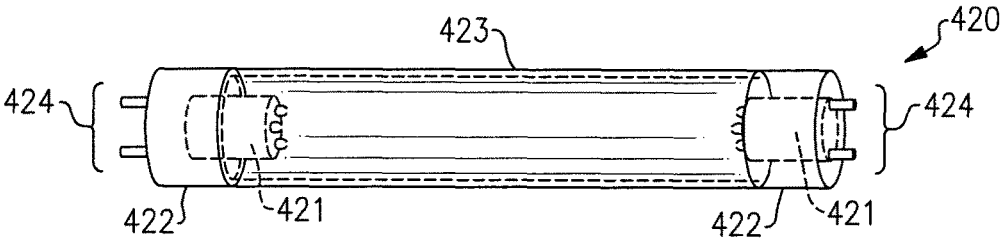

FIG. 42 is a sectional view of a lighting device 420 that comprises first and second light engine modules 421, first and second housing members 422, a lens 423 and a pair of electrical connectors 424.

Figure 43:
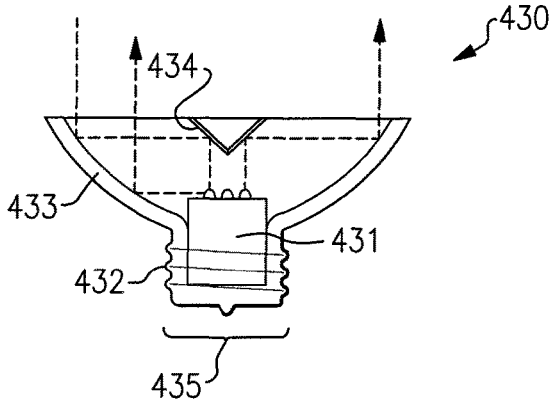

FIG. 43 is a sectional view of a lighting device 430 that comprises a light engine module 431, a housing member 432, a first reflector 433, a second reflector 434 and an electrical connector 435.

Figure 44:
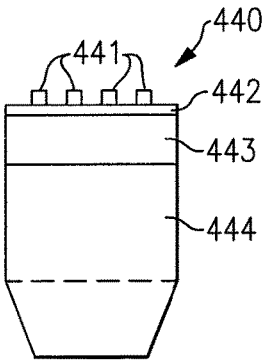

FIG. 44 is a front view of a light engine module 440.

Figure 45:
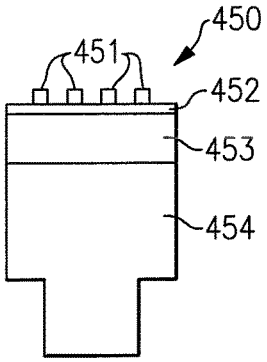

FIG. 45 is a front view of a light engine module 450.

Figure 46:
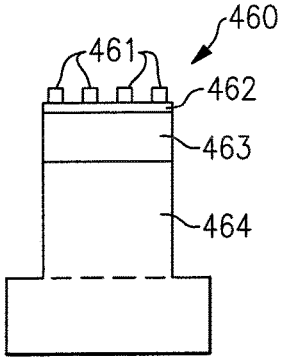

FIG. 46 is a front view of a light engine module 460.

Figure 47:
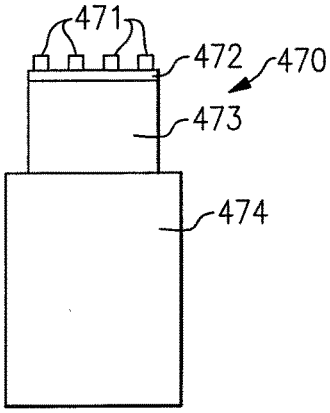

FIG. 47 is a front view of a light engine module 470.

Figure 48:
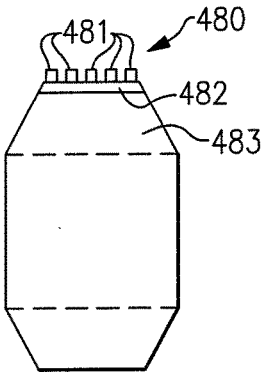

FIG. 48 is a front view of a light engine module 480.

Figure 49:
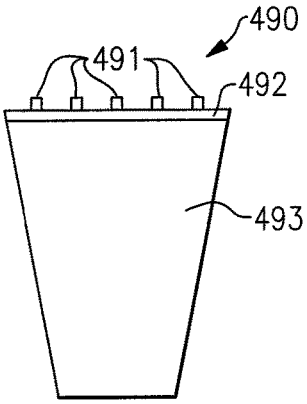

FIG. 49 is a front view of a light engine module 490.

Figure 50:
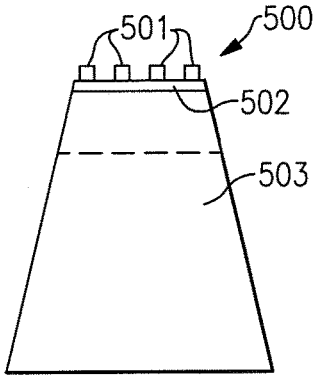

FIG. 50 is a front view of a light engine module 500.

Figure 51:
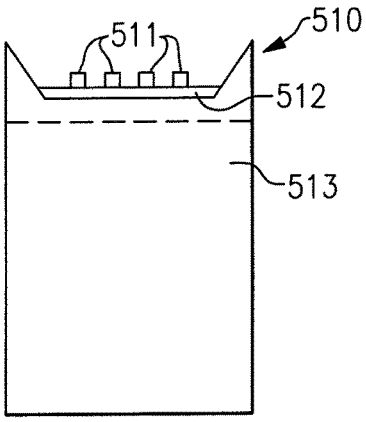

FIG. 51 is a front view of a light engine module 510.

Figure 52:
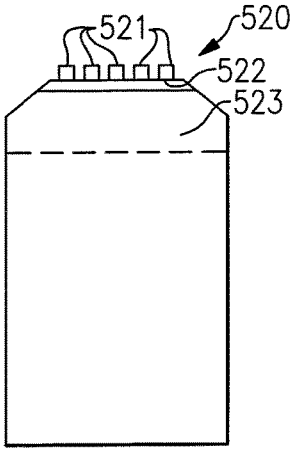

FIG. 52 is a front view of a light engine module 520.

Figure 53:
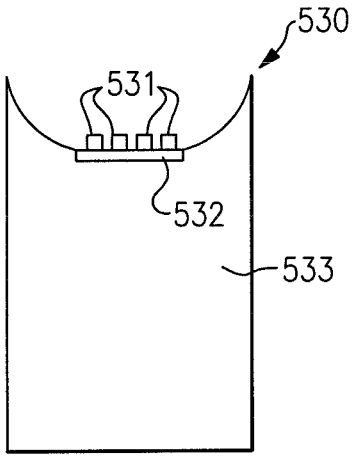

FIG. 53 is a front view of a light engine module 530.

Figure 54:
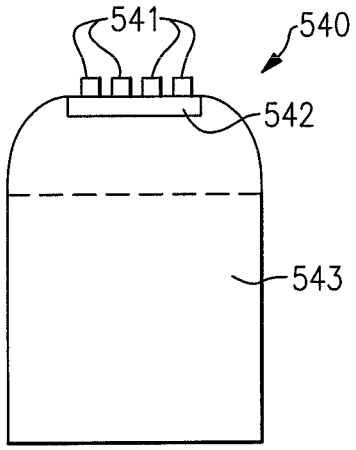

FIG. 54 is a front view of a light engine module 540.

Figure 55:
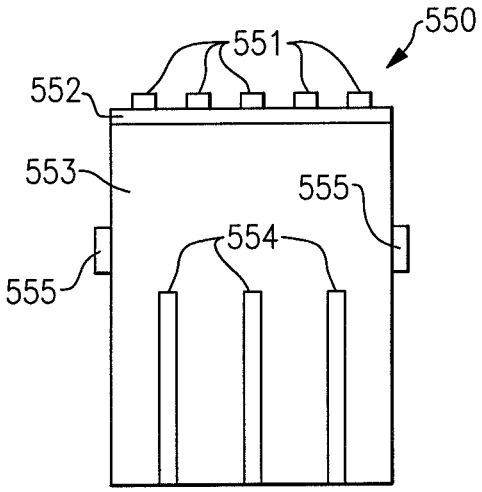

FIG. 55 is a front view of a light engine module 550.

Figure 56:
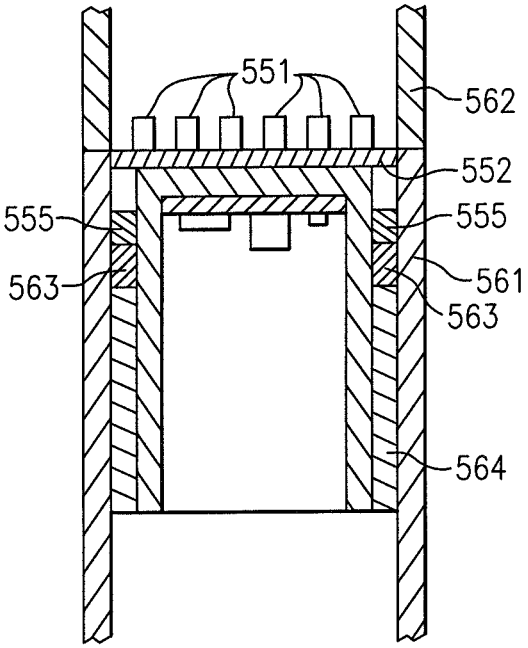

FIG. 56 is a cross-sectional view of the light engine module 550 mounted in a lighting device element.

Figure 57:
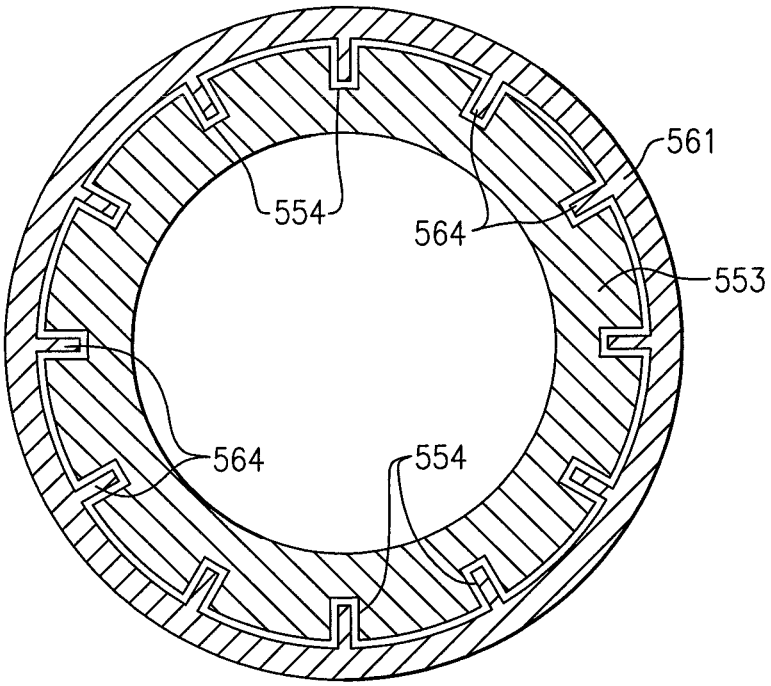

FIG. 57 is a top view of the light engine module 550 mounted in the housing member 561.

Figure 58:
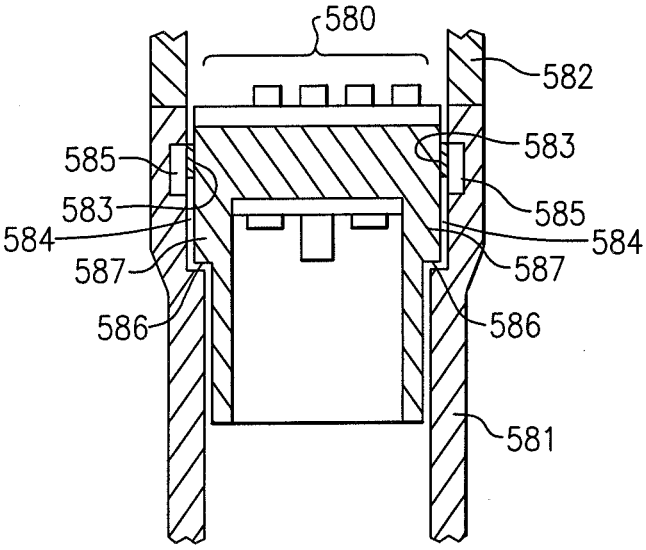

FIG. 58 is a cross-sectional view of a light engine module 580 mounted in a lighting device element.

Figure 59:
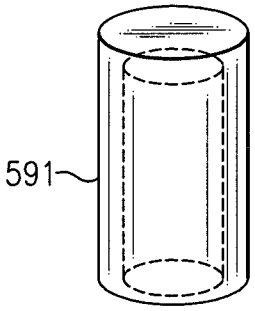

FIG. 59 is a perspective view of a first support structure 591.

Figure 60:
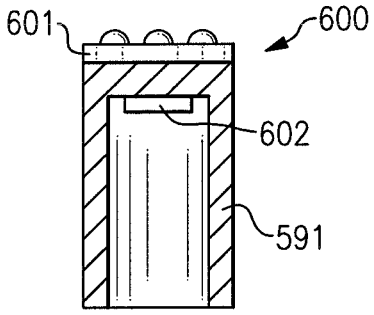

FIG. 60 is a sectional view of a light engine module 600 that comprises the first support structure 591, a first circuit board 601 which is attached to the first support structure 591 and a second circuit board 602 also attached to the first support structure 591.

Figure 61:
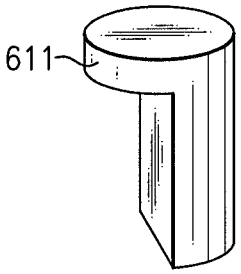

FIG. 61 is a perspective view of a first support structure 611.

Figure 62:
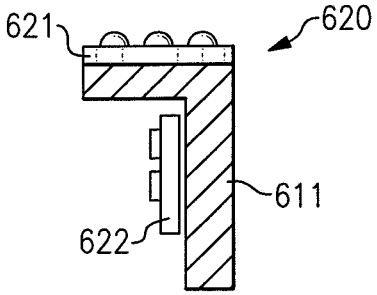

FIG. 62 is a sectional view of a light engine module 620 that comprises the first support structure 611, a first circuit board 621 which is attached to the first support structure 611 and a second circuit board 622 also attached to the first support structure 611.

Figure 63:
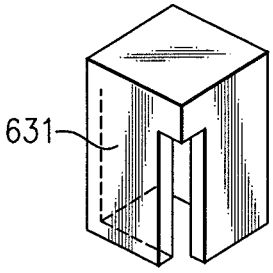

FIG. 63 is a perspective view of a first support structure 631.

Figure 64:
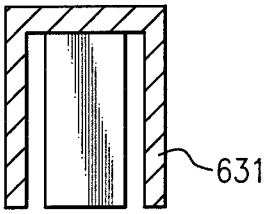

FIG. 64 is a sectional view of the first support structure 631.

Figure 65:
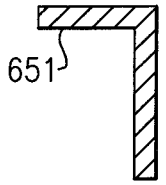

FIG. 65 is a sectional view of a first support structure 651.

Figure 66:
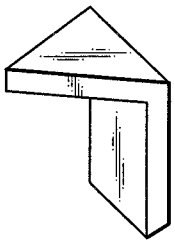

FIG. 66 is a perspective view of the first support structure 651.

Figure 67:
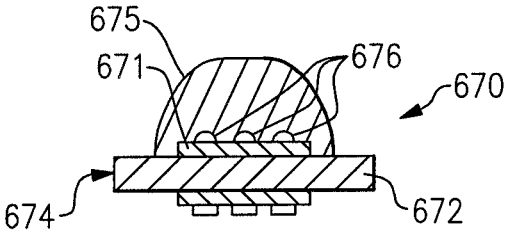

FIG. 67 is a sectional view depicting a light engine module 670.

Figure 68:
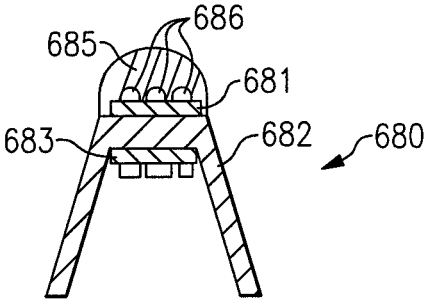

FIG. 68 is a sectional view depicting a light engine module 680.

Figure 69:
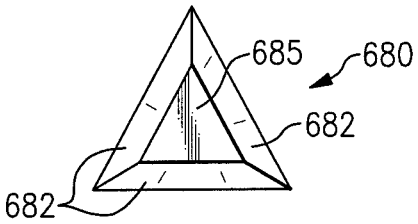

FIG. 69 is a top view of the light engine module 680.

Figure 70:
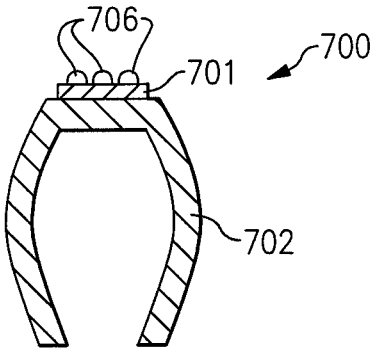

FIG. 70 is a sectional view depicting a light engine module 700.

Figure 71:
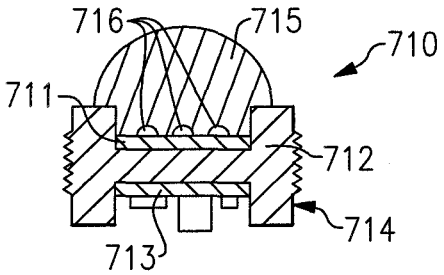

FIG. 71 is a sectional view depicting a light engine module 710.

Figure 72:
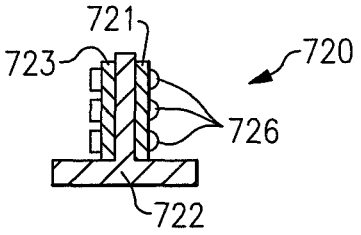

FIG. 72 is a sectional view depicting a light engine module 720.

Figure 73:
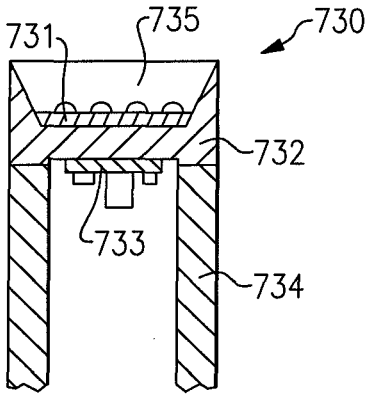

FIG. 73 is a sectional view depicting a light engine module 730.

Figure 74:
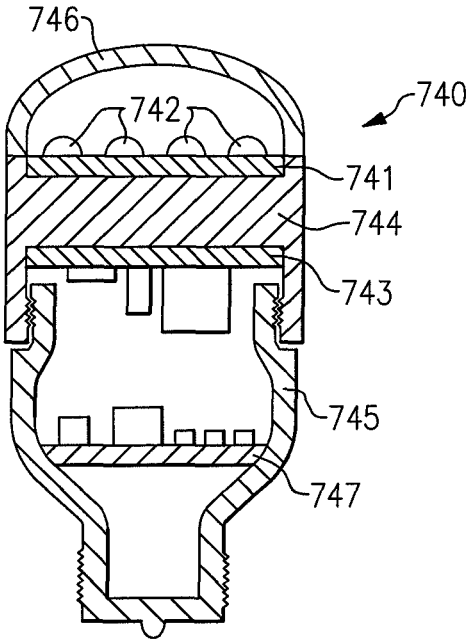

FIG. 74 is a sectional view of a lighting device 740.

Figure 75:
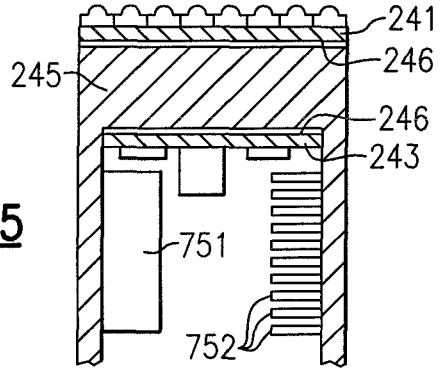

FIG. 75 depicts a portion of a light engine module 750.

Figure 76:
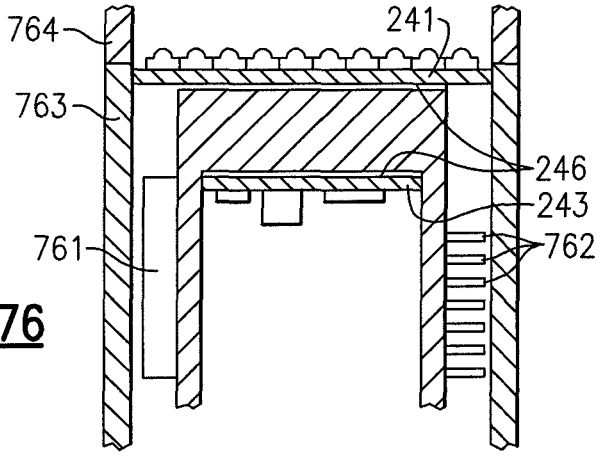

FIG. 76 depicts a portion of a light engine module 760.

Figure 77:
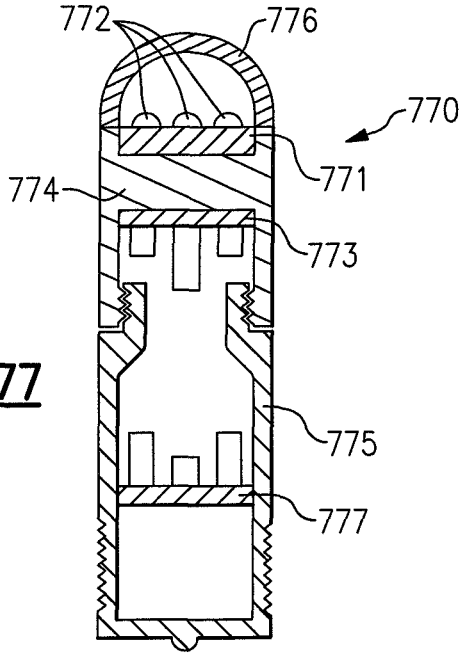

FIG. 77 is a sectional view of a lighting device 770.

Figure 78:
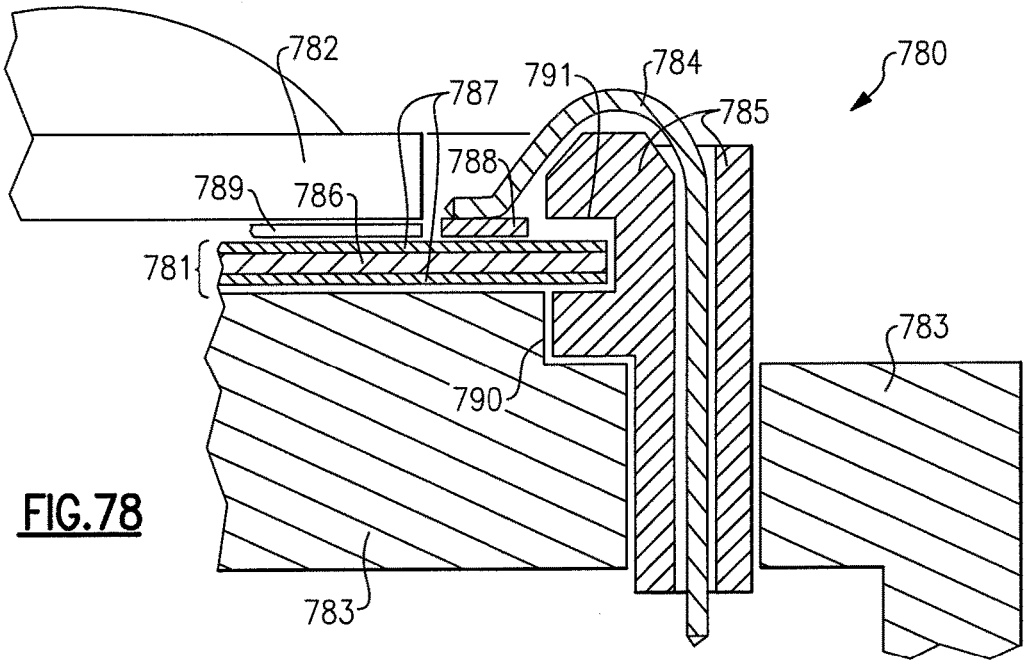

FIG. 78 is a sectional view of a portion of a light engine module 780.

Figure 79:
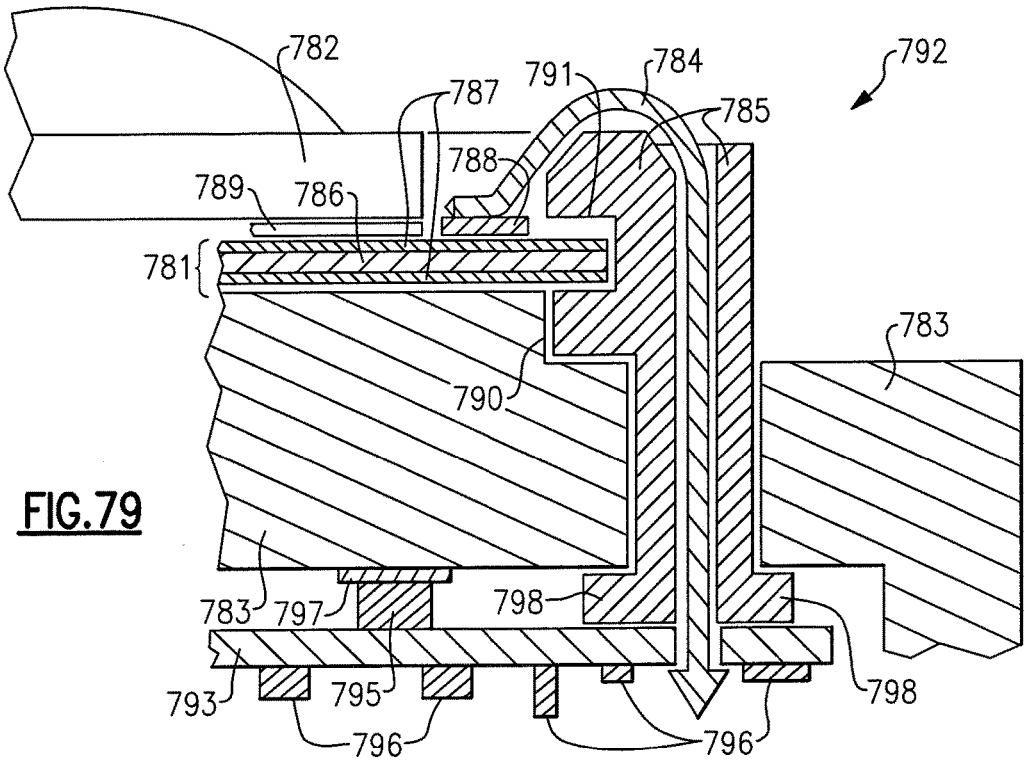

FIG. 79 is a sectional view of a portion of a light engine module 792.

Figure 80:
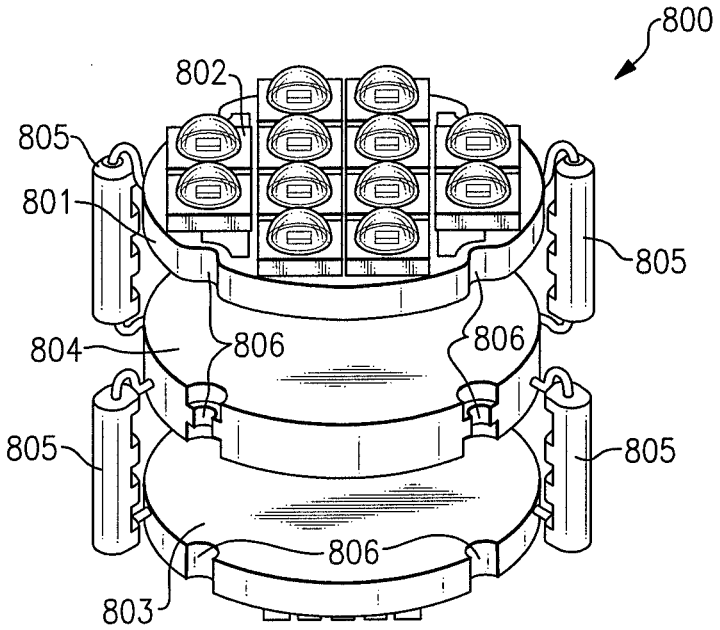

FIG. 80 is an exploded perspective view of a portion of a light engine module 800.

Figure 81:
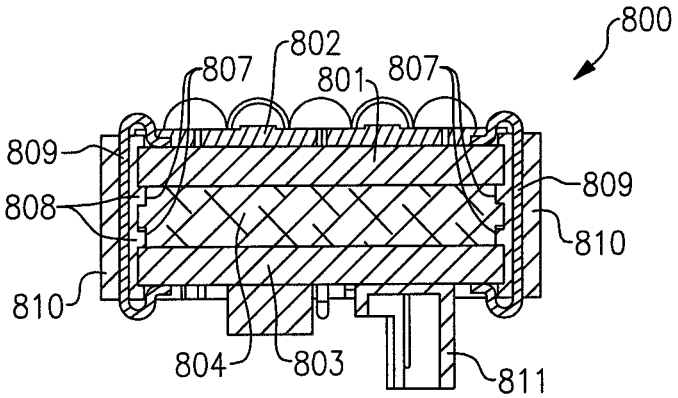

FIG. 81 is a sectional view of the light engine module 800 shown in FIG. 80.

Figure 82:
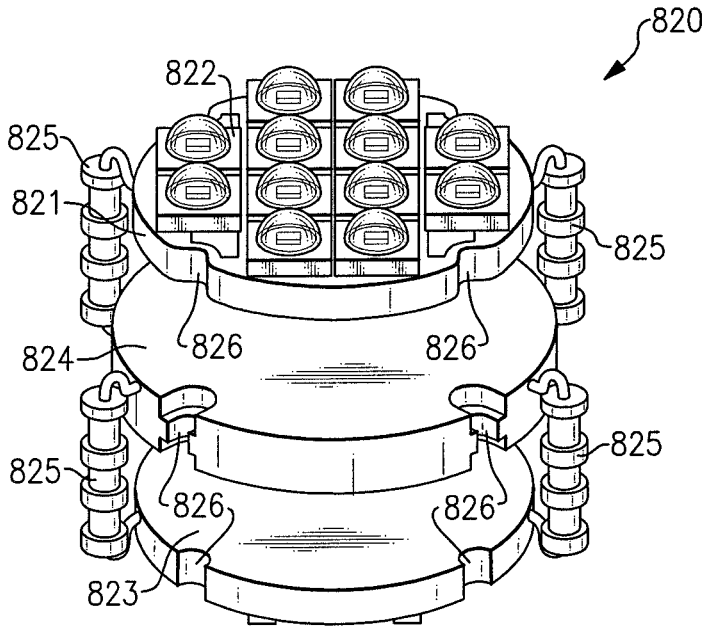

FIG. 82 is an exploded perspective view of a portion of a light engine module 820.

Figure 83:
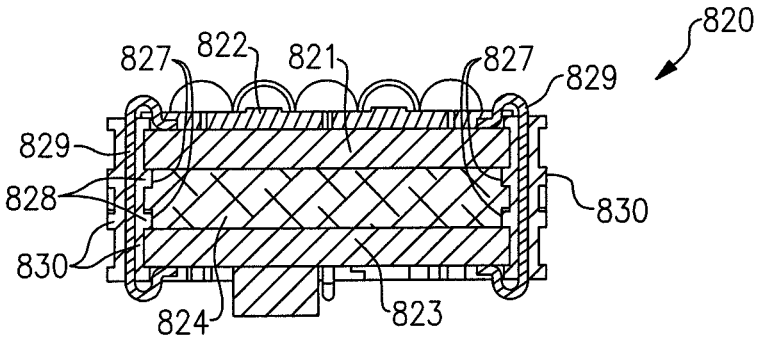

FIG. 83 is a sectional view of the light engine module 820 shown in FIG. 82.

Figure 84:
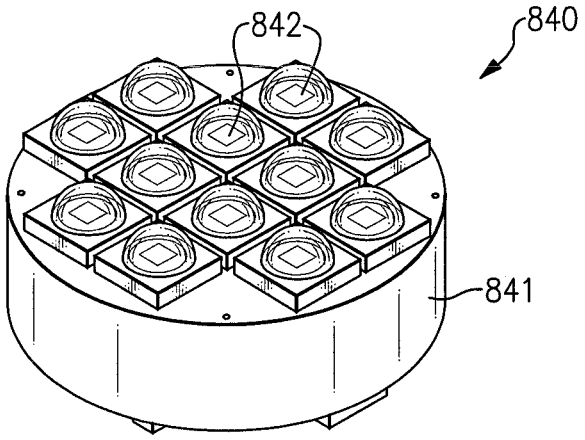
Figure 85:
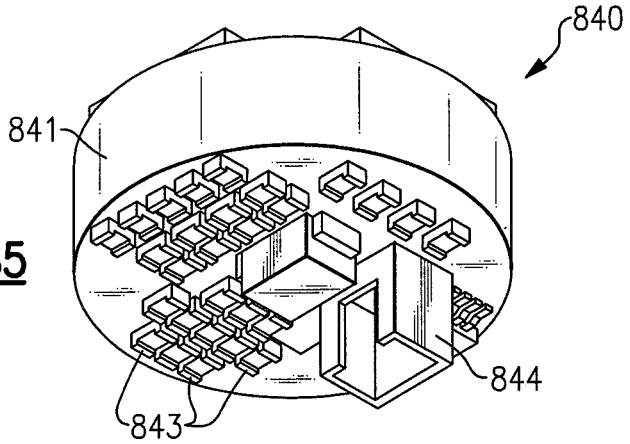

FIGS. 84 and 85 are perspective views of a light engine module 840.

Figure 86:
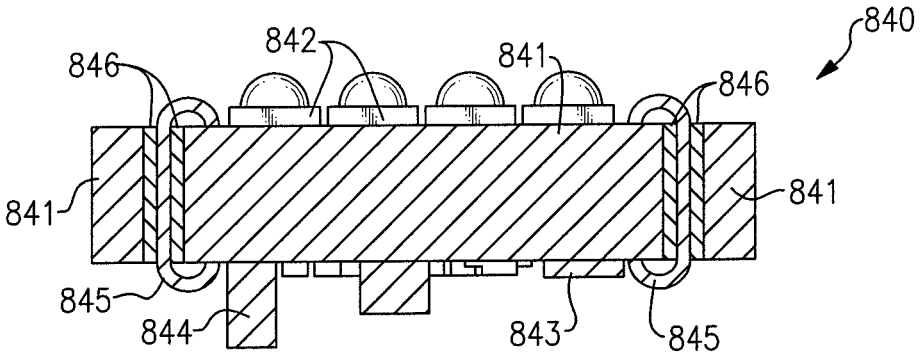

FIG. 86 is a sectional view of the light engine module 840.

Figure 87:
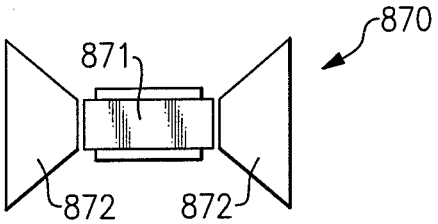

FIG. 87 is a conceptual view of a light engine module 870.

Figure 88:
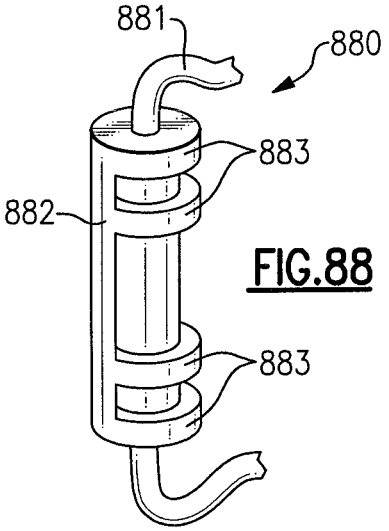

FIG. 88 is a perspective view of an electrical connection structure 880.

Figure 89:
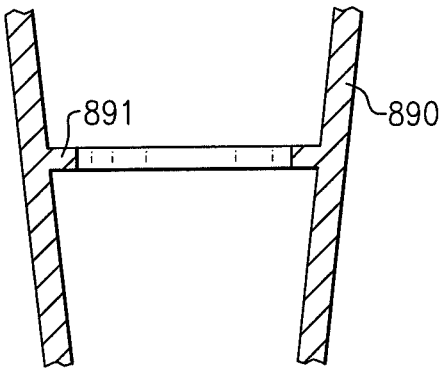

FIG. 89 is a sectional front view of a lighting device element 890.

Figure 90:
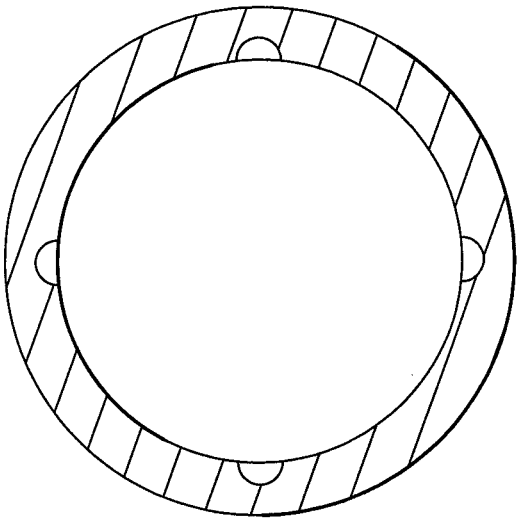

FIG. 90 is a sectional top view of a lighting device element 990.

Figure 91:
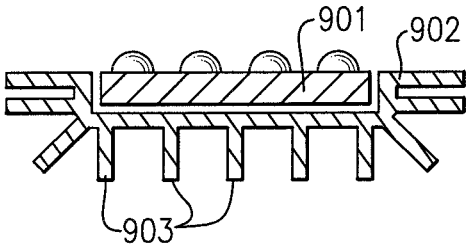

FIG. 91 is a sectional view of a light engine element comprising a light engine module 901 and an interface element 902 connected to the light engine module.

Figure 92:
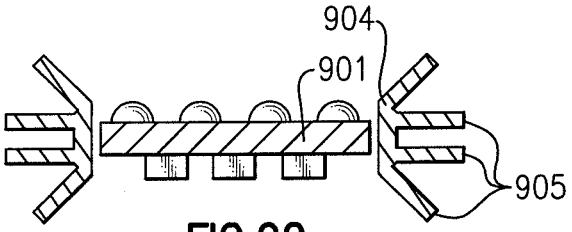

FIG. 92 is a sectional view of a light engine element comprising a light engine module 901 and an interface element 904 connected to the light engine module.

Figure 93:
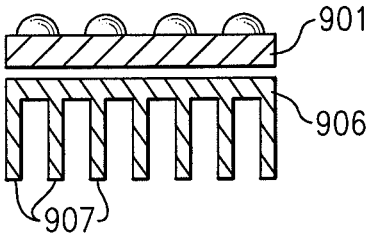

FIG. 93 is a sectional view of a light engine element comprising a light engine module 901 and an interface element 906 connected to the light engine module.

Figure 94:
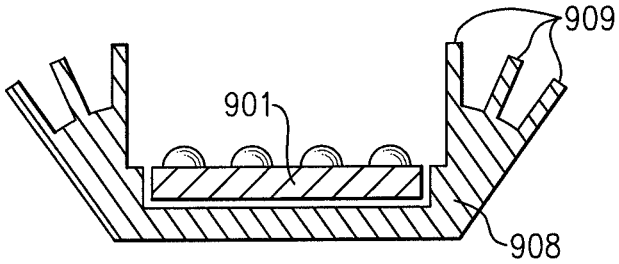

FIG. 94 is a sectional view of a light engine element comprising a light engine module 901 and an interface element 908 connected to the light engine module.

Figure 95:
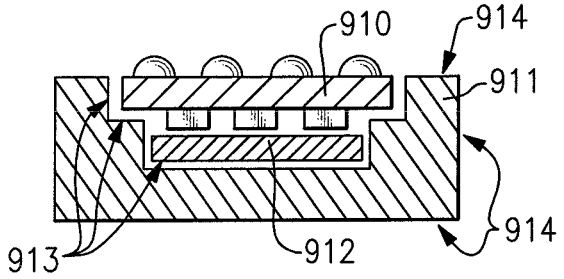

FIG. 95 is a sectional view of a light engine element comprising a light engine module 910 and an interface element 911 connected to the light engine module.

Figure 96:
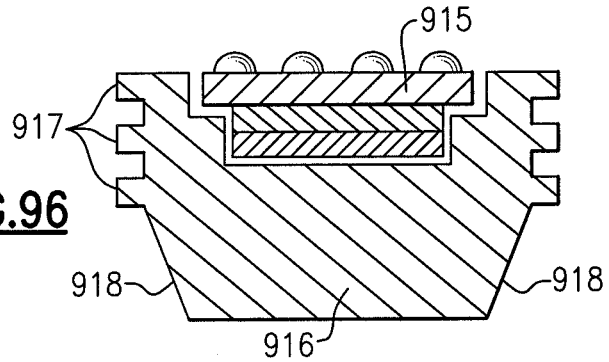

FIG. 96 is a sectional view of a light engine element comprising a "standard" light engine module 915 and an interface element 916 connected to the light engine module.

Figure 97:
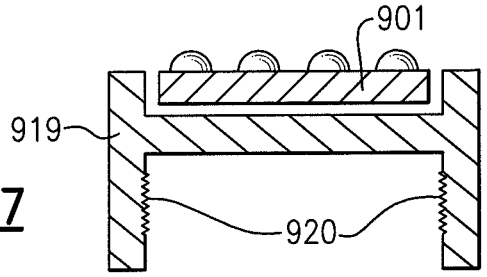

FIG. 97 is a sectional view of a light engine element comprising a light engine module 901 and an interface element 919 connected to the light engine module.

Figure 98:
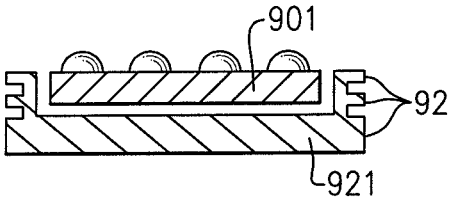

FIG. 98 is a sectional view of a light engine element comprising a light engine module 901 and an interface element 921 connected to the light engine module.

Figure 99:
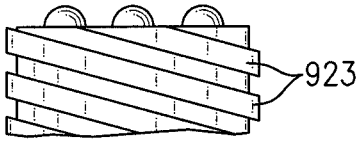

FIG. 99 is a front view of the light engine element shown in FIG. 98.

Figure 100:
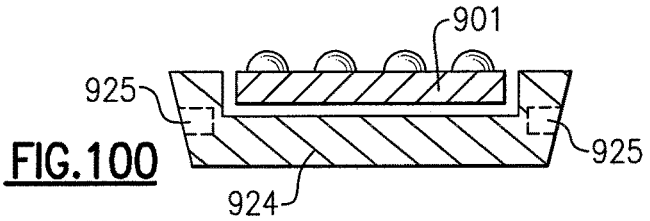

FIG. 100 is a sectional view of a light engine element comprising a light engine module 901 and an interface element 924 connected to the light engine module.

Figure 101:
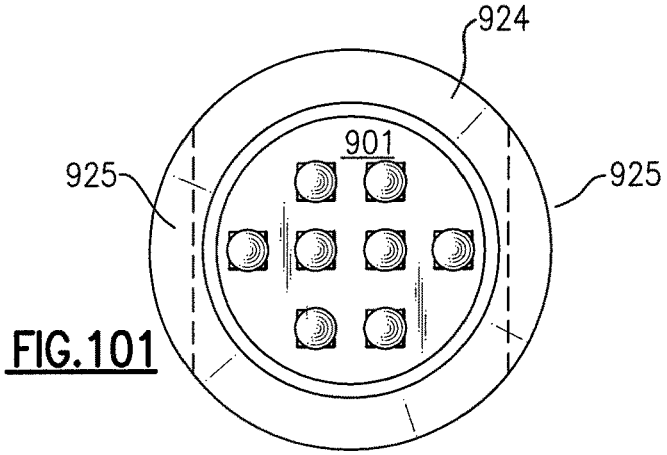

FIG. 101 is a front view of the light engine element shown in FIG. 100.

Figure 102:
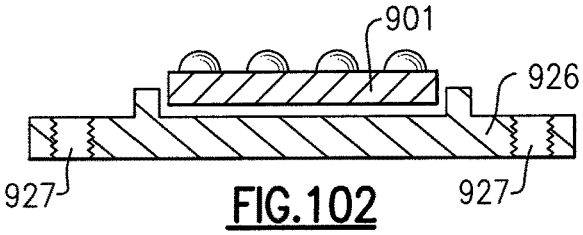

FIG. 102 is a sectional view of a light engine element comprising a light engine module 901 and an interface element 926 connected to the light engine module.

Figure 103:
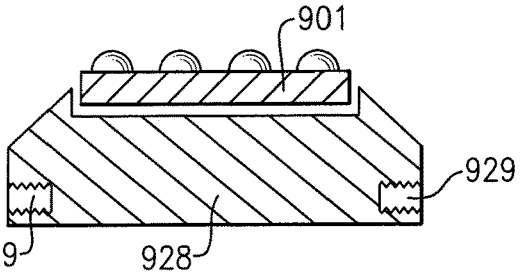

FIG. 103 is a sectional view of a light engine element comprising a light engine module 901 and an interface element 928 connected to the light engine module.

Figure 104:
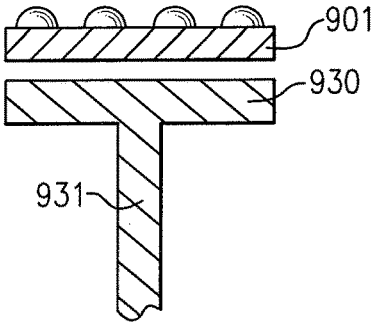

FIG. 104 is a sectional view of a light engine element comprising a light engine module 901 and an interface element 930 connected to the light engine module.

Figure 105:
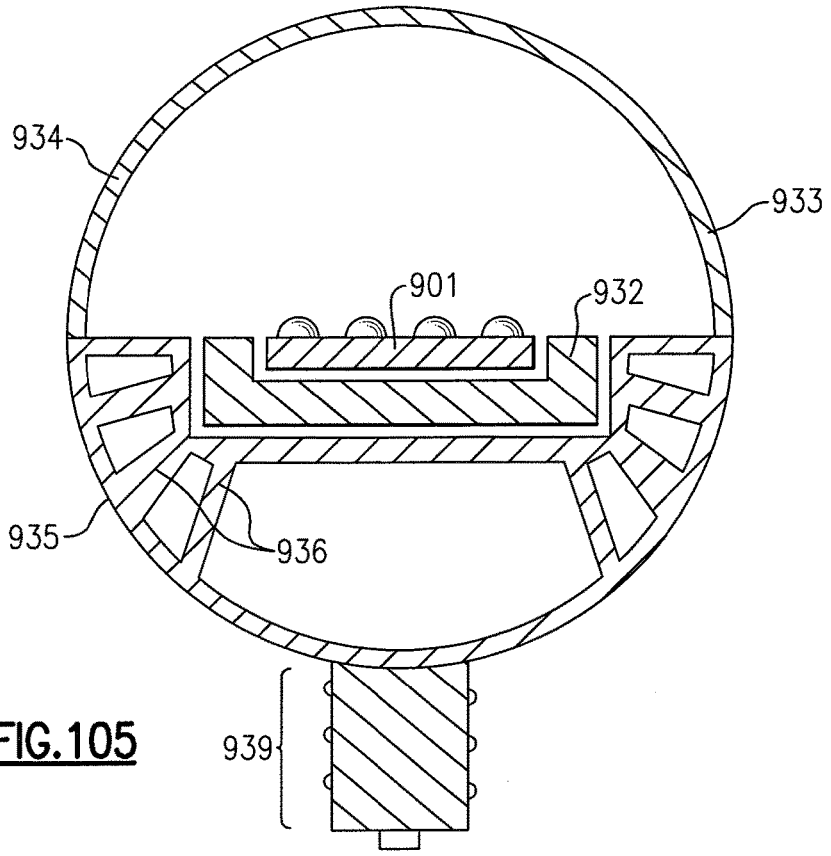

FIG. 105 is a sectional view of a lighting device comprising a light engine module 901, an interface element 932 connected to the light engine module, a lighting device element 933 to which the interface element 932 is connected, and an electrical connector 939.

Figure 106:
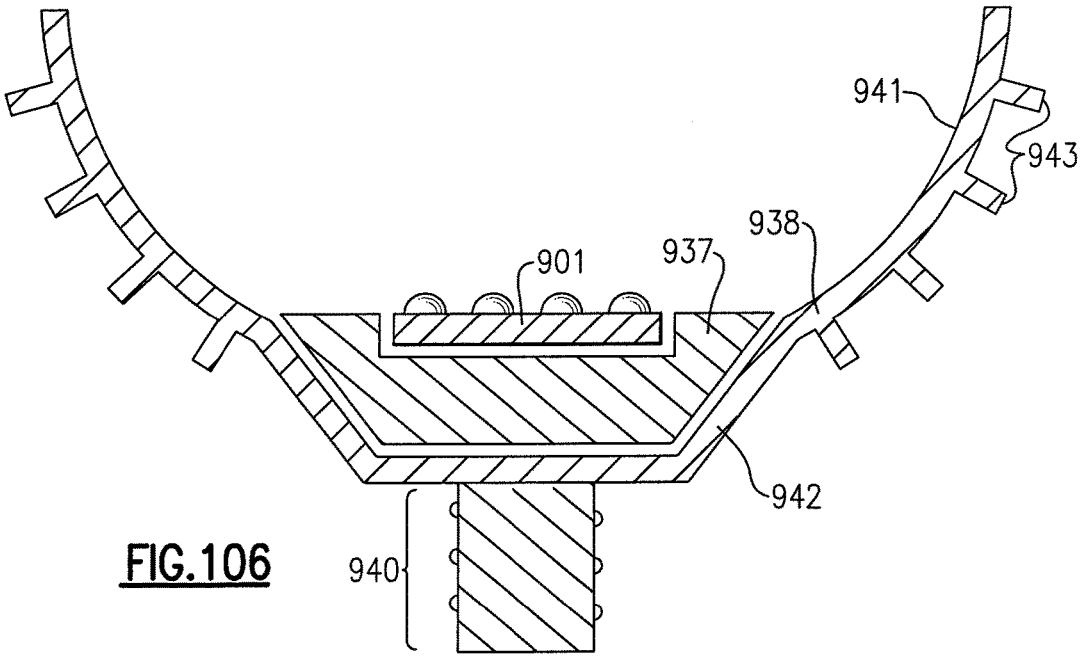

FIG. 106 is a sectional view of a lighting device comprising a light engine module 901, an interface element 937 connected to the light engine module, a lighting device element 938 to which the interface element 932 is connected, and an electrical connector 940.

Figure 107:
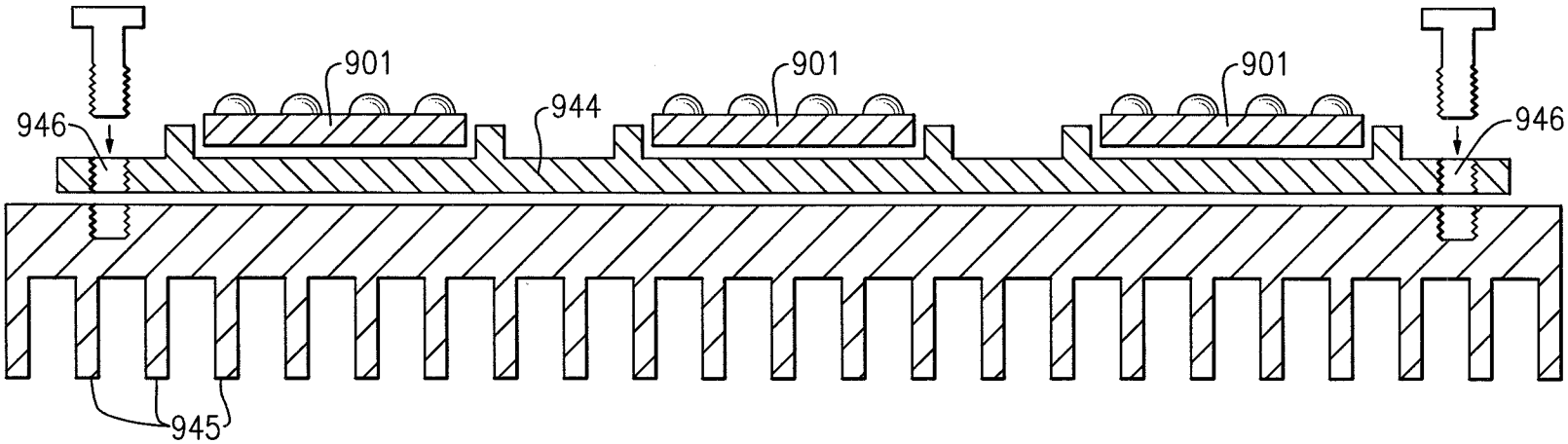

FIG. 107 is a sectional view of a light engine element comprising a plurality of light engine modules 901 and an interface element 944 connected to the light engine module.

Figure 108:
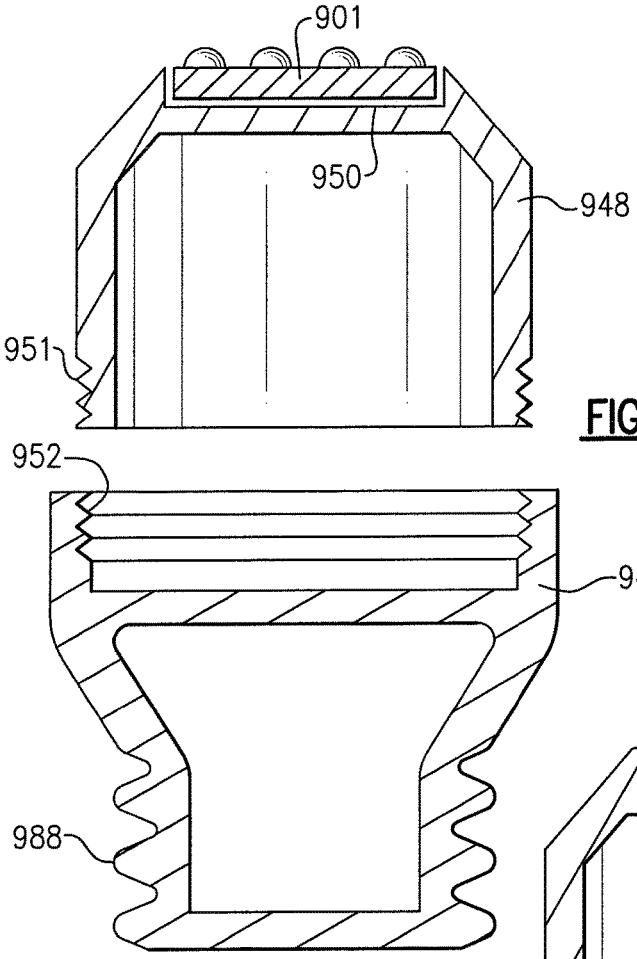

FIG. 108 is a sectional view of a lighting device comprising a light engine module 901, an interface element 948 connected to the light engine module 901, a housing member 949 to which the interface element 948 is connected and an electrical connector 988.

Figure 109:
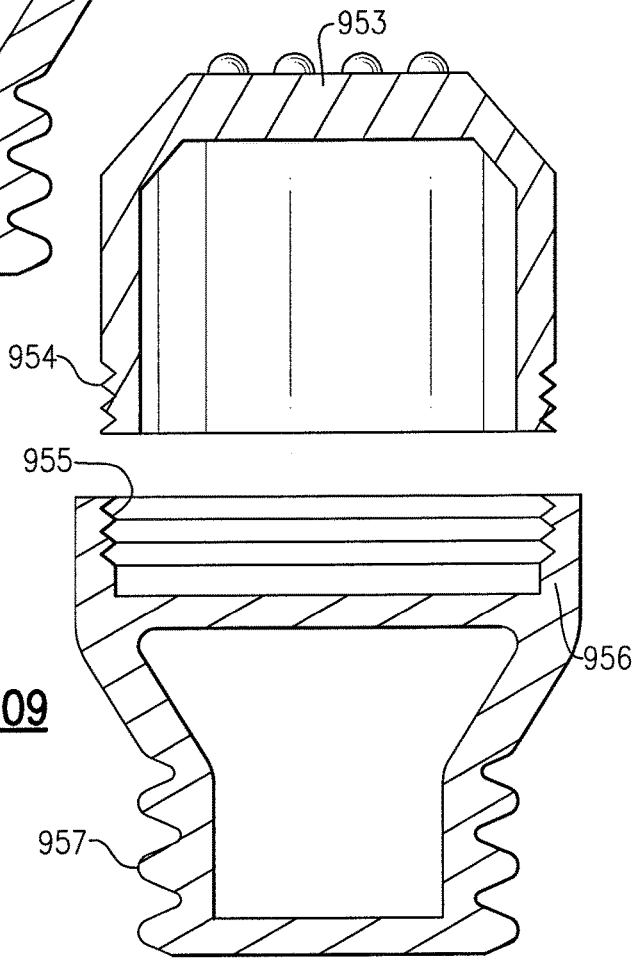

FIG. 109 is a sectional view of a lighting device comprising a light engine module 953 that comprises an array of solid state light emitters and an interface element, a housing member 956, and an electrical connector 957.

Figure 110:
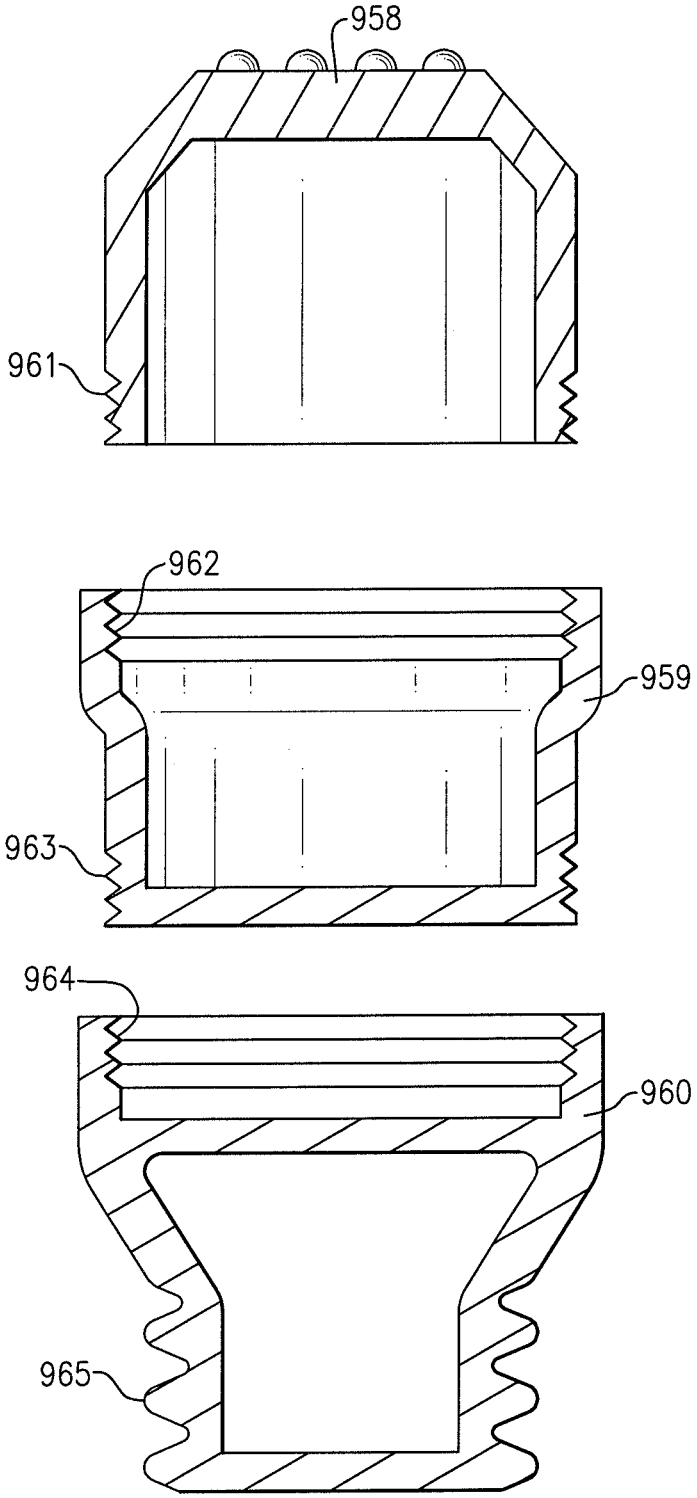

FIG. 110 is a sectional view of a lighting device comprising a light engine module 958, an interface element 959 connected to the light engine module 958, a housing member 960 to which the interface element 959 is connected, and an electrical connector 965.

Figure 111:
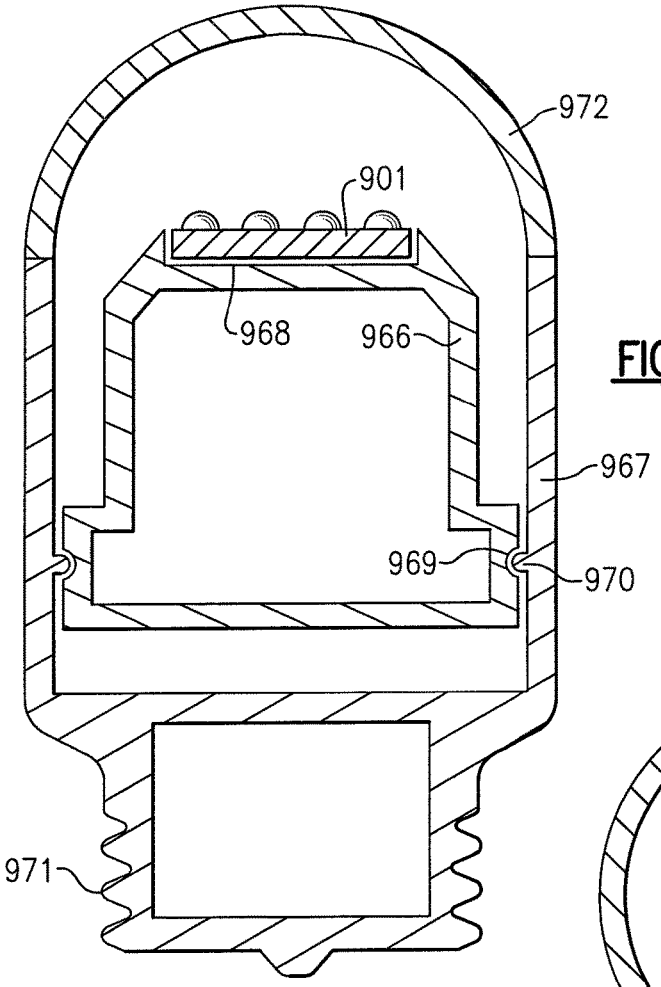

FIG. 111 is a sectional view of a lighting device comprising a light engine module 901, an interface element 966 connected to the light engine module 901, a housing member 967 to which the interface element 966 is connected, a lens 972, and an electrical connector 971.

Figure 112:
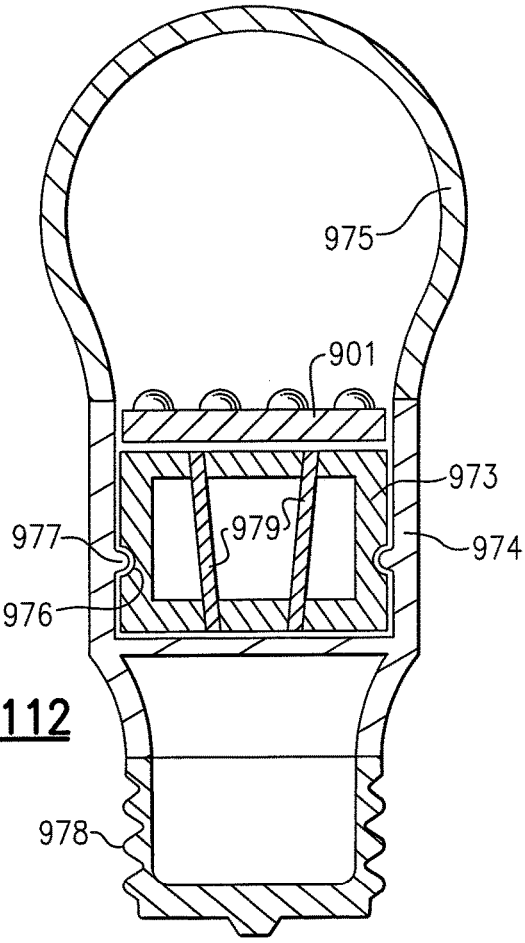

FIG. 112 is a sectional view of a lighting device comprising a light engine module 901, an interface element 973 connected to the light engine module 901, a housing member 974 to which the interface element 973 is connected, a lens 975 and an electrical connector 978.

Figure 113:
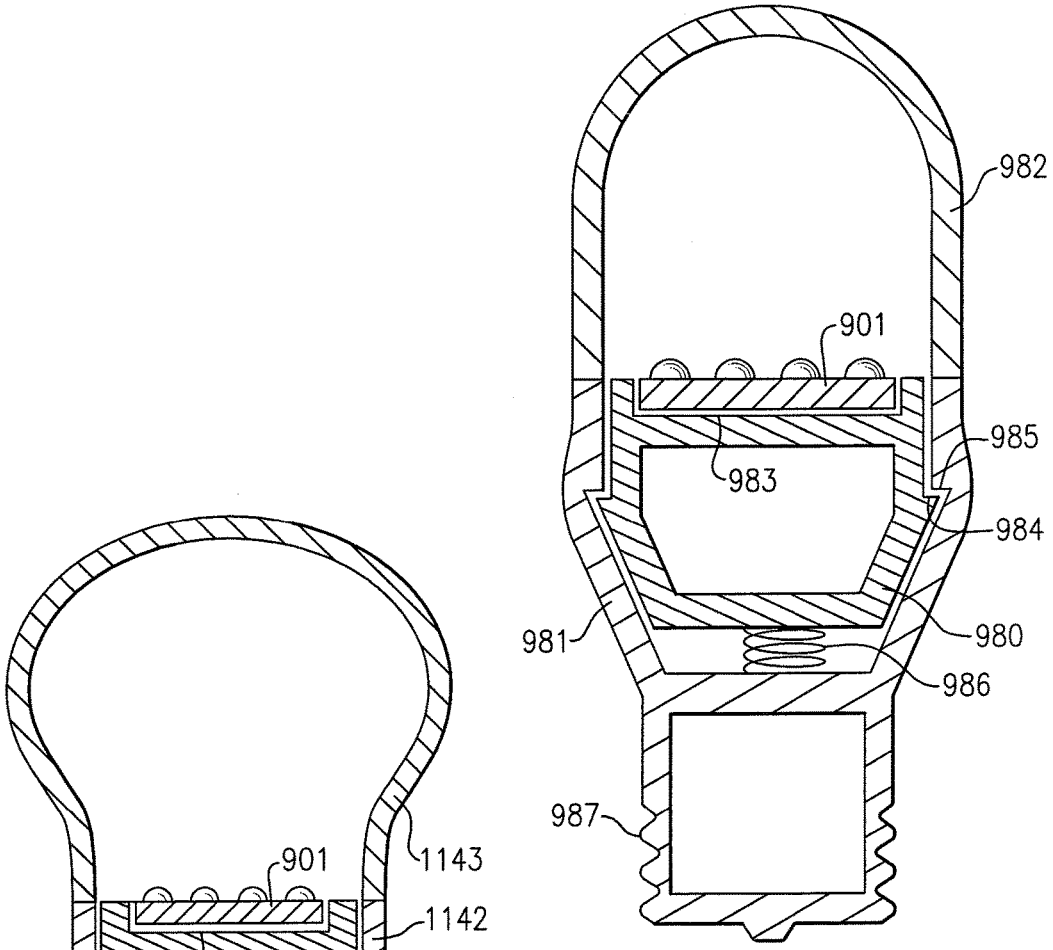

FIG. 113 is a sectional view of a lighting device comprising a light engine module 901, an interface element 980 connected to the light engine module 901, a housing member 981 to which the interface element 980 is connected, a lens 982, an electrical connector 987, and a spring element 986.

Figure 114:
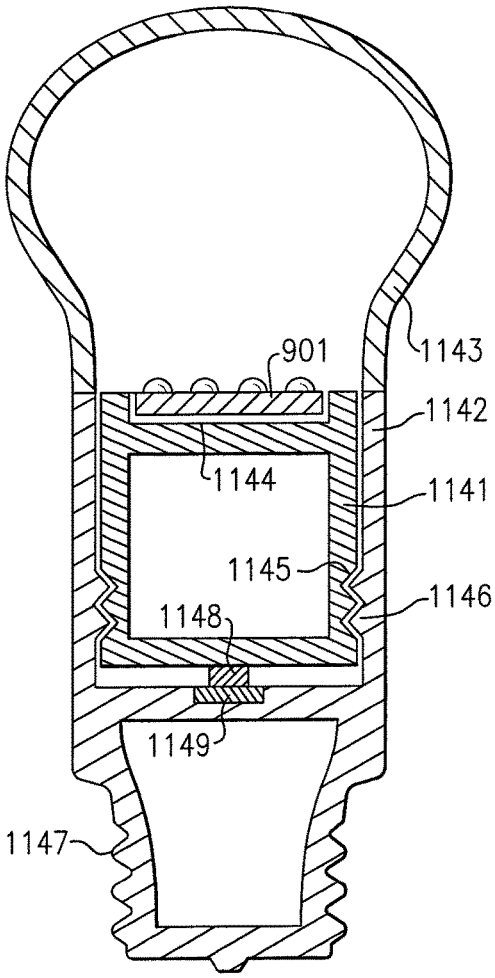

FIG. 114 is a sectional view of a lighting device comprising a light engine module 901, an interface element 1141 connected to the light engine module 901, a housing member 1142 to which the interface element 1141 is connected, a lens 1143, and an electrical connector 1147.

Figure 115:
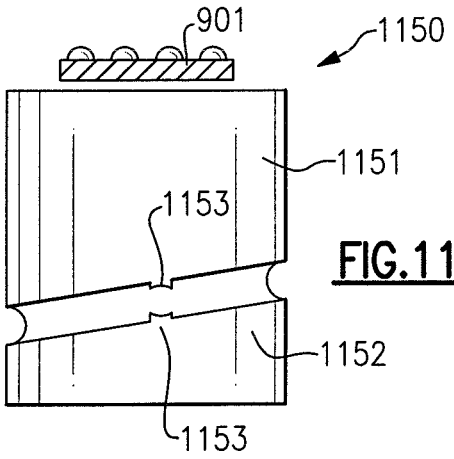

FIG. 115 is a front elevation view of a light engine element 1150 comprising a light engine module 901 and an interface element 1151 connected to the light engine module 901.

Figure 116:
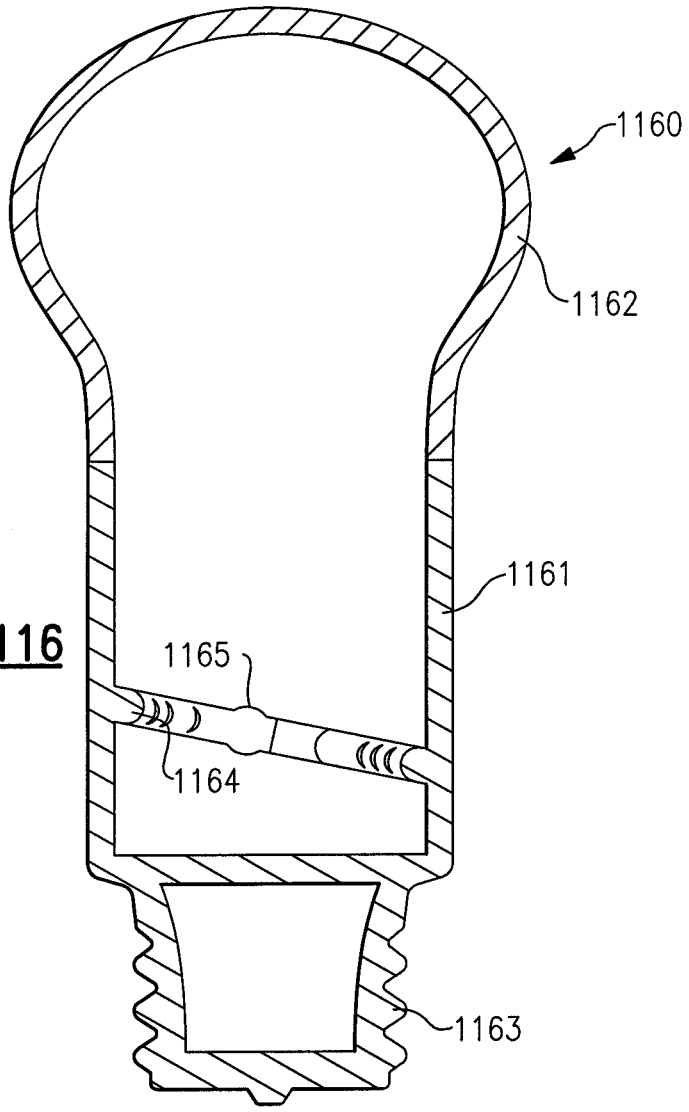

FIG. 116 is a sectional view of a lighting device element 1160 that comprises a housing member 1161, a lens 1162 and an electrical connector 1163.

Figure 117:
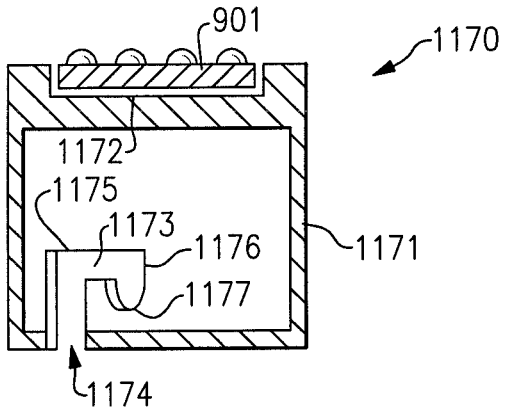

FIG. 117 is a sectional view of a light engine element 1170 comprising a light engine module 901 and an interface element 1171 connected to the light engine module 901.

Figure 118:
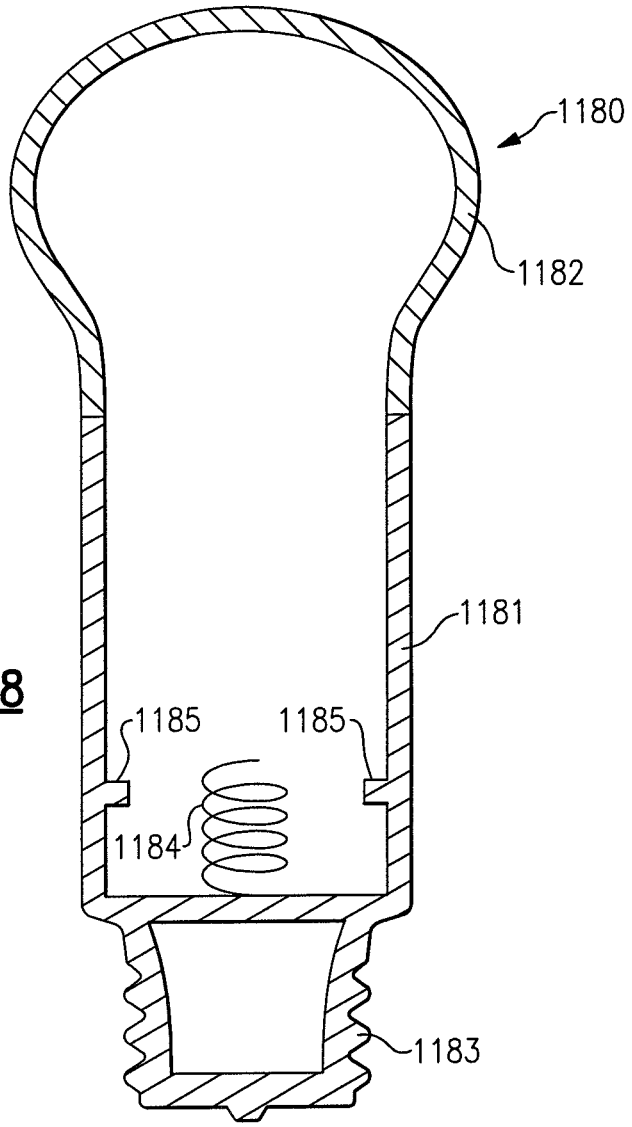

FIG. 118 is a sectional view of a lighting device element 1180 that comprises a housing member 1181, a lens 1182, an electrical connector 1183 and a spring element 1184.

Figure 119:
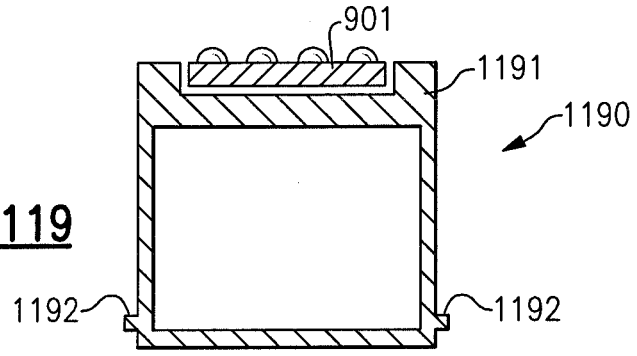

FIG. 119 is a sectional view of a light engine element 1190 comprising a light engine module 901 and an interface element 1191 connected to the light engine module 901.

Figure 120:
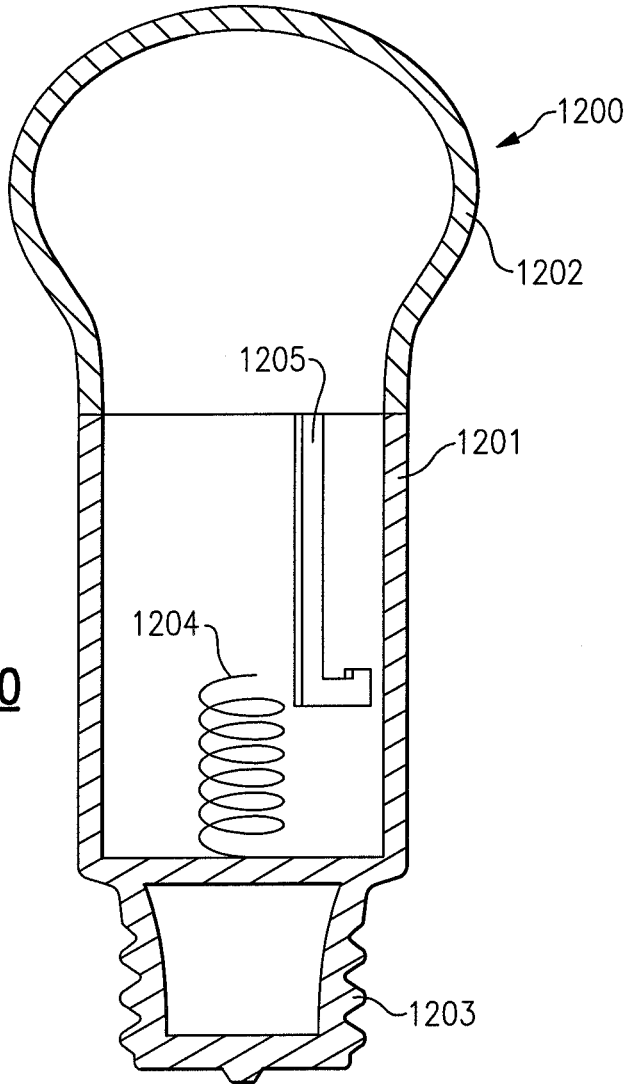

FIG. 120 is a sectional view of a lighting device element 1200 that comprises a housing member 1201, a lens 1202, an electrical connector 1203 and a spring element 1204.

Figure 121:
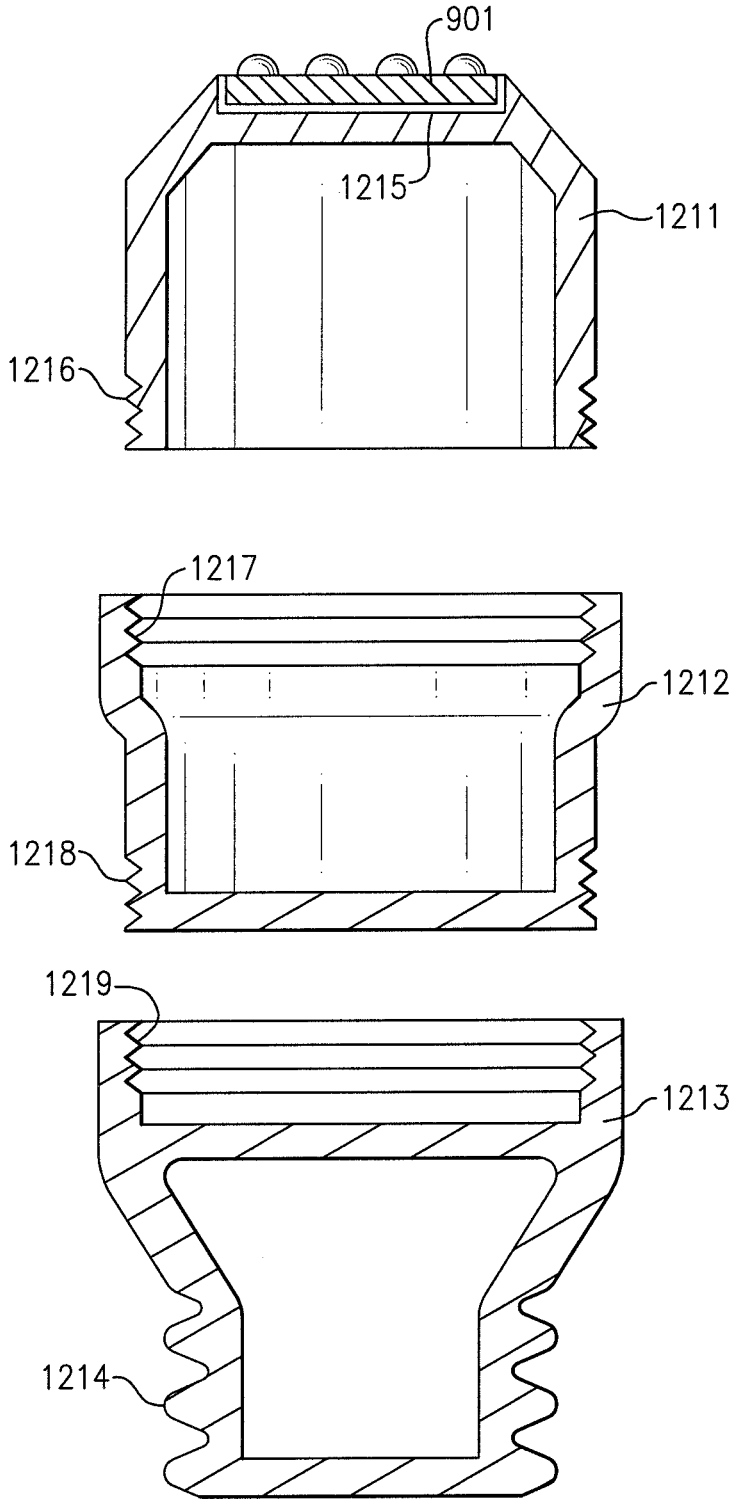

FIG. 121 is a sectional view of a lighting device comprising a light engine module 901, a light engine module housing member 1211 which is connected to the light engine module 901, an interface element 1212 which is connected to the light engine module housing member 1211, a housing member 1213 to which the interface element 1212 is connected, and an electrical connector 1214.

DETAILED DESCRIPTION OF THE INVENTIVE SUBJECT MATTER

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on" or extending "onto" another element, it can be directly on or extend directly onto the other element, or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some electromagnetic radiation (e.g., visible light). The expression "illuminated" encompasses situations where the solid state light emitter emits electromagnetic radiation continuously, or intermittently at a rate such that a human eye would perceive it as emitting electromagnetic radiation continuously or intermittently, or where a plurality of solid state light emitters of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "adjacent", as used herein to refer to a spatial relationship between a first structure and a second structure, means that the first and second structures are next to each other. That is, where the structures that are described as being "adjacent" to one another are similar, no other similar structure is positioned between the first structure and the second structure (for example, where two dissipation elements are adjacent to each other, no other dissipation element is positioned between them). Where the structures that are described as being "adjacent" to one another are not similar, no other structure is positioned between them. The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The word "surface", as used herein (e.g., in the expression "one or more solid state light emitters can be mounted on a first surface of a solid state light emitter support member"), encompasses regions that are flat or substantially flat, as well as regions that are not substantially flat, but for which at least 70% of the surface area of the region fits between first and second planes that are parallel to each other and are spaced from each other by a distance that is not more than 50% of a largest dimension of the region, and for which there are not two or more sub-regions within the region that (1) each comprise at least 5% of the surface area of the region, (2) at least 85% of the surface area of a first sub-region fits between third and fourth planes that are parallel to each other and are spaced from each other by a distance that is not more than 25% of a largest dimension of the first sub-region, and (3) at least 85% of the surface area of a second sub-region fits between fifth and sixth planes that (i) are parallel to each other, (ii) are spaced from each other by a distance that is not more than 25% of a largest dimension of the second sub-region, and (iii) define and angle of at least 30 degrees relative to the third and fourth planes.

The expression "substantially flat" or "substantially planar" means that at least 90% of the points in the surface which is characterized as being substantially flat are located on one of or between a pair of planes which are parallel and which are spaced from each other by a distance of not more than 5% of the largest dimension of the surface.

The expression "major surface" as used herein, means a surface which has a surface area which comprises at least 25% of the surface area of the entire structure, and in some cases at least 40% of the surface area of the entire structure (e.g., each of the top and bottom surfaces of a substantially flat thin element having substantially parallel top and bottom surfaces).

The expression "axis of the lighting device", as used herein, can refer to a straight line about which the lighting device is substantially symmetrical. In instances where a lighting device is not substantially symmetrical about any line, the expression "axis of the lighting device" can refer to (1) a line relative to which two or more like structures (or structures that provide like functions) on the lighting device are equidistant, (2) a line that passes through a center of gravity of the lighting device, and/or (3) a line about which rotation of the lighting device would be substantially balanced.

The expression "substantially balanced", as used herein, when referring to a structure, means that the structure is balanced or could be balanced by adding to a specific location or locations mass that in total comprises not more than about 10 percent of the mass of the structure.

The expression "surface that has a curved cross-section" means a surface through which a cross-section can be taken where at least 50% of the points in a portion of the section are spaced from a curve by a distance of not more than 10% of a maximum dimension of the surface, the curve corresponding to a circle, an ellipse, a parabola or a shape that has a single substantially constant radius of curvature or that has plural radii of curvature that all differ by not more than 50% of a curvature value, each radii of curvature being based on a sequence of points that extends at least 10% of a maximum dimension of the surface.

The expression "substantially the same space" in the expression "fit within substantially the same space that is provided for comparable conventional lighting devices" means that a first device and a second device are shaped such that the first device can be positioned such that it occupies a first device location and the second device can (at a different time) be positioned such that it occupies a second device location, wherein the first device in the first device location occupies at least 80 percent (and in some cases at least 90 percent, at least 95 percent or at least 98 or 99 percent) of the volume of the second device location, and the second device in the second device location occupies at least 80 percent (and in some cases at least 90 percent, at least 95 percent or at least 98 or 99 percent) of the volume of the first device location.

The expression "emission plane of a solid state light emitter," (e.g., "an emission plane of the first solid state light emitter"), as used herein, means (1) a plane that is perpendicular to an axis of the light emission from the solid state light emitter (e.g., in a case where light emission is hemispherical, the plane would be along the flat part of the hemisphere; in a case where light emission is conical, the plane would be perpendicular to the axis of the cone), (2) a plane that is perpendicular to a direction of maximum intensity of light emission from the solid state light emitter (e.g., in a case where the maximum light emission is vertical, the plane would be horizontal), (3) a plane that is perpendicular to a mean direction of light emission (in other words, if the maximum intensity is in a first direction, but an intensity in a second direction ten degrees to one side of the first direction is larger than an intensity in a third direction ten degrees to an opposite side of the first direction, the mean intensity would be moved somewhat toward the second direction as a result of the intensities in the second direction and the third direction).

The expression "substantially all" in the expression "substantially all of the light emitted by the plurality of solid state light emitters is emitted into the second side of the emission plane of the first solid state light emitter" means at least 98 percent of the light.

The expression "substantially perpendicular", as used herein, means that at least 90% of the points in the structure which is characterized as being substantially perpendicular to a reference plane or line are located on one of or between a pair of planes (1) which are perpendicular to the reference plane, (2) which are parallel to each other and (3) which are spaced from each other by a distance of not more than 5% of the largest dimension of the structure.

The terms "removable" and "removably", as used herein (e.g., in any of the expressions "removable light engine module", "removable support member", "removably supported", "removably attached", or "removably mounted"), means that the element (e.g., a light engine module, a support member or an interface element) that is characterized as being removable can be removed (e.g., from the lighting device, or from attachment to one or more other component) without structurally changing any other component (e.g., in the remainder of the lighting device), e.g., severing any material.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in some aspects, the present inventive subject matter is directed to a light engine module that comprises at least one solid state light emitter support member and one or more solid state light emitters. In other aspects, light engine modules can also comprise one or more compensation circuits and/or one or more electrical contact elements. In other aspects, the present inventive subject matter is directed to a lighting device that comprises at least one light engine module and one or more housing members.

Light engine modules according to the present inventive subject matter can be configured to emit (when supplied with electricity) light of any color or hue. For example, in some embodiments, light engine modules can emit white light (i.e., they can include solid state light emitters and/or luminescent material which emit light that, when blended, mix to produce light that is perceived as white light. Alternatively, in some embodiments, light engine modules can emit light that is blue, green, yellow, orange, red, or any other color or hue.

The following discussion of solid state light emitters applies to the solid state light emitters that can be included in any of the light engine modules or lighting devices according to the present inventive subject matter.

Persons of skill in the art are familiar with, and have ready access to, a wide variety of solid state light emitters, and any suitable solid state light emitter (or solid state light emitters) can be employed in the light engine modules or lighting devices according to the present inventive subject matter. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Solid state light emitters according to the present inventive subject matter can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation. Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 14/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley; the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

In general, light of any number of colors can be mixed by the lighting devices according to the present inventive subject matter. Representative examples of blending of light colors are described in:

U.S. patent application Ser. No. 11/613,714, filed Dec. 20, 2006 (now U.S. Patent Publication No. 2007/0139920), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/736,799, filed Apr. 18, 2007 (now U.S. Patent Publication No. 2007/0267983), the entirety of which is hereby incorporated by reference as if set forth in its entirety;

U.S. patent application Ser. No. 11/737,321, filed Apr. 19, 2007 (now U.S. Patent Publication No. 2007/0278503), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 12/117,122, filed May 8, 2008 (now U.S. Patent Publication No. 2008/0304260), the entirety of which is hereby incorporated by reference as if set forth in its entirety;

U.S. patent application Ser. No. 12/117,131, filed May 8, 2008 (now U.S. Patent Publication No. 2008/0278940), the entirety of which is hereby incorporated by reference as if set forth in its entirety;

U.S. patent application Ser. No. 12/117,136, filed May 8, 2008 (now U.S. Patent Publication No. 2008/0278928), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley; the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/951,626, filed Dec. 6, 2007 (now U.S. Patent Publication No. 2008/0136313), the entirety of which is hereby incorporated by reference as if set forth in its entirety;

U.S. patent application Ser. No. 12/035,604, filed on Feb. 22, 2008 (now U.S. Patent Publication No. 2008/0259589), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety;

U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley; the entirety of which is hereby incorporated by reference as if set forth in its entirety;

U.S. patent application Ser. No. 12/535,319, filed on Aug. 4, 2009 (now U.S. Patent Publication No. 2011/0031894), the entirety of which is hereby incorporated by reference as if set forth in its entirety; and U.S. patent application Ser. No. 14/541,215, filed on Aug. 14, 2009 (now U.S. Patent Publication No. 2011/0037409), the entirety of which is hereby incorporated by reference as if set forth in its entirety.

Some embodiments according to the present inventive subject matter provide a light engine module that comprises at least one solid state light emitter that, if energized, emits BSY light, and at least one solid state light emitter that, if energized, emits light that is not BSY light.

The expression "BSY light", as used herein, means light having x, y color coordinates which define a point which is within (1) an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53

The lighting devices according to the present inventive subject matter can comprise any desired number of solid state light emitters (and/or any amount of luminescent material or number of lumiphors). For example, a lighting device according to the present inventive subject matter can include 50 or more light emitting diodes, or can include 100 or more light emitting diodes, etc. Other embodiments may include fewer light emitting diodes, and such could be small chip light emitting diodes or high power light emitting diodes.

The one or more solid state light emitters (and optionally one or more luminescent materials) can be arranged in any suitable way.

Some embodiments according to the present inventive subject matter can include solid state light emitters that emit light of a first hue (e.g., light within the BSY range) and solid state light emitters that emit light of a second hue (e.g., that is not within the BSY range, such as red or reddish or reddish orange or orangish, or orange light), where each of the solid state light emitters that emit light that is not BSY light is surrounded by five or six solid state light emitters that emit BSY light.

Some embodiments according to the present inventive subject matter comprise a first group of one or more solid state light emitters that, if energized, emit BSY light, and a second group of one or more solid state light emitters that, if energized, emit light that is not BSY light, the first and second groups of light emitting diodes are mounted on a first solid state light emitter support member, and an average distance between a center of each solid state light emitter in the first group and a closest point on an edge region of the first solid state light emitter support member is smaller than an average distance between a center of each solid state light emitter in the second group and a closest point on an edge region of the first solid state light emitter support member.

In some embodiments, solid state light emitters (e.g., where a first group includes solid state light emitters that emit non-BSY light, e.g., red, reddish, reddish-orange, orangish or orange light, and a second group includes solid state light emitters that emit BSY light) may be arranged pursuant to a guideline described below in paragraphs (1)-(5), or any combination of two or more thereof, to promote mixing of light from solid state light emitters emitting different colors of light:

(1) an array that has groups of first and second solid state light emitters with the first group of solid state light emitters arranged so that no two of the first group solid state light emitters are directly next to one another in the array;

(2) an array that comprises a first group of solid state light emitters and one or more additional groups of solid state light emitters, the first group of solid state light emitters being arranged so that at least three solid state light emitters from the one or more additional groups is adjacent to each of the solid state light emitters in the first group;

(3) an array that comprises a first group of solid state light emitters and one or more additional groups of solid state light emitters, and the array is arranged so that less than fifty percent (50%), or as few as possible, of the solid state light emitters in the first group of solid state light emitters are on the perimeter of the array;

(4) an array that comprises a first group of solid state light emitters and one or more additional groups of solid state light emitters, and the first group of solid state light emitters is arranged so that no two solid state light emitters from the first group are directly next to one another in the array, and so that at least three solid state light emitters from the one or more additional groups is adjacent to each of the solid state light emitters in the first group; and/or (5) an array that is arranged so that no two solid state light emitters from the first group are directly next to one another in the array, fewer than fifty percent (50%) of the solid state light emitters in the first group of solid state light emitters are on the perimeter of the array, and at least three solid state light emitters from the one or more additional groups are adjacent to each of the solid state light emitters in the first group.

Figure 18:
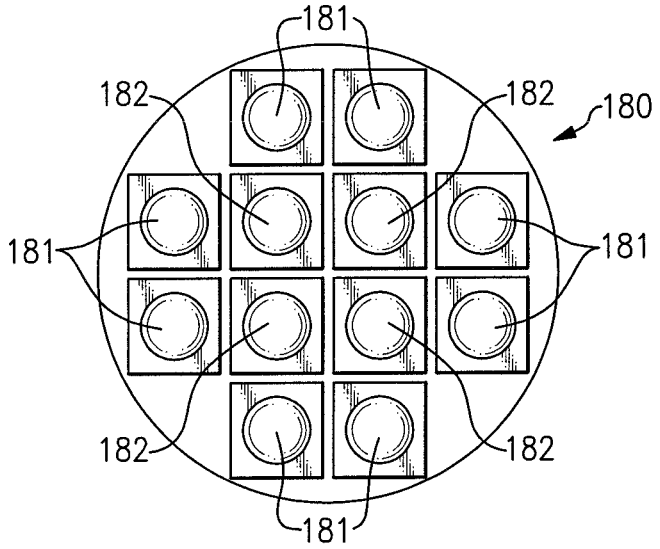
FIG. 18 is a schematic representation of an example of an arrangement of solid state light emitters on a solid state light emitter support member.

FIG. 18 depicts a representative example of an arrangement of solid state light emitters on a solid state light emitter support member. Referring to FIG. 18, there is shown a light engine module 180 that comprises twelve solid state light emitters 181 and 182. The respective solid state light emitters 181 and 182 can be selected so as to emit light of any desired wavelength range (or color). In some embodiments, for example, the eight solid state light emitters 181 can be phosphor light emitting diodes (i.e., light emitting elements that comprise at least one light emitting diode and a luminescent material, e.g., a phosphor) and the four solid state light emitters 182 can be light emitting diodes. In some embodiments according to the arrangement depicted in FIG. 18, the solid state light emitters 181 can be phosphor light emitting diodes that emit BSY light and/or the solid state light emitters 182 can be light emitting diodes that emit highly saturated light, e.g., red light. In some embodiments, the solid state light emitters 181 and 182 comprise light emitting diodes that emit red light, light emitting diodes that emit green light and light emitting diodes that emit blue light, i.e., the light engine module 180 is an RGB module (in some of such embodiments, the red, green and blue light emitters can be mixed so as to assist in mixing the light exiting from the light engine module 180). In some embodiments, the solid state light emitters 181 can be phosphor light emitting diodes that emit white light and the solid state light emitters 182 can be light emitting diodes that emit red light. In some embodiments, the solid state light emitters 181 can be phosphor light emitting diodes that emit warm white light and the solid state light emitters 182 can be light emitting diodes that emit cyan light.

Arrays according to the present inventive subject matter can also be arranged other ways, and can have additional features, that promote color mixing. In some embodiments, solid state light emitters can be arranged so that they are tightly packed, which can further promote natural color mixing. The lighting device can also comprise different diffusers and reflectors to promote color mixing in the near field and in the far field.

Solid state light emitters can be mounted on the one or more solid state light emitter support members in any suitable way, e.g., by using chip on heat sink mounting techniques, by soldering (e.g., if the solid state light emitter support member comprises a metal core printed circuit board (MCPCB), flex circuit or even a standard PCB, such as an FR4 board), for example, solid state light emitters can be mounted using substrate techniques such as from Thermastrate Ltd of Northumberland, UK. If desired, the surface of the solid state light emitter support member and/or the one or more solid state light emitters can be machined or otherwise formed to be of matching topography so as to provide high heat sink surface area. The following discussion of solid state light emitter support members applies to the solid state light emitter support members that can be included in any of the light engine modules or lighting devices according to the present inventive subject matter.

The solid state light emitter support member (or members) can be made of any suitable material (or combination of materials), and persons of skill in the art are familiar with a variety of suitable materials. In light engine modules or lighting devices that include two or more solid state light emitter support members, the respective solid state light emitter support members can be made of the same material or combination of materials, or any one or more of the respective solid state light emitter support members can be made of different materials (or combinations of materials).

The solid state light emitter support member (or members) can be of any suitable shape and/or size. In some embodiments, which can include or not include, as suitable, any of the other features described herein, a solid state light emitter support member can have first and second major surfaces, and one or more edge regions. In some embodiments, such first and second major surfaces can be substantially planar and substantially parallel to each other. In some embodiments, such first and second major surfaces can be substantially planar and substantially parallel to each other, and at least one edge region can extend from the first major surface to the second major surface substantially perpendicularly to each of the first and second major surfaces at least partway around a periphery of the solid state light emitter support member (or, a plurality of edge regions can extend from the first major surface to the second major surface substantially perpendicularly to each of the first and second major surfaces at least partway around a periphery of the solid state light emitter support member).

In some embodiments, which can include or not include, as suitable, any of the other features described herein, all of the solid state light emitters in the lighting device can be mounted on a single surface of the solid state light emitter support member.

In some embodiments, which can include or not include, as suitable, any of the other features described herein, at least one solid state light emitter can be mounted on one surface of the solid state light emitter support member, and at least one compensation circuit can be mounted on a second surface of the solid state light emitter support member. In some of such embodiments, the first and second surfaces of the solid state light emitter support member can be on opposite sides of the solid state light emitter support member, e.g., the first and second surfaces of the solid state light emitter support member can each be substantially planar and substantially parallel to each other.

In some embodiments, which can include or not include, as suitable, any of the other features described herein, one or more electrical contact elements can be mounted on the solid state light emitter support member (or at least one of plural solid state light emitter support members). In some of such embodiments, at least a portion of such an electrical contact element (or at least one of a plurality of electrical contact elements) can be exposed on at least one surface of a solid state light emitter support member (e.g., on an edge region, which can, for example, extend between first and second major substantially planar and substantially parallel surfaces of the solid state light emitter support member) and can come into contact with a corresponding conductive element (e.g., a contact, spring element, trace, wire bond, etc.) mounted on a lighting device element (e.g., a housing member), whereby electricity supplied to the conductive element can be supplied through such contact (or contacts) to circuitry which can ultimately supply electricity to one or more solid state light emitters (and in some cases such an electrical contact element can wrap around and be present on another surface of the solid state light emitter support member).

In some embodiments, which can include or not include, as suitable, any of the other features described herein, the solid state light emitter support member (or at least one of plural solid state light emitter support members) can comprise conductive regions that supply electricity to the one or more solid state light emitters, and optionally to other circuitry, as suitable. For instance, in some of such embodiments, the solid state light emitter support member can be a circuit board (or comprises a circuit board).

In some embodiments, which can include or not include, as suitable, any of the other features described herein, the solid state light emitter support member (or at least one of plural solid state light emitter support members) can comprise a circuit board (e.g., a metal core circuit board) (in some embodiments, the solid state light emitter support member can consist essentially of a circuit board) on which the solid state light emitter (or at least one of plural solid state light emitters) can be mounted, and optionally other circuitry (e.g., one or more compensation circuits) can be mounted (on the same surface and/or on different surface, e.g., on opposite sides).

In some embodiments, which can include or not include, as suitable, any of the other features described herein, the solid state light emitter support member can comprise at least two support elements, i.e., at least a first support element (e.g., a circuit board on which the one or more solid state light emitters are mounted) and at least a second support element to which the first support element is attached. For instance, some embodiments can include at least four support elements, namely: (1) a first circuit board (e.g., a metal core circuit board) on which a plurality of solid state light emitters are mounted (e.g., in an arrangement as depicted in FIG. 18), (2) a second circuit board (e.g., a metal core circuit board or an FR4 circuit board) on which at least a first compensation circuit is mounted, (3) a first support structure (e.g., of a material that has high heat conductivity, such as aluminum or copper) to which the first and second circuit boards are attached (permanently or removably) (e.g., on different surfaces of the first support structure, such as on opposite sides) and (4) a second support structure (e.g., of a material that has high heat conductivity, such as aluminum or copper) to which the first support structure is attached (permanently or removably) and which is attached (permanently or removably) to a lighting device element (e.g., a housing member).

In embodiments in which a solid state light emitter support member comprises two or more support elements (e.g., embodiments as described in the preceding paragraph), any support element can be attached (permanently or removably) to any other support element in any suitable way. For instance, in embodiments in which a solid state light emitter support member comprises a first circuit board (on which one or more solid state light emitters are mounted) and a first support structure (e.g., embodiments as described in the preceding paragraph), the first circuit board can be attached to the first support structure with screws (or bolts or rivets), with clips, by screw threading, with adhesive (e.g., thermal paste), by compression (e.g., by heating the first support structure and inserting the first circuit board into a recess (in which the first circuit board fits snugly) in the first support structure, so that when the first support structure cools down, the first circuit board will be compressed within the recess), by electrically conductive pins (that supply electricity to the first circuit board, e.g., from a power supply or to or from a second circuit board) that are bent around the first circuit board to hold the first circuit board in place, by press fitting the first circuit board in a recess in the first support structure, by a ridge and groove (e.g., a ridge on an edge of the first circuit board that fits into a groove or a recess in the first support structure, or a ridge on an edge of a recess in the first support structure that fits into a groove on the first circuit board), or by an arrangement in which a tab on one element fits into a slot on the other element and then the elements are moved relative to one another (e.g., one element is slid or rotated relative to the other). In any such embodiment, the first circuit board and the first support structure can be shaped, positioned relative to each other, and/or engaged with each other so as to provide good thermal coupling, e.g., so that heat generated by the one or more solid state light emitters can be transferred from the solid state light emitter(s) to the first circuit board and then on to the first support structure. In addition, in any such embodiment, the first circuit board and the first support structure can include respective structures that assist in properly aligning the first circuit board relative to the first support structure, e.g., the first circuit board can have one or more tabs that fit into one or more corresponding slots or grooves in the first support structure, and/or the first support structure can have one or more tabs that fit into one or more corresponding slots or grooves in the first circuit board.

Analogously, in embodiments in which a solid state light emitter support member comprises a second circuit board (on which at least one compensation circuit is mounted) and a first support structure, the second circuit board can be attached to the first support structure with screws (or bolts or rivets), with clips, by screw threading, with adhesive (e.g., thermal paste), by compression (e.g., by heating the first support structure and inserting the second circuit board into a recess (in which the second circuit board fits snugly) in the first support structure, so that when the first support structure cools down, the second circuit board will be compressed within the recess), by electrically conductive pins (that supply electricity to the second circuit board, e.g., from a power supply or to or from a first circuit board) that are bent around the second circuit board to hold the second circuit board in place, by press fitting the second circuit board in a recess in the first support structure, by a ridge and groove (e.g., a ridge on an edge of the second circuit board that fits into a groove or a recess in the first support structure, or a ridge on an edge of a recess in the first support structure that fits into a groove on the second circuit board), or by an arrangement in which a tab on one element fits into a slot on the other element and then the elements are moved relative to one another (e.g., one element is slid or rotated relative to the other). In any such embodiment, the second circuit board and the first support structure can be shaped, positioned relative to each other, and/or engaged with each other so as to provide good thermal coupling, e.g., so that heat generated by one or more components on the second circuit board can be transferred to the second circuit board and then on to the first support structure. In addition, in any such embodiment, the second circuit board and the first support structure can include respective structures that assist in properly aligning the second circuit board relative to the first support structure, e.g., the second circuit board can have one or more tabs that fit into one or more corresponding slots or grooves in the first support structure, and/or the first support structure can have one or more tabs that fit into one or more corresponding slots or grooves in the second circuit board.

As indicated above, in some embodiments, which can include or not include, as suitable, any of the other features described herein, the solid state light emitter support member can comprise a first circuit board (on which the one or more solid state light emitters are mounted), a second circuit board (on which at least a first compensation circuit is mounted), and at least a first support structure to which the first and second circuit boards are attached (permanently or removably). In some of such embodiments, the first and second circuit boards can be attached to different surfaces of the first support structure, such as on opposite sides, or the second circuit board can be positioned such that its major surfaces are substantially perpendicular to those of the first circuit board. In some of such embodiments, one or more electrical connections can be provided between contacts (and/or between any other components) on the respective circuit boards in any suitable way. Representative structures (or ways) for providing electrical connection (i.e., electrical connection structures) between components on respective circuit boards include pins (i.e., substantially rigid conductors that can be of any desired shape), insulated wires, ribbon cables (e.g., flat flexible cables (FFC's) or flexible printed circuits (FPC's), interconnects (e.g., made by forming a hole, coating the walls of the hole with insulating material and plating or depositing metal in the hole), solder, conductive clips, wire bonds, spring contacts, or any combination of any of the above. Any of such structures for providing electrical connection between components on respective circuit boards can include suitable electrical insulation, e.g., where one or both of the circuit boards is/are a metal core circuit board.

By providing two or more circuit boards (as is the case in some embodiments, as described above), it is possible to reduce (or even minimize) the surface area of a region from which light is emitted, by positioning some or all of the electrical components that do not emit light on one or more circuit boards that is/are not located on the region from which light is emitted. Such an arrangement (i.e., reducing or minimizing the surface area of a region from which light is emitted) can make it easier to provide for some light to be directed beneath the plane of emission for some or all of the solid state light emitters (e.g., to increase the range of directions in which light is emitted from the lighting device), and also can allow for a more narrow profile for the light engine module, such that the light engine module can fit into lighting device elements for smaller form factor lighting devices and/or so that more space is available for other components, e.g., one or more heat dissipation structures.

In some embodiments, which can include or not include, as suitable, any of the other features described herein, any structure (e.g., circuitry and/or support structure and/or one or more circuit boards) that is located where some light emitted by the one or more solid state light emitters is directed (continuously or intermittently or occasionally), can be made more reflective, e.g., by painting it white.

Figure 4:
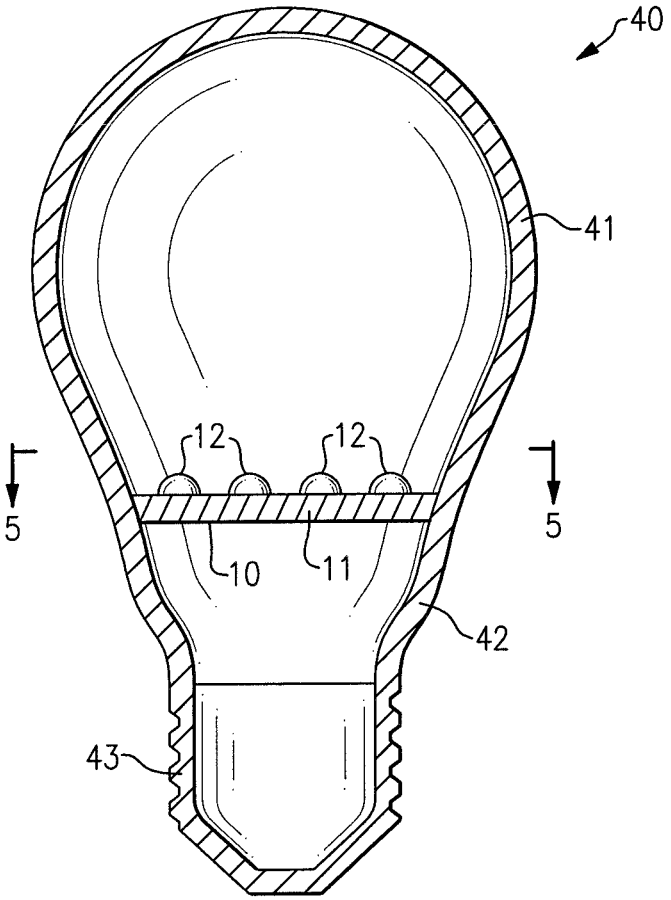
FIG. 4 is a sectional view of a lighting device 40.

In some embodiments, which can include or not include, as suitable, any of the other features described herein, any structure (e.g., support structure and/or one or more circuit boards) that is located where some light emitted by the one or more solid state light emitters is directed (continuously or intermittently or occasionally), can be transparent, substantially transparent or partially transparent (e.g., whereby the range of directions that light proceeds from the lighting device can be increased, for example so that more light can travel below the emission plane of the solid state light emitters 12 shown in FIG. 4).

In embodiments in which pins are included to provide electrical connection between one or more components on the first circuit board and one or more components on the second circuit board, such pins can be of any desired shape. In some embodiments, one or more pins can be L-shaped. In embodiments in which one or more pins are L-shaped (e.g., having a first portion that is substantially perpendicular to the major surfaces of the circuit board and a second portion that is substantially parallel to the major surfaces of the circuit board), the pin(s) can be attached (e.g., by soldering) to a component mounted on a circuit board, the second portion of the pin can extend parallel to the surface of the circuit board far enough that the first portion of the pin does not come into contact with the edge of the circuit board (which can be useful if the circuit board is a metal core circuit board, i.e., a circuit board that comprises a conductive layer (e.g., of aluminum) (which comprises the majority of the thickness of the circuit board), thin layers of dielectric material positioned on the major surfaces of the conductive layer, and conductive tracks (e.g., of copper) formed on one or both exposed major surfaces of the layers of dielectric material), and if electrical contact between the pin and the conductive layer of the metal core circuit board is not desired. In embodiments, in which one or more pins are L-shaped, the pin(s) can also hold the circuit board in place (or assist in doing so).

In embodiments in which pins are included to provide electrical connection between one or more components on a first circuit board and one or more components on a second circuit board, the pin(s) may have ribs and/or indentations in order to hold the pin(s) in place relative to other structure (e.g., relative to a first support structure where the first and second circuit boards are positioned on different surfaces (e.g., opposite sides) of the first support structure). In some embodiments, the pins can exert spring force on the circuit board (or boards) to hold it (or them) in place (or to assist in doing so). In some embodiments in which one or more pins are included, one or more insulating elements can be provided to insulate at least a portion of the pin (or at least portions of plural pins). In some embodiments in which one or more pins are included, a pin (or one or more of plural pins) can be attached to a component on one circuit board (e.g., by soldering) and the pin (including the other end of it) remains substantially in place while one or more other assembly steps are carried out (e.g., attached to a component on the other circuit board).

In embodiments in which pins are included to provide electrical connection between one or more components on a first circuit board and one or more components on a second circuit board, the pin(s) may have any suitable cross-sectional profile, e.g., round, oval, square, hexagonal, rectangular, etc.

In embodiments in which insulated wires are included to provide electrical connection between one or more components on a first circuit board and one or more components on a second circuit board, a plurality of insulated wires can be provided in relatively close proximity to each other (since they are insulated).

In some embodiments in which electrical connection is provided between one or more components on a first circuit board and one or more components on a second circuit board, contact regions (e.g., solder pads) on respective circuit boards can be aligned with one another (for example, in embodiments in which a first circuit board (on which a plurality of solid state light emitters are mounted) and a second circuit board (on which at least one compensation circuit is mounted) are positioned on opposite sides of a first support structure, contact regions on the first and second circuit boards can be aligned such that one or more distance between contact regions on the respective circuit boards is approximately the same as the distance between the respective circuit boards (e.g., they can be positioned similarly relative to an axis extending perpendicularly through the respective circuit boards), and/or the corresponding contact regions are shaped similarly, and/or no components (other than, e.g., one or both circuit boards and/or one or more support structures) are positioned between corresponding contact regions.

In some embodiments in which electrical connection is provided between one or more components on a first circuit board and one or more components on a second circuit board, one or more slots can be provided in any structure that is located between the first and second circuit boards (e.g., a support structure), and/or in the first circuit board and/or the second circuit board, and one or more electrical conductor can extend through the slot (or slots). In such embodiments, fewer solid state light emitters can be included (e.g., in the arrangement depicted in FIG. 18, one of the solid state light emitters 181 or 182 can be removed) to provide space for such a slot (or slots).

As indicated above, in some embodiments, which can include or not include, as suitable, any of the other features described herein, the solid state light emitter support member can comprise a first circuit board (on which the one or more solid state light emitters are mounted), a first support structure to which the first circuit board (and optionally also a second circuit board, if included) is attached (permanently or removably), and a second support structure to which the first support structure is attached (permanently or removably) and which is attached (permanently or removably) to a lighting device element (e.g., a housing member). In such embodiments, the first support structure can be attached to the second support structure in any suitable way, e.g., with screws (or bolts or rivets), with clips, by screw threading, with adhesive (e.g., thermal paste), by compression (e.g., by heating the first support structure and inserting the second support structure into the first support structure (e.g., by inserting a portion of a cylindrical exterior surface of the second support structure into a hollow cylindrical portion of the first support structure, or by inserting a portion of a cylindrical exterior surface of the first support structure into a hollow cylindrical portion of the second support structure), so that when the first support structure cools down, the second support structure will be compressed within the first support structure, or vice-versa), by press fitting a portion of the first support structure into a portion of the second support structure (or vice-versa), by a ridge and groove (e.g., a ridge on the first support structure that fits into a groove in the second support structure, or a ridge on the second support structure that fits into a groove on the first support structure), or by an arrangement in which a tab on one element fits into a slot on the other element and then the elements are moved relative to one another (e.g., one element is slid or rotated relative to the other). In any such embodiment, the first support structure and the second support structure can be shaped, positioned relative to each other, and/or engaged with each other so as to provide good thermal coupling, e.g., so that heat generated by the one or more solid state light emitters that is transferred from the solid state light emitter(s) can be readily transferred to the second support structure. In addition, in any such embodiment, the first support structure and the second support structure can include respective structures that assist in properly aligning the first support structure relative to the second support structure, e.g., the first support structure can have one or more tabs that fit into one or more corresponding slots or grooves in the second support structure, and/or the second support structure can have one or more tabs that fit into one or more corresponding slots or grooves in the first support structure.

In embodiments that comprises one or more circuit boards, the circuit board(s) can be any suitable circuit board, a wide variety of which are well known to persons of skill in the art. In some embodiments, one or more circuit boards can be metal core circuit boards (e.g., at least one circuit board on which one or moresolid state light emitters are mounted and/or at least one circuit board on which at least one compensation circuit is mounted can comprise (or each can comprise) a metal core circuit board), one or more circuit boards can be FR4 circuit boards (e.g., at least one circuit board on which at least one compensation circuit is mounted can comprise (or each can comprise) an FR4 circuit board.

In embodiments that comprise one or more support structures, the support structure(s) can comprise any suitable material, and can be of any suitable shape. For example, in such embodiments, one or more support structure can be made of any suitable material that has relatively high heat conductivity, e.g., aluminum, copper, aluminum nitride (AlN), silicon carbide (SiC), diamond-like carbon (DLC), etc. In embodiments that include one or more support structures that is/are made of a metal, if two or more circuit boards (e.g., a first circuit board on which a plurality of solid state light emitters are mounted) and a second circuit board on which at least one compensation circuit is mounted) are mounted on a single support structure, at least one of the circuit boards may need to be insulated from the support structure (e.g., by including an insulating layer between the support structure and the circuit board). In some embodiments that include one or more support structures that is/are made of metal, the support structure(s) can be insulated from the circuit board (or from each of the circuit boards), so that a person touching the support structure (or support structures), e.g., while handling the lighting device, will not be shocked.

In embodiments that comprise one or more support structures, the support structure(s) can provide a space or cavity into which one or more other components of the lighting device can be positioned. For instance, in some embodiments in which a first circuit board (on which a plurality of solid state light emitters are mounted) and a second circuit board (on which at least one compensation circuit is mounted) are positioned on opposite sides of a first support structure (and optionally there can be provided a second support structure, to which the first support structure is attached and which is attached to a lighting device element), the second circuit board can be positioned in an interior space defined by the first support structure (or defined by the first and second support structures). Alternatively or additionally, in such embodiments, a power supply (or one or more components thereof), a source of power (e.g., a battery or a photovoltaic collector), etc. can be positioned within such a space.

The solid state light emitter support member (or members) can be held in place relative to a lighting device in any suitable way, a wide variety of which will be readily apparent to persons skilled in the art. In some embodiments, a solid state light emitter support member (or members) can be held in place relative to any suitable lighting device element (e.g., a housing member) included in a lighting device. For instance, a solid state light emitter support member can be held in place relative to a lighting device element (e.g., a housing member) (1) by providing threads on an edge surface of the solid state light emitter support member which can be threadedly engaged in corresponding threads provided in the interior of a housing member, (2) by providing a clip (or clips) on the solid state light emitter support member which engage the housing member, and/or by providing a clip (or clips) on the housing member which engage the solid state light emitter support member, (3) by providing a pin (or pins) on the solid state light emitter support member which fits into a recess (or recesses) provided on the housing member, and/or by providing a pin (or pins) on the housing member which fits into a recess (or recesses) provided on the solid state light emitter support member, (4) using screws, bolts, rivets, etc. that extend through at least a portion of the housing member and at least a portion of the solid state light emitter support member, (5) using adhesive, (6) through geometry (e.g., an external frustoconical surface on the solid state light emitter support member engages an internal frustoconical surface on the housing member, etc.

The following discussion of compensation circuits applies to the compensation circuits that can be included in any of the light engine modules or lighting devices according to the present inventive subject matter.

Compensation circuits are provided to help to ensure that the perceived color (including color temperature in the case of "white" light) of the light exiting a lighting device is accurate (e.g., within a specific tolerance). Such compensation circuits, if included, can (for example) adjust the current supplied to solid state light emitters that emit light of one color and/or separately adjust the current supplied to solid state light emitters that emit light of a different color, so as to adjust the color of mixed light emitted from lighting devices, and such adjustment(s) can be (1) based on temperature sensed by one or more temperature sensors (if included), and/or (2) based on light emission as sensed by one or more light sensors (if included) (e.g., based on one or more sensors that detect (i) the color of the light being emitted from the lighting device, and/or (ii) the intensity of the light being emitted from one or more of the solid state light emitters, and/or (iii) the intensity of light of one or more specific hues of color), and/or based on any other sensors (if included), factors, phenomena, etc.

A wide variety of compensation circuits are known, and any can be employed in the lighting devices according to the present inventive subject matter. For example, a compensation circuit may comprise a digital controller, an analog controller or a combination of digital and analog. For example, a compensation circuit may comprise an application specific integrated circuit (ASIC), a microprocessor, a microcontroller, a collection of discrete components or combinations thereof. In some embodiments, a compensation circuit may be programmed to control one or more solid state light emitters. In some embodiments, control of one or more solid state light emitters may be provided by the circuit design of the compensation circuit and is, therefore, fixed at the time of manufacture. In still further embodiments, aspects of the compensation circuit, such as reference voltages, resistance values or the like, may be set at the time of manufacture so as to allow adjustment of the control of the one or more solid state light emitters without the need for programming or control code.

Representative examples of suitable compensation circuits are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011/0068702); the entirety of which is hereby incorporated by reference as if set forth in its entirety; and U.S. patent application Ser. No. 12/704,730, filed on Feb. 12, 2010, entitled "Solid State Lighting Apparatus With Compensation Bypass Circuits And Methods Of Operation Thereof", now U.S. Patent Publication No. 2011/68701); the entirety of which is hereby incorporated by reference as if set forth in its entirety.

The following discussion of color sensors applies to color sensors that can be included in any of the light engine modules or lighting devices according to the present inventive subject matter.

Persons of skill in the art are familiar with a wide variety of color sensors, and any of such sensors can be employed in the lighting devices of the present inventive subject matter. Among these well known sensors are sensors that are sensitive to all visible light, as well as sensors that are sensitive to only a portion of visible light. For example, the sensor can be a unique and inexpensive sensor (GaP:N light emitting diode) that views the entire light flux but is only (optically) sensitive to one or more of a plurality of light emitting diodes. For instance, in one specific example, the sensor can be sensitive to only a particular range (or ranges) of wavelengths, and the sensor can provide feedback to one or more light sources (e.g., light emitting diodes that emit light of that color or that emit light of other colors) for color consistency as the light sources age (and light output decreases). By using a sensor that monitors output selectively (by color), the output of one color can be selectively controlled to maintain the proper ratios of outputs and thereby maintain the color output of the device. This type of sensor is excited by only light having wavelengths within a particular range, e.g., a range that excludes red light (see, e.g., U.S. patent application Ser. No. 12/117,280, filed May 8, 2008 (now U.S. Patent Publication No. 2008/0309255), the entirety of which is hereby incorporated by reference as if set forth in its entirety.

Other techniques for sensing changes in light output of light sources include providing separate or reference emitters and a sensor that measures the light output of these emitters. These reference emitters can be placed so as to be isolated from ambient light such that they typically do not contribute to the light output of the lighting device. Additional techniques for sensing the light output of a light source include measuring ambient light and light output of the lighting device separately and then compensating the measured light output of the light source based on the measured ambient light.

The following discussion of temperature sensors applies to temperature sensors that can be included in any of the light engine modules or lighting devices according to the present inventive subject matter.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to compensation circuitry, e.g., to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

In some embodiments, one or more temperature sensors (e.g., a single temperature sensor or a network of temperature sensors) can be provided which are in contact with one or more solid state light emitters (or on the surface of the solid state light emitter support member on which the one or more solid state light emitters are mounted), or are positioned close to one or more solid state light emitters (e.g., less than ¼ inch away), such that the temperature sensor(s) provide accurate readings of the temperature of the solid state light emitter(s).

In some embodiments, one or more temperature sensors (e.g., a single temperature sensor or a network of temperature sensors) can be provided which are not in contact with one or more solid state light emitters, and are not positioned close to one or more solid state light emitters, but are positioned such that it (or they) is spaced from the solid state light emitter (or solid state light emitters) by only structure (or structures) having low thermal resistance, such that the temperature sensor(s) provide accurate readings of the temperature of the solid state light emitter(s).

In some embodiments, one or more temperature sensors (e.g., a single temperature sensor or a network of temperature sensors) can be provided which are not in contact with one or more solid state light emitters, and are not positioned close to one or more solid state light emitters, but the arrangement is such that the temperature at the temperature sensor(s) is proportional to the temperature at the solid state light emitter(s), or the temperature at the temperature sensor(s) varies in proportion to the variance of temperature at the solid state light emitter(s), or the temperature at the temperature sensor(s) is correlatable to the temperature at the solid state light emitter(s).

The following discussion of electrical contact elements applies to electrical contact elements that can be included in any of the light engine modules or lighting devices according to the present inventive subject matter.

Persons of skill in the art are familiar with a wide variety of electrical contact elements, and any of such electrical contact elements can be employed in accordance with the present inventive subject matter. Electrical contact elements can be made of any suitable electrically conductive material (or combinations of materials), a wide variety of which are well known to persons skilled in the art. Electrical contact elements can be of any suitable size and shape, a variety of which are well known to those of skill in the art. For instance, a contact element can comprise a substantially flat or curved element, which can be generally circular, square, rectangular, etc. A contact element can be in the shape of a helical spring, a leaf spring, or any other suitable shape.

The following discussion of housing members applies to the housing members that can be included in any of the lighting devices according to the present inventive subject matter.

A housing member can be of any suitable shape and size, and can be made of any suitable material or materials. Persons of skill in the art are familiar with, and can envision, a wide variety of materials out of which a housing can be constructed (for example, a metal, a ceramic material, a plastic material with low thermal resistance, or combinations thereof), and a wide variety of shapes for such housings, and housings made of any of such materials and having any of such shapes can be employed in accordance with the present inventive subject matter.

In some embodiments, a housing member can comprise one or more heat dissipation regions, e.g., one or more heat dissipation fins, or any other structure that provides or enhances any suitable thermal management scheme.

In embodiments in which the solid state light emitter support comprises one or more support structures, the support structure (or at least one of the plural support structures) can function as a heat sink and/or as a heat dissipation structure.

In some embodiments, which can include or not include, as suitable, any of the other features described herein, any component (or components) of a lighting device can comprise one or more heat dissipation structures, e.g., fins or pins. For instance, in some embodiments, one or more heat dissipation structures can be provided on a first support structure (to which one or more circuit boards can be attached), a second support structure (to which a first support structure is attached and which is attached to a lighting device element), a first circuit board (on which a plurality of solid state light emitters are mounted), a second circuit board (on which at least one compensation circuit is mounted), and/or a housing member or any other part of a lighting device element. In some embodiments, at least some heat is extracted through a peripheral edge of a light engine module, e.g., through the vertical (in the orientation depicted) sides of the first support structure 824 in the light engine module shown in FIGS. 82-83 (and optionally through other structures).

Some embodiments of lighting devices according to the present inventive subject matter can have only passive cooling. On the other hand, some embodiments of lighting devices according to the present inventive subject matter can have active cooling (and can optionally also have any of the passive cooling features described herein). The expression "active cooling" is used herein in a manner that is consistent with its common usage to refer to cooling that is achieved through the use of some form of energy, as opposed to "passive cooling", which is achieved without the use of energy (i.e., while energy is supplied to the one or more solid state light emitters, passive cooling is the cooling that would be achieved without the use of any component(s) that would require additional energy in order to function to provide additional cooling). In some embodiments of the present inventive subject matter, therefore, cooling is achieved with only passive cooling, while in other embodiments of the present inventive subject matter, active cooling is provided (and any of the features described herein that provide or enhance passive cooling can optionally be included).

In some embodiments, a housing member and a mixing chamber element are integral.

In some embodiments, a housing member is shaped so that it can accommodate the one or more solid state light emitter support member, as well as any of a variety of light engine modules involved in receiving current supplied to a lighting device, modifying the current (e.g., converting it from AC to DC and/or from one voltage to another voltage), and/or driving one or more solid state light emitters (e.g., illuminating one or more solid state light emitter intermittently and/or adjusting the current supplied to one or more solid state light emitters in response to a detected operating temperature of one or more solid state light emitter, a detected change in intensity or color of light output, a detected change in an ambient characteristic such as temperature or background light, a user command, etc., and/or a signal contained in the input power, such as a dimming signal in AC power supplied to the lighting device).

In some embodiments, which can include or not include, as suitable, any of the other features described herein, lighting devices according to the present inventive subject matter can include any suitable thermal management solutions.

The lighting devices according to the present inventive subject matter can employ any suitable heat dissipation scheme, a wide variety of which (e.g., one or more heat dissipation structures) are well known to persons skilled in the art and/or which can readily be envisioned by persons skilled in the art. Representative examples of heat dissipation schemes which might be suitable are described in:

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 12/411,905, filed on Mar. 26, 2009 (now U.S. Patent Publication No. 2010/0246177), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/551,921, filed on Sep. 1, 2009 (now U.S. Patent Publication No. 2011/0050070), the entirety of which is hereby incorporated by reference as if set forth in its entirety;

U.S. Patent Application No. 61/245,683, filed on Sep. 25, 2009, the entirety of which is hereby incorporated by reference as if set forth in its entirety;

U.S. Patent Application No. 61/245,685, filed on Sep. 25, 2009, the entirety of which is hereby incorporated by reference as if set forth in its entirety;

U.S. patent application Ser. No. 12/566,850, filed on Sep. 25, 2009 (now U.S. Patent Publication No. 2011/0074265), the entirety of which is hereby incorporated by reference as if set forth in its entirety;

U.S. patent application Ser. No. 12/582,206, filed on Oct. 20, 2009 (now U.S. Patent Publication No. 2011/0090686), the entirety of which is hereby incorporated by reference as if set forth in its entirety;

U.S. patent application Ser. No. 12/607,355, filed on Oct. 28, 2009 (now U.S. Patent Publication No. 2011/0089838), the entirety of which is hereby incorporated by reference as if set forth in its entirety; and U.S. patent application Ser. No. 12/683,886, filed on Jan. 7, 2010 (now U.S. Patent Publication No. 2011/0089830), the entirety of which is hereby incorporated by reference as if set forth in its entirety.

In embodiments where active cooling is provided, any type of active cooling can be employed, e.g., blowing or pushing (or assisting in blowing) an ambient fluid (such as air) across or near one or more heat dissipation elements or heat sinks, thermoelectric cooling, phase change cooling (including supplying energy for pumping and/or compressing fluid), liquid cooling (including supplying energy for pumping, e.g., water, liquid nitrogen or liquid helium), magnetoresistance, etc.

In some embodiments, which can include or not include, as suitable, any of the other features described herein, one or more heat spreaders can be provided in order to move heat away from the one or more solid state light emitter support member to one or more heat sink regions and/or one or more heat dissipation regions, and/or the heat spreader can itself provide surface area from which heat can be dissipated. Persons of skill in the art are familiar with a variety of materials that would be suitable for use in making a heat spreader, and any of such materials (e.g., copper, aluminum, etc.) can be employed.

In some embodiments, which can include or not include, as suitable, any of the other features described herein, a heat spreader can be provided that is in contact with a first surface of a solid state light emitter support member, and one or more solid state light emitters can be mounted on a second surface of the solid state light emitter support member, the first surface and the second surface being on opposite sides of the solid state light emitter support member. In such embodiments, circuitry (e.g., a compensation circuit) can be provided and positioned in contact with such a heat spreader, e.g., a heat spreader can be located between a solid state light emitter support member and a compensation circuit, and/or a heat spreader can have a recess that opens to a surface of the heat spreader that is remote from a solid state light emitter support member, and a compensation circuit can be located within that recess. Such arrangements can be useful for fitting such components into a particular form factor (e.g., an A lamp) while avoiding any of the components blocking any light emitted by the solid state light emitter(s) (or reducing the extent to which any such light may be blocked). In some embodiments, which can include or not include, as suitable, any of the other features described herein, a sensor (e.g., a temperature sensor, such as a thermistor) can be positioned in any suitable location. In some embodiments, (1) a heat spreader can be provided that is in contact with a second surface of a solid state light emitter support member and one or more solid state light emitters can be mounted on a first surface of the solid state light emitter support member, with the first surface and the second surface being on opposite sides of the solid state light emitter support member, (2) circuitry (e.g., a compensation circuit) can be positioned in contact with such a heat spreader, e.g., a heat spreader can be located between a solid state light emitter support member and a compensation circuit, and/or a spreader can have a recess that opens to a surface of the heat spreader that is remote from a solid state light emitter support member and a compensation circuit can be located within that recess, and (3) a temperature sensor (e.g., a thermistor) can be positioned in contact with the heat spreader, e.g., between the heat spreader and the circuitry (e.g., compensation circuit).

In some embodiments, which can include or not include, as suitable, any of the other features described herein, one or more solid state light emitters can be mounted on a first surface of a solid state light emitter support member, the solid state light emitter support member can be positioned within a housing, and the first surface area does not fill the entire cross-section of the housing, so that the majority of the light emitted by the solid state light emitters travels into a first hemisphere defined by the first surface and in which the solid state light emitters are located, but some light emitted by the one or more solid state light emitters also travels into a second hemisphere which is complementary to the first hemisphere, i.e., if the first surface is horizontal and the solid state light emitters are mounted on top of the first surface, a majority of the light emitted by the solid state light emitters travels upward, but a portion of the light emitted by the solid state light emitters can travel downward, e.g., through spaces defined between a perimeter of the solid state light emitter support member and the inside wall of the housing (in which the solid state light emitter support member is mounted) in a plane defined by the first surface (or at least a portion of the first surface).

In some embodiments, which can include or not include, as suitable, any of the other features described herein, one or more solid state light emitters can be mounted on a first surface of a solid state light emitter support member, and at least 40% (and in some embodiments, at least 50%, at least 60%, at least 70%, at least 80%, at least 90% or at least 95%) of the surface area of the first surface of the solid state light emitter support member is covered by a solid state light emitter. Such embodiments can be helpful in providing devices in which solid state light emitters are relatively tightly packed on a surface of a solid state light emitter support member and the surface area of the solid state light emitter support member can as a result be smaller than a cross-sectional space defined by an inside wall of a housing, so that a majority of the light emitted by the solid state light emitters travels into a first hemisphere defined by the first surface and in which the solid state light emitters are located, but some light emitted by the one or more solid state light emitters also travels into a second hemisphere which is complementary to the first hemisphere, as described in the preceding paragraph. Such reduction in the surface area of a surface of a solid state light emitter support member on which solid state light emitters are mounted can be referred to as "reducing the light aperture" or "minimizing the light aperture". Optionally, in any of such embodiments described above in this paragraph, one or more electrical contact elements can be positioned on the surface of the solid state light emitter support member on which solid state light emitters are mounted.

In some embodiments, which can include or not include, as suitable, any of the other features described herein, one or more solid state light emitters can be mounted on a first surface of a solid state light emitter support member, and at least some circuitry can be mounted on the first surface.

As noted above, an aspect of the present inventive subject matter relates to a light engine element that comprises a light engine module and at least one interface element connected to the light engine module. An interface element can be provided in any light engine element described herein, which can include or not include, as suitable, any of the other features described herein.

An interface element (if provided) can be connected to a light engine module in any suitable way, a wide variety of which will be readily apparent to persons skilled in the art. For instance, an interface element can be connected (e.g., permanently attached or removably attached) to a light engine module (1) by providing threads on a surface of the interface element which can be threadedly engaged in corresponding threads provided on the light engine module, (2) by providing a clip (or clips) on the interface element which engages the light engine module, and/or by providing a clip (or clips) on the light engine module which engages the interface element, (3) by providing a pin (or pins) on the interface element which fits into a recess (or recesses) provided on the light engine module, and/or by providing a pin (or pins) on the light engine module which fits into a recess (or recesses) provided on the interface element, (4) using screws, bolts, rivets, etc. that extend through at least a portion of the interface element and at least a portion of the light engine module, (5) using adhesive, (6) through geometry (e.g., an external frustoconical surface on the light engine module engages an internal frustoconical surface on the interface element, etc.). For example, engagement can be provided with a variety of interlocking, screw-in, twist-on (including very coarse pitch threads), mating an/or other connection features (including the inclusion of multiple modules where a light engine and/or a driver is/are screwed into a module housing which screws into or interfaces with a lighting device element or an interface element).

As noted above, an aspect of the present inventive subject matter relates to a lighting device that comprises a light engine module, at least one interface element, and at least one lighting device element, in which the interface element is connected to the light engine module and to the at least one lighting device element. An interface element can be provided in any lighting device described herein, which can include or not include, as suitable, any of the other features described herein. In this aspect of the present inventive subject matter, the interface element can be connected (e.g., permanently attached or removably attached) to the light engine module in any suitable way, e.g., as described above. In addition, in this aspect of the present inventive subject matter, the interface element can be connected (e.g., permanently attached or removably attached) to the lighting device element in any suitable way. For instance, an interface element can be connected to a lighting device element (1) by providing threads on a surface of the interface element which can be threadedly engaged in corresponding threads provided on the lighting device element, (2) by providing a clip (or clips) on the interface element which engages the lighting device element, and/or by providing a clip (or clips) on the lighting device element which engages the interface element, (3) by providing a pin (or pins) on the interface element which fits into a recess (or recesses) provided on the lighting device element, and/or by providing a pin (or pins) on the lighting device element which fits into a recess (or recesses) provided on the interface element, (4) using screws, bolts, rivets, etc. that extend through at least a portion of the interface element and at least a portion of the lighting device element, (5) using adhesive, (6) through geometry (e.g., an external frustoconical surface on the interface element engages an internal frustoconical surface on the lighting device element, etc.). For example (as with the connection between the interface element and the light engine module), engagement can be provided with a variety of interlocking, screw-in, twist-on (including very coarse pitch threads), mating an/or other connection features (including the inclusion of multiple modules where a light engine and/or a driver is/are screwed into a module housing which screws into or interfaces with a lighting device element or an interface element).

The following discussion of interface elements applies to interface elements that can be included, if desired, in any of the light engine elements or lighting devices according to the present inventive subject matter. An interface element, if included, can comprise one or more metal materials (e.g., copper, aluminum, bronze or other alloys), ceramic materials (e.g., aluminum oxide, aluminum nitride, silicon carbide, magnesium oxide), semiconductor materials (e.g., silicon, carbon, etc.), plastic materials or organic materials filled with one or more thermally conductive materials such as silicon carbide, beryllium oxide, aluminum nitride, carbon materials (e.g., graphite, diamond, DLC, etc.), and may, if desired, include portions of electrically insulating and/or electrically conductive and/or electrically semiconducting material (or materials).

An interface element (if included), or one or more interface elements, can provide or assist in providing heat dissipation, heat transfer, one or more electrical connections, and/or one or more optical interfaces. For example, an interface element can include heat dissipating fins and/or heat dissipating pins; an interface element can include one or more regions of high heat conductivity (or an entire interface element can have high heat conductivity) to move heat from a region where heat is generated (or from a region to which generated heat is readily transferred) to a heat dissipation region (or to a region from which heat can readily be transferred to a heat dissipation region); an interface element can include one or more electrical conductors to conduct electricity from a first region (against which a surface region of the interface element abuts) to a second region (against which a second surface region of the interface element abuts) or plural regions; and/or an interface element can include one or more regions that are transparent, translucent or optically transmissive to one or more other regions, whereby at least a portion of light that is incident on one surface region of the interface element can exit from one or more other surface regions of the interface element.

An interface element (if included) and/or a light engine module and/or a lighting device element can comprise one or more structures that assist in properly aligning the interface element relative to a light engine module and/or relative to a lighting device element. For instance, any of these structures can comprise one or more ribs, ridges, pins or tabs, etc. that fit into one or more corresponding slots, notches or grooves, etc. in any of the other structures.

An interface element (if included) can be of any desired shape and size. In some aspects of the present inventive subject matter, an interface element can be of such shape and size that (1) it can readily be connected to a light engine module of a particular shape and size (or to particular light engine modules of particular shapes and sizes) and (2) it can readily be connected to a lighting device element of a particular shape and size (or to lighting device elements of particular shapes and sizes). By providing interface elements of a variety of shapes and sizes, a particular light engine module can be positioned within any of a variety of lighting device elements (and specific desired properties, e.g., heat dissipation, heat transfer, electrical conductivity, optical transmission) can be provided by the interface element (or elements). In such a way, a light engine module of a particular design can be advantageously used in any of a variety of lighting device elements.

In some embodiments, which can include or not include, as suitable, any of the other features described herein, one or more solid state light emitters can be mounted on a first surface of a solid state light emitter support member, and at least some circuitry can be mounted on the one or more other surface of the solid state light emitter support member (in such embodiments, some circuitry can also be mounted on the first surface of the solid state light emitter support member, or no circuitry can be mounted on the first surface of the solid state light emitter support member). In making such devices, circuitry can be mounted on portions of the first surface of the solid state light emitter support member which are later bent so as to become different surfaces (i.e., so as to no longer be part of the first surface of the solid state light emitter support member), e.g., circuit components can be mounted on narrower portions of the first surface of the solid state light emitter support member that protrude from a wider portion of the first surface of the solid state light emitter support member, and the narrower portions are later bent, e.g., to form an angle (e.g., of 90 degrees) relative to the wider portion of the solid state light emitter support member (alternatively, one or more narrower portions can be bent before some or all of the circuitry components eventually mounted thereon are mounted thereon).

Lighting devices according to the present inventive subject matter can comprise one or more electrical connectors.

Various types of electrical connectors are well known to those skilled in the art, and any of such electrical connectors can be attached within (or attached to) the lighting devices according to the present inventive subject matter. Representative examples of suitable types of electrical connectors include wires (for splicing to a branch circuit), Edison plugs (i.e., Edison screw threads, which are receivable in Edison sockets) and GU24 pins (which are receivable in GU24 sockets). Other well known types of electrical connectors include 2-pin (round) GX5.3, can DC bay, 2-pin GY6.35, recessed single contact R7s, screw terminals, 4 inch leads, 1 inch ribbon leads, 6 inch flex leads, 2-pin GU4, 2-pin GU5.3, 2-pin G4, turn & lock GU7, GU10, G8, G9, 2-pin Pf, min screw E10, DC bay BA15d, min cand E11, med screw E26, mog screw E39, mogul bipost G38, ext. mog end pr GX16d, mod end pr GX16d and med skirted E26/50x39 (see https://www.gecatalogs.com/lighting/software/GELighting-CatalogSetup.exe).

In some embodiments, an electrical connector is attached to at least one housing member. In some embodiments of lighting devices in accordance with the present inventive subject matter, the lighting device comprises a lens element, a housing, an electrical connector and a light engine module, with the light engine module positioned within the housing, and with the lens element and the electrical connector attached to opposite ends of the housing, whereby the form factor of the lighting device is similar to a conventional lighting device, e.g., an A lamp (whereby the lighting device according to the present inventive subject matter can be screwed into a socket designed to accommodate an A lamp or from which an A lamp has been removed). In some embodiments that comprise one or more support structures, the support structure (or one or more of the plural support structures) can comprise one or more electrical connectors, or can be attached to one or more electrical connectors.

An electrical connector, if included, can be electrically connected to one or more circuitry component (e.g., a power supply, a first circuit board (on which a plurality of solid state light emitters are mounted), and/or a second circuit board (on which at least one compensation circuit is mounted) included in the lighting device in any suitable way. Representative examples of ways to electrically connect a circuitry component to an electrical connector include connecting a first portion of a flexible wire to the electrical connector and to connect a second portion of the flexible wire to a circuit board (e.g., a metal core circuit board) on which the circuitry component is mounted, providing one or more pins, insulated wires, ribbon cables, solder, conductive clips, wire bonds, spring contacts, or any combination of any of the above.

An electrical connector, if included, can be attached to one or more other components of the lighting device in any suitable way, e.g., by screw-threading into another component (e.g., a housing member, if included, or a lens, if included), with screws (or bolts or rivets), with clips, with adhesive (e.g., thermal paste), by compression, by press fitting, by a ridge and groove, or by an arrangement in which a tab on one element fits into a slot on the other element and then the elements are moved relative to one another (e.g., one element is slid or rotated relative to the other).

It would be especially desirable to provide a lighting device that comprises one or more solid state light emitters (and in which some or all of the light produced by the lighting device is generated by solid state light emitters), where the lighting device can be easily substituted (i.e., retrofitted or used in place of initially) for a conventional lighting device (e.g., an incandescent lighting device, a fluorescent lighting device or other conventional types of lighting devices), for example, a lighting device (that comprises one or more solid state light emitters) that can be engaged with the same socket that the conventional lighting device is engaged (a representative example being simply unscrewing an incandescent lighting device from an Edison socket and threading in the Edison socket, in place of the incandescent lighting device, a lighting device that comprises one or more solid state light emitters). In some aspects of the present inventive subject matter, such lighting devices are provided.

Some embodiments in accordance with the present inventive subject matter (which can include or not include any of the features described elsewhere herein) include one or more lenses, diffusers or light control elements. Persons of skill in the art are familiar with a wide variety of lenses, diffusers and light control elements, can readily envision a variety of materials out of which a lens, a diffuser, or a light control element can be made (e.g., polycarbonate materials, acrylic materials, fused silica, polystyrene, etc.), and are familiar with and/or can envision a wide variety of shapes that lenses, diffusers and light control elements can be. Any of such materials and/or shapes can be employed in a lens and/or a diffuser and/or a light control element in an embodiment that includes a lens and/or a diffuser and/or a light control element. As will be understood by persons skilled in the art, a lens or a diffuser or a light control element in a lighting device according to the present inventive subject matter can be selected to have any desired effect on incident light (or no effect), such as focusing, diffusing, altering the direction of emission from the lighting device (e.g., increasing the range of directions that light proceeds from the lighting device, such as bending light to travel below the emission plane of the solid state light emitters 96 shown in FIG. 9), etc.

In embodiments in accordance with the present inventive subject matter that include a lens (or plural lenses), the lens (or lenses) can be positioned in any suitable location and orientation. Any such lens and/or diffuser and/or light control element can comprise one or more luminescent materials, e.g., one or more phosphor.

In some embodiments, a lens (or two or more lenses) can be provided which, together with a housing member (and/or an electrical connector), defines a space in which one or more light engine module (which can comprise one or more solid state light emitter support members and one or more solid state light emitters), whereby at least some of the light that is emitted by the one or more solid state light emitters passes through the lens (or lenses). In such embodiments, the lens (or lenses) can be of any suitable shape, e.g., any shape that corresponds to a portion of a conventional lighting device (e.g., a shape that corresponds to a transparent portion of a conventional lighting device, a shape that includes a region that corresponds to a transparent portion of a conventional lighting device, or a shape that corresponds to a portion of a transparent portion of a conventional lighting device).

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of the lighting device. A diffuser can be included in the form of a diffuser film/layer that is arranged to mix light emission from solid state light emitters in the near field. That is, a diffuser can mix the emission of solid state light emitters, such that when the lighting device is viewed directly, the light from the discrete solid state light emitters is not separately identifiable.

A diffuser film (if employed) can comprise any of many different structures and materials arranged in different ways, e.g., it can comprise a conformally arranged coating over a lens. In some embodiments, commercially available diffuser films can be used such as those provided by Bright View Technologies, Inc. of Morrisville, N.C., Fusion Optix, Inc. of Cambridge, Mass., or Luminit, Inc. of Torrance, Calif. Some of these films can comprise diffusing microstructures that can comprise random or ordered micro lenses or geometric features and can have various shapes and sizes. A diffuser film can be sized to fit over all or less than all of a lens, and can be bonded in place over a lens using known bonding materials and methods. For example, a film can be mounted to a lens with an adhesive, or could be film insert molded with a lens. In other embodiments, a diffuser film can comprise scattering particles, or can comprise index photonic features, alone or in combination with microstructures. A diffuser film can have any of a wide range of suitable thicknesses (some diffuser films are commercially available in a thickness in the range of from 0.005 inches to 0.125 inches, although films with other thicknesses can also be used).

In other embodiments, a diffuser and/or scattering pattern can be directly patterned onto a component, e.g., a lens. Such a pattern may, for example, be random or a pseudo pattern of surface elements that scatter or disperse light passing through them. The diffuser can also comprise microstructures within the component (e.g., lens), or a diffuser film can be included within the component (e.g., lens).

Diffusion and/or light scattering can also be provided or enhanced through the use of additives, a wide variety of which are well known to persons of skill in the art. Any of such additives can be contained in a lumiphor, in an encapsulant, and/or in any other suitable element or component of the lighting device.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed. For example, representative light control elements are described in U.S. Patent Application No. 61/245,688, filed on Sep. 25, 2009, the entirety of which is hereby incorporated by reference as if set forth in its entirety. A light control element (or elements) can be any structure or feature that alters the overall nature of a pattern formed by light emitted by a light source. As such, the expression "light control element", as used herein, encompasses, e.g., films and lenses that comprise one or more volumetric light control structures and/or one or more surface light control features.

In some embodiments, there can be provided one or more light engine module that extends from one side of an interface between a housing member and a lens to the other side of such interface. For example, there can be provided a lighting device which (1) if oriented such that such interface is horizontal (or substantially horizontal), the lens is above the interface and the housing member is below the interface, and which (2) comprises a light engine module (or modules) that extends from below the interface to above the interface. Such a lighting device can comprise one or more solid state light emitters mounted on a portion (or portions) of one or more solid state light emitter support members that are on the side of the interface on which the lens is located, as well as one or more solid state light emitters that are on the side of the interface on which the housing member is located (e.g., one or more solid state light emitters can be positioned on a first surface of the solid state light emitter support member that is an extremity of the solid state light emitter support member and that is substantially parallel to the interface, and one or more solid state light emitters can be positioned on surfaces of the solid state light emitter support member that extend from the first surface toward the interface). In such lighting devices, one or more light engine modules can be shaped and oriented as a pedestal, with solid state light emitters positioned on the top and the sides of the pedestal. Such embodiments (i.e., embodiments as described in this paragraph) can be helpful in providing devices in which solid state light emitters are relatively tightly packed on a surface of a solid state light emitter support member and the surface area of the solid state light emitter support member can as a result be smaller than a space defined by an inside wall of a housing, so that a majority of the light emitted by the solid state light emitters travels into a first hemisphere defined by the first surface and in which the solid state light emitters are located, but some light emitted by the one or more solid state light emitters also travels into a second hemisphere which is complementary to the first hemisphere, i.e., such embodiments can achieve (or help to achieve) reducing the light aperture or minimizing the light aperture.

In addition, one or more scattering elements (e.g., layers) can optionally be included in the lighting devices according to the present inventive subject matter. For example, a scattering element can be included in a lumiphor, and/or a separate scattering element can be provided. A wide variety of separate scattering elements are well known to those of skill in the art, and any such elements can be employed in the lighting devices of the present inventive subject matter. Particles made from different materials can be used, such as titanium dioxide, alumina, silicon carbide, gallium nitride, or glass micro spheres, e.g., with the particles dispersed within a lens.

Figure 9:
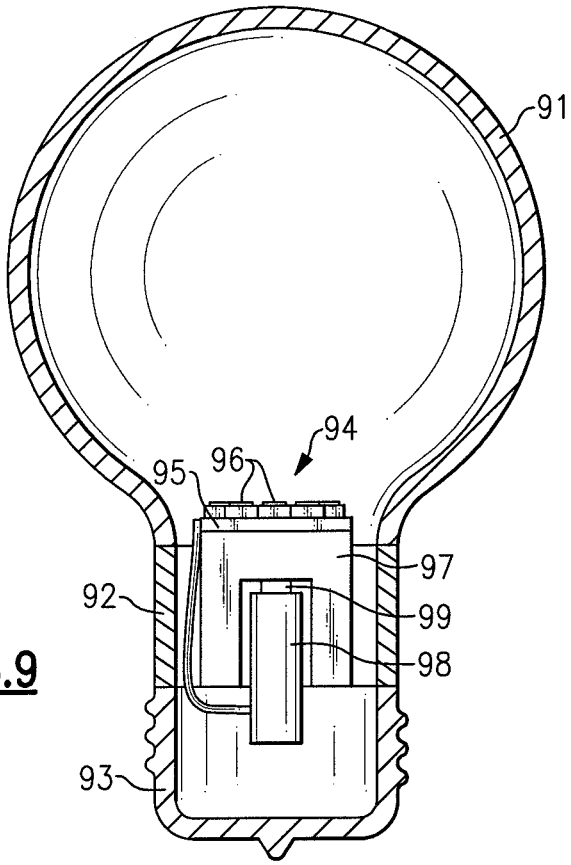
FIG. 9 is a cross-sectional view of a lighting device 90.

Lighting devices according to the present inventive subject matter can be of any desired overall shape and size. In some embodiments, the lighting devices according to the present inventive subject matter are of size and shape (i.e., form factor) that correspond to any of the wide variety of light sources in existence, e.g., A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. Within each of the lamp types identified in the previous sentence, numerous different varieties (or an infinite number of varieties) exist. For example, a number of different varieties of conventional A lamps exist and include those identified as A 15 lamps, A 17 lamps, A 19 lamps, A 21 lamps and A 23 lamps. The expression "A lamp" as used herein includes any lamp that satisfies the dimensional characteristics for A lamps as defined in ANSI C78.20-2003, including the conventional A lamps identified in the preceding sentence. Some representative examples of form factors include mini multi-Mirror® projection lamps, multi-Mirror® projection lamps, reflector projection lamps, 2-pin-vented base reflector projection lamps, 4-pin base CBA projection lamps, 4-pin base BCK projection lamps, DAT/DAK DAY/DAK incandescent projection lamps, DEK/DFW/DHN incandescent projection lamps, CAR incandescent projection lamps CAZ/CZB incandescent projection lamps, CZX/DAB incandescent projection lamps, DDB incandescent projection lamps, DRB DRC incandescent projection lamps, DRS incandescent projection lamps, BLX BLC BNF incandescent projection lamps, CDD incandescent projection lamps, CRX/CBS incandescent projection lamps, BAH BBA BCA ECA standard photofloods, EBW ECT standard photofloods, EXV EXX EZK reflector photofloods, DXC EAL reflector photofloods, double-ended projection lamps, G-6 G5.3 projection lamps, G-7 G29.5 projection lamps, G-7 2 button projection lamps, T-4 GY6.35 projection lamps, DFN/DFC/DCH/DJA/DFP incandescent projection lamps, DLD/DFZ GX17q incandescent projection lamps, DJL G17q incandescent projection lamps, DPT mog base incandescent projection lamps, lamp shape B (B8 cand, B10 can, B13 med), lamp shape C (C7 cand, C7 DC bay), lamp shape CA (CA8 cand, CA9 med, CA10 cand, CA10 med), lamp shape G (G16.5 cand, G16.5 DC bay, G16.5 SC bay, G16.5 med, G25 med, G30 med, G30 med skrt, G40 med, G40 mog) T6.5 DC bay, T8 disc (a single light engine module could be placed in one end, or a pair could be positioned one in each end), T6.5 inter, T8 med, lamp shape T (T4 cand, T4.5 cand, T6 cand, T6.5 DC bay, T7 cand, T7 DC bay, T7 inter, T8 cand, T8 DC bay, T8 inter, T8SC bay, T8 SC Pf, T10 med, T10 med Pf, T12 3C med, T14 med Pf, T20 mog bipost, T20 med bipost, T24 med bipost), lamp shape M (M14 med), lamp shape ER (ER30 med, ER39 med), lamp shape BR (BR30 med, BR40 med), lamp shape R (R14 SC bay, R14 inter, R20 med, R25 med, R30 med, R40 med, R40 med skrt, R40 mog, R52 mog), lamp shape P (P25 3C mog), lamp shape PS (PS25 3C mog, PS25 med, PS30 med, PS30 mog, PS35 mog, PS40 mog, PS40 mog Pf, PS52 mog), lamp shape PAR (PAR 20 med NP, PAR 30 med NP, PAR 36 scrw trim, PAR 38 skrt, PAR 38 med skrt, PAR38 med sid pr, PAR46 scrw trm, PAR46 mog end pr, PAR46 med sid pr, PAR56 scrw trm, PAR56 mog end pr, PAR56 mog end pr, PAR64 scrw trm, PAR64 ex mog end pr). (see https://www.gecatalogs.com/lighting/software/GELightingCatalogSetup.exe)(with respect to each of the form factors, a light engine module can be positioned in any suitable location, e.g., with its axis coaxial with an axis of the form factor (e.g., as shown in FIG. 9) and in any suitable location relative to the respective electrical connector). The lamps according to the present inventive subject matter can satisfy (or not satisfy) any or all of the other characteristics for A lamps (defined in ANSI C78.20-2003), or for any other type of lamp.

Lighting devices in accordance with the present inventive subject matter can be designed to emit light in any suitable pattern, e.g., in the form of a flood light, a spotlight, a downlight, etc. Lighting devices according to the present inventive subject matter can comprise one or more light sources that emit light in any suitable pattern, or one or more light sources that emit light in each of a plurality of different patterns.

Light engine modules according to the present inventive subject matter can be incorporated into any suitable lighting devices, a wide variety of which are known to those of skill in the art. For instance, light engine modules according to the present inventive subject matter can be incorporated into any of the lighting devices disclosed in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams); the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/467,467, filed on May 18, 2009 (now U.S. Patent Publication No. 2010/0290222), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/465,203 May 13, 2009, filed on May 13, 2009 (now U.S. Patent Publication No. 2010/0290208), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/566,936, filed on Sep. 25, 2009 (now U.S. Patent Publication No. 2011/0075423), the entirety of which is hereby incorporated by reference as if set forth in its entirety;

U.S. patent application Ser. No. 12/566,857, filed on Sep. 25, 2009 (now U.S. Patent Publication No. 2011/0075411), the entirety of which is hereby incorporated by reference as if set forth in its entirety;

U.S. patent application Ser. No. 12/621,970, filed on Nov. 19, 2009 (now U.S. Patent Publication No. 2011/0075414), the entirety of which is hereby incorporated by reference as if set forth in its entirety; and U.S. patent application Ser. No. 12/566,861, filed on Sep. 25, 2009 (now U.S. Patent Publication No. 2011/0075422), the entirety of which is hereby incorporated by reference as if set forth in its entirety.

Any desired circuitry (instead of or in addition to one or more compensation circuits, as discussed above), including any desired electronic components, can be employed in order to supply energy to the one or more solid state light emitters according to the present inventive subject matter. Representative examples of circuitry which may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

U.S. patent application Ser. No. 12/566,142, filed on Sep. 24, 2009, entitled "Solid State Lighting Apparatus With Configurable Shunts" (now U.S. Patent Publication No. 2011/0068696), the entirety of which is hereby incorporated by reference as if set forth in its entirety;

U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011/0068702); the entirety of which is hereby incorporated by reference as if set forth in its entirety.

For example, solid state lighting systems have been developed that include a power supply that receives the AC line voltage and converts that voltage to a voltage (e.g., to DC and to a different voltage value) and/or current suitable for driving solid state light emitters. Power supplies for light emitting diode light sources can include any of a wide variety of electrical components, e.g., linear current regulated supplies and/or pulse width modulated current and/or voltage regulated supplies, and can include bridge rectifiers, transformers, power factor controllers etc.

In some embodiments that comprise a first circuit board (on which a plurality of solid state light emitters are mounted) and a second circuit board (on which at least one compensation circuit is mounted), one or more electrical connections can be made among a power supply (which may or may not be part of the lighting device), the second circuit board and the first circuit board, and one or more other electrical connections can be made between the first and second circuit boards. For instance, two pins can be included that electrically contact the power supply, the second circuit board and the first circuit board (to power some or all of the solid state light emitters), and two pins can be included that electrically contact the first and second circuit boards, to provide for bypass around a subset of the solid state light emitters.

In some embodiments that comprise one or more support structures, first circuit board (on which a plurality of solid state light emitters are mounted) and a second circuit board (on which at least one compensation circuit is mounted), the support structure (or at least one of the plural support structures) can provide electrical connection (1) between the second circuit board and the first circuit board, and/or (2) between the first circuit board and a power supply (which may or may not be part of the lighting device), and/or (3) between the second circuit board and a power supply (which may or may not be part of the lighting device), and/or (4) between the first circuit board and an electrical connector (which may or may not be part of the lighting device), and/or (5) between the second circuit board and an electrical connector (which may or may not be part of the lighting device).

In some embodiments that comprise one or more support structures and a first circuit board (on which a plurality of solid state light emitters are mounted), the support structure (or at least one of the plural support structures) can provide electrical connection between the first circuit board and a power supply (which may or may not be part of the lighting device), and/or between the first circuit board and an electrical connector (which may or may not be part of the lighting device).

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg Johansen, U.S. Pat. No. 7,202,608 to Robinson et al, U.S. Pat. Nos. 6,995,518, 6,724,376, 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

Various electronic components (if provided in the lighting devices) can be mounted in any suitable way. For example, in some embodiments, light emitting diodes can be mounted on the one or more solid state light emitter support member, and electronic circuitry that can convert AC line voltage into DC voltage suitable for being supplied to light emitting diodes can be mounted on a separate element (e.g., a "driver circuit board"), whereby line voltage is supplied to the electrical connector and passed along to a driver circuit board, the line voltage is converted to DC voltage suitable for being supplied to light emitting diodes in the driver circuit board, and the DC voltage is passed along to the solid state light emitter support member (or members) where it is then supplied to the light emitting diodes. In some embodiments according to the present inventive subject matter, the solid state light emitter support member can comprise a metal core circuit board.

Some embodiments in accordance with the present inventive subject matter can comprise a power line that can be connected to a source of power (such as a branch circuit, a battery, a photovoltaic collector, etc.) and that can supply power to an electrical connector (or directly to an electrical contact, e.g., the power line itself can be an electrical connector). Persons of skill in the art are familiar with, and have ready access to, a variety of structures that can be used as a power line. A power line can be any structure that can carry electrical energy and supply it to an electrical connector on a lighting device and/or to a lighting device according to the present inventive subject matter.

Energy can be supplied to the lighting devices according to the present inventive subject matter from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

Lighting devices according to the present inventive subject matter can comprise any suitable structures. For example, as suitable, lighting devices according to the present inventive subject matter can comprise any structures, or portions thereof (e.g., arrangements of sources of visible light, mounting structures, schemes for mounting sources of visible light, housings for sources of visible light), described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/465,203, filed on May 13, 2009 (now U.S. Patent Publication No. 2010/0290208), the entirety of which is hereby incorporated by reference as if set forth in its entirety;

U.S. Patent Application No. 61/303,789, filed on Feb. 12, 2010, the entirety of which is hereby incorporated by reference as if set forth in its entirety; and U.S. Patent Application No. 61/303,797, filed on Feb. 12, 2010, the entirety of which is hereby incorporated by reference as if set forth in its entirety.

For example, lighting devices according to the present inventive subject matter can comprise a mixing chamber element, and/or can be attached to a trim element and/or a fixture element A mixing chamber element (if included) can be of any suitable shape and size, and can be made of any suitable material or materials. Light emitted by the one or more solid state light emitters can be mixed to a suitable extent in a mixing chamber before exiting the lighting device.

Representative examples of materials that can be used for making a mixing chamber element include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments, a mixing chamber element can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments, a mixing chamber is defined (at least in part) by a mixing chamber element. In some embodiments, a mixing chamber is defined in part by a mixing chamber element (and/or by a trim element) and in part by a lens and/or a diffuser. The expression "defined (at least in part)", e.g., as used in the expression "mixing chamber is defined (at least in part) by a mixing chamber element" means that the element or feature that is defined "at least in part" by a particular structure is defined completely by that structure or is defined by that structure in combination with one or more additional structures.

In some embodiments, at least one trim element can be attached to a lighting device according to the present inventive subject matter. A trim element (if included) can be of any suitable shape and size, and can be made of any suitable material or materials. Representative examples of materials that can be used for making a trim element include, among a wide variety of other materials, spun aluminum, stamped aluminum, die cast aluminum, rolled or stamped steel, hydroformed aluminum, injection molded metal, iron, injection molded thermoplastic, compression molded or injection molded thermoset, glass (e.g., molded glass), ceramic, liquid crystal polymer, polyphenylene sulfide (PPS), clear or tinted acrylic (PMMA) sheet, cast or injection molded acrylic, thermoset bulk molded compound or other composite material. In some embodiments that include a trim element, the trim element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®.

In some embodiments according to the present inventive subject matter, a mixing chamber element can be provided which comprises a trim element (e.g., a single structure can be provided which acts as a mixing chamber element and as a trim element, a mixing chamber element can be integral with a trim element, and/or a mixing chamber element can comprise a region that functions as a trim element). In some embodiments, such structure can also comprise some or all of a thermal management system for the lighting device. By providing such a structure, it is possible to reduce or minimize the thermal interfaces between the solid state light emitter(s) and the ambient environment (and thereby improve heat transfer), especially, in some cases, in devices in which a trim element acts as a heat sink for light source(s) (e.g., solid state light emitters) and is exposed to a room. In addition, such a structure can eliminate one or more assembly steps, and/or reduce parts count. In such lighting devices, the structure (i.e., the combined mixing chamber element and trim element) can further comprise one or more reflector and/or reflective film, with the structural aspects of the mixing chamber element being provided by the combined mixing chamber element and trim element).

In some embodiments, a lighting device according to the present inventive subject matter can be attached to at least one fixture element. A fixture element, when included, can comprise a fixture housing, a mounting structure, an enclosing structure, and/or any other suitable structure. Persons of skill in the art are familiar with, and can envision, a wide variety of materials out of which such fixture elements can be constructed, and a wide variety of shapes for such fixture elements. Fixture elements made of any of such materials and having any of such shapes can be employed in accordance with the present inventive subject matter.

For example, fixture elements, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/467,467, filed on May 18, 2009 (now U.S. Patent Publication No. 2010/0290222), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/465,203, filed on May 13, 2009 (now U.S. Patent Publication No. 2010/0290208), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/566,936, filed on Sep. 25, 2009 (now U.S. Patent Publication No. 2011/0075423), the entirety of which is hereby incorporated by reference as if set forth in its entirety;

U.S. patent application Ser. No. 12/566,857, filed on Sep. 25, 2009 (now U.S. Patent Publication No. 2011/0075411), the entirety of which is hereby incorporated by reference as if set forth in its entirety;

U.S. patent application Ser. No. 12/621,970, filed on Nov. 19, 2009 (now U.S. Patent Publication No. 2011/0075414), the entirety of which is hereby incorporated by reference as if set forth in its entirety; and U.S. patent application Ser. No. 12/566,861, filed on Sep. 25, 2009 (now U.S. Patent Publication No. 2011/0075422), the entirety of which is hereby incorporated by reference as if set forth in its entirety.

In some embodiments, a fixture element, if provided, can further comprise an electrical connector that engages an electrical connector on the lighting device or that is electrically connected to the lighting device In some embodiments that include a fixture element, an electrical connector is provided that is substantially non-moving relative to the fixture element, e.g., the force normally employed when installing an Edison plug in an Edison socket does not cause the Edison socket to move more than one centimeter relative to the fixture element, and in some embodiments, not more than ½ centimeter (or not more than ¼ centimeter, or not more than one millimeter, etc.). In some embodiments, an electrical connector that engages an electrical connector on the lighting device can move relative to a fixture element, and structure can be provided to limit movement of the lighting device relative to the fixture element (e.g., as disclosed in U.S. patent application Ser. No. 11/877,038, filed Oct. 23, 2007 (now U.S. Patent Publication No. 2008/0106907), the entirety of which is hereby incorporated by reference as if set forth in its entirety).

In some embodiments, one or more structures can be attached to a lighting device that engage structure in a fixture element to hold the lighting device in place relative to the fixture element. In some embodiments, the lighting device can be biased against a fixture element, e.g., so that a flange portion of a trim element is maintained in contact (and forced against) a bottom region of a fixture element (e.g., a circular extremity of a cylindrical can light housing). Additional examples of structures that can be used to hold a lighting device in place relative to a fixture element are disclosed in U.S. patent application Ser. No. 11/877,038, filed Oct. 23, 2007 (now U.S. Patent Publication No. 2008/0106907), the entirety of which is hereby incorporated by reference as if set forth in its entirety).

The lighting devices of the present inventive subject matter can be arranged in generally any suitable orientation, a variety of which are well known to persons skilled in the art. For example, the lighting device can be a back-reflecting device or a front-emitting device.

Persons of skill in the art are familiar with, and have ready access to, a wide variety of filters (discussed in more detail below), and any suitable filter (or filters), or combinations of different types of filters, can be employed in accordance with the present inventive subject matter. Such filters include (1) pass-through filters, i.e., filters in which light to be filtered is directed toward the filter, and some or all of the light passes through the filter (e.g., some of the light does not pass through the filter) and the light that passes through the filter is the filtered light, (2) reflection filters, i.e., filters in which light to be filtered is directed toward the filter, and some or all of the light is reflected by the filter (e.g., some of the light is not reflected by the filter) and the light that is reflected by the filter is the filtered light, and (3) filters that provide a combination of both pass-through filtering and reflection filtering.

In many situations, the lifetime of solid state light emitters, can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of the thermal management system of the lighting device is/are selected so as to extract heat from the solid state light emitter(s) and dissipate the extracted heat to a surrounding environment at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

Solid state light emitter lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

Various embodiments are described herein with reference to "expected L70 lifetime." Because the lifetimes of solid state lighting products are measured in the tens of thousands of hours, it is generally impractical to perform full term testing to measure the lifetime of the product. Therefore, projections of lifetime from test data on the system and/or light source are used to project the lifetime of the system. Such testing methods include, but are not limited to, the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein. Accordingly, the term "expected L70 lifetime" refers to the predicted L70 lifetime of a product as evidenced, for example, by the L70 lifetime projections of ENERGY STAR, ASSIST and/or a manufacturer's claims of lifetime.

Lighting devices according to some embodiments of the present inventive subject matter provide an expected L70 lifetime of at least 25,000 hours. Lighting devices according to some embodiments of the present inventive subject matter provide expected L70 lifetimes of at least 35,000 hours, and lighting devices according to some embodiments of the present inventive subject matter provide expected L70 lifetimes of at least 50,000 hours.

In some aspects of the present inventive subject matter, there are provided solid state light emitter lighting devices that provide good efficiency and that are within the size and shape constraints of the lamp for which the solid state light emitter lighting device is a replacement. In some embodiments of this type, there are provided solid state light emitter lighting devices that provide lumen output of at least 600 lumens, and in some embodiments at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens (or in some cases at least even higher lumen outputs), and/or CRI Ra of at least 70, and in some embodiments at least 80, at least 85, at least 90 or at least 95).

In some aspects of the present inventive subject matter, which can include or not include any of the features described elsewhere herein, there are provided solid state light emitter lighting devices that provide sufficient lumen output (to be useful as a replacement for a conventional lamp), that provide good efficiency and that are within the size and shape constraints of the lamp for which the solid state light emitter lighting device is a replacement. In some cases, "sufficient lumen output" means at least 75% of the lumen output of the lamp for which the solid state light emitter lighting device is a replacement, and in some cases, at least 85%, 90%, 95%, 100%, 105%, 110%, 115%, 120% or 125% of the lumen output of the lamp for which the solid state light emitter lighting device is a replacement.

The lighting devices according to the present inventive subject matter can direct light in any desired range of directions. For instance, in some embodiments, the lighting device can direct light substantially omnidirectionally (i.e., substantially 100% of all directions extending from a center of the lighting device), i.e., within a volume defined by a two-dimensional shape in an x, y plane that encompasses rays extending from 0 degrees to 180 degrees relative to the y axis (i.e., 0 degrees extending from the origin along the positive y axis, 180 degrees extending from the origin along the negative y axis), the two-dimensional shape being rotated 360 degrees about the y axis (in some cases, the y axis can be a vertical axis of the lighting device). In some embodiments, the lighting device emits light substantially in all directions within a volume defined by a two-dimensional shape in an x, y plane that encompasses rays extending from 0 degrees to 150 degrees relative to the y axis (extending along a vertical axis of the lighting device), the two-dimensional shape being rotated 360 degrees about the y axis. In some embodiments, the lighting device emits light substantially in all directions within a volume defined by a two-dimensional shape in an x, y plane that encompasses rays extending from 0 degrees to 120 degrees relative to the y axis (extending along a vertical axis of the lighting device), the two-dimensional shape being rotated 360 degrees about the y axis. In some embodiments, the lighting device emits light substantially in all directions within a volume defined by a two-dimensional shape in an x, y plane that encompasses rays extending from 0 degrees to 90 degrees relative to the y axis (extending along a vertical axis of the lighting device), the two-dimensional shape being rotated 360 degrees about the y axis (i.e., a hemispherical region). In some embodiments, the two-dimensional shape can instead encompass rays extending from an angle in the range of from 0 to 30 degrees (or from 30 degrees to 60 degrees, or from 60 degrees to 90 degrees) to an angle in the range of from 90 to 120 degrees (or from 120 degrees to 150 degrees, or from 150 degrees to 180 degrees). In some embodiments, the range of directions in which the lighting device emits light can be non-symmetrical about any axis, i.e., different embodiments can have any suitable range of directions of light emission, which can be continuous or discontinuous (e.g., regions of ranges of emissions can be surrounded by regions of ranges in which light is not emitted). In some embodiments, the lighting device can emit light in at least 50% of all directions extending from a center of the lighting device (e.g., hemispherical being 50%), and in some embodiments at least 60%, 70%, 80%, 90% or more.

Heat transfer from one structure or region to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal pad, thermal grease, graphite sheets, etc.

In some embodiments according to the present inventive subject matter, a portion (or portions) of any module, element, or other component of the lighting device) can comprise one or more thermal transfer region(s) that has/have an elevated heat conductivity (e.g., higher than the rest of that module, element or other component. A thermal transfer region (or regions) can be made of any suitable material, and can be of any suitable shape. Use of materials having higher heat conductivity in making the thermal transfer region(s) generally provides greater heat transfer, and use of thermal transfer region(s) of larger surface area and/or cross-sectional area generally provides greater heat transfer. Representative examples of materials that can be used to make the thermal transfer region(s), if provided, include metals, diamond, DLC, etc. Representative examples of shapes in which the thermal transfer region(s), if provided, can be formed include bars, slivers, slices, crossbars, wires and/or wire patterns. A thermal transfer region (or regions), if included, can also function as one or more pathways for carrying electricity, if desired.

The present inventive subject matter is further directed to methods comprising mounting any light engine module according to the description herein to any lighting device element according to the description herein.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 1:
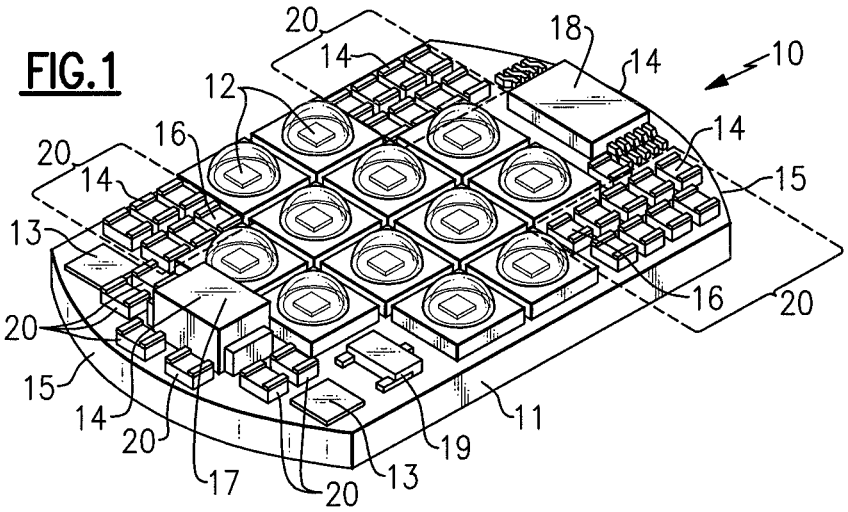
FIG. 1 is a first perspective view of a light engine module 10.
Figure 2:
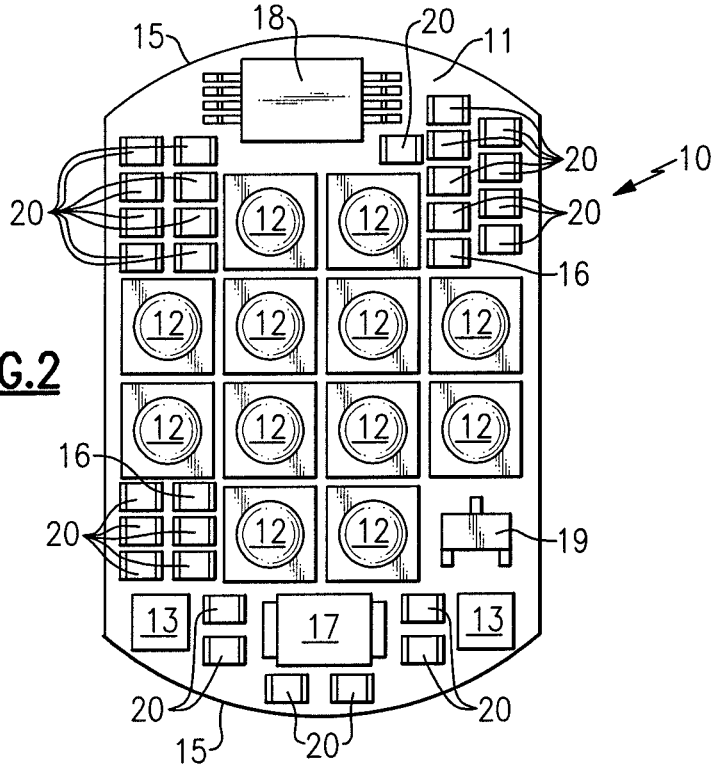
FIG. 2 is a top view of the light engine module 10.
Figure 3:
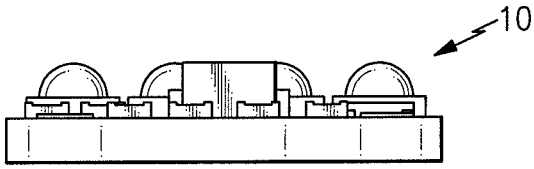
FIG. 3 is a side view of the light engine module 10.

FIGS. 1-3 illustrate a light engine module 10 in accordance with the present inventive subject matter. FIG. 1 is a first perspective view of the light engine module 10. FIG. 2 is a top view of the light engine module 10. FIG. 3 is a side view of the light engine module 10.

Referring to FIG. 2, the light engine module 10 comprises a first solid state light emitter support member 11, a plurality (twelve) of solid state light emitters 12 mounted on the solid state light emitter support member 11, first and second electrical contact elements 13 located on the solid state light emitter support member 11, and a plurality of other circuitry components (including compensation circuitry) 14 mounted on the solid state light emitter support member 11. Such circuitry components include a pair of thermistors 16, a power diode 17, a dual comparator 18, and a switching transistor 19, along with one or more zener diodes, capacitors and resistors 20.

As shown in FIGS. 1 and 2, first and second regions 15 of the solid state light emitter support member 11 each comprise a surface that has a curved (i.e., arc-shaped) cross-section.

Figure 5:
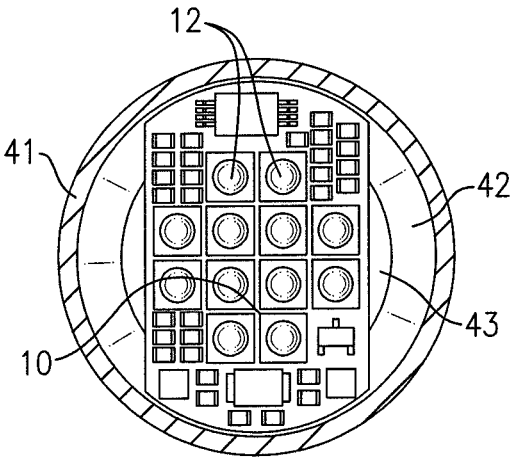
FIG. 5 is a sectional view taken along plane 5-5 shown in FIG. 4.

FIGS. 4-5 illustrate a lighting device 40 in accordance with the present inventive subject matter. FIG. 4 is a sectional view of the lighting device 40, and FIG. 5 is a sectional view taken along plane 5-5 shown in FIG. 4.

Referring to FIG. 4, the lighting device 40 comprises a lens 41, a housing member 42 an electrical connector 43 and a light engine module 10 (which can be, for example, as shown in FIGS. 1-3). The light engine module 10 is mounted in the housing member 42 and its curved edges are in contact with the housing member 42.

Referring to FIG. 5, the plurality of solid state light emitters 12 are mounted on a first surface of the solid state light emitter support member 11, the solid state light emitter support member 11 is mounted within the housing member 42, and the first surface does not fill the entire cross-section of the housing member 42, so that the majority of the light emitted by the plurality of solid state light emitters 12 travels into a first hemisphere defined by the first surface and in which the plurality of solid state light emitters 12 are located (i.e., upward in the orientation shown in FIG. 4), but some light emitted by the one or more of the plurality of solid state light emitters 12 also travels into a second hemisphere which is complementary to the first hemisphere (i.e., downward in the orientation shown in FIG. 4), through spaces defined between the perimeter of the solid state light emitter support member 11 and the inside wall of the housing member 42. Some or all of the housing member 42 can be transparent (or substantially transparent or partially transparent), in order to allow such light in the second hemisphere to exit from the lighting device 40.

As can be seen in FIG. 4, the lens 41, together with the housing member 42 and the electrical connector 43, defines a space in which the light engine module 10 is located, whereby at least some of the light that is emitted by the plurality of solid state light emitters 12 passes through the lens 41. The outermost regions of the lens 41, the housing member 42 and the electrical connector 43 in combination provide a shape that corresponds to a conventional A lamp.

Referring again to FIG. 2, the plurality of solid state light emitters 12 are mounted on a first surface of the solid state light emitter support member 11, and more than 40% of the surface area of the first surface of the solid state light emitter support member 11 is covered by the plurality of solid state light emitters 12.

Figure 6:
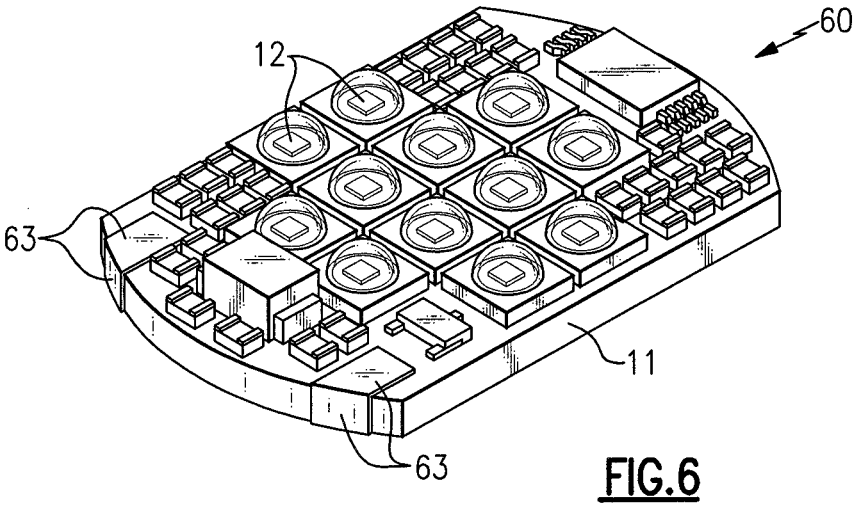
FIG. 6 illustrates a light engine module 60.

FIG. 6 illustrates a light engine module 60 that is similar to the light engine module 10 illustrated in FIGS. 1-3, except that the light engine module 60 includes first and second electrical contact elements 63 (instead of the electrical contact elements 13) which wrap around the edge of the lighting device 60. Alternatively, the electrical connector 63 could be (1) only on the curved edge of the lighting device 60, (2) only on the surface of the solid state light emitter support member 11 that is opposite to the surface on which the plurality of solid state light emitters 12 are mounted, (3) on the curved edge of the lighting device 60 and on the surface of the solid state light emitter support member 11 that is opposite to the surface on which the plurality of solid state light emitters 12 are mounted, or (4) on any other portion or portions of the solid state light emitter support member 11. In some of such embodiments, at least portions of the electrical connector 63 can come into contact with a corresponding conductive element (e.g., a contact, spring element, trace, wire bond, etc.) mounted on a housing member (or any other lighting device element), whereby electricity supplied to the conductive element can be supplied through such contact (or contacts) to the electrical connector 63.

Figure 7:
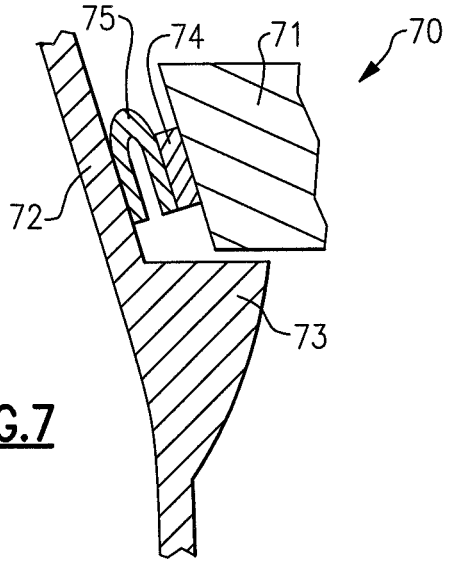
FIG. 7 illustrates close-up view of a portion of a lighting device.

FIG. 7 illustrates close-up view of a portion of a lighting device in which a light engine module 70 is mounted in a housing member 72, with a portion of the light engine module 70 (namely, a perimeter region of a solid state light emitter support member 71 resting on a protrusion 73 from the housing member 72, and in which the light engine module 70 comprises an electrical contact element 74 that is in contact with a conductive element 75 provided on the housing member 72. Alternatively (or additionally), in some embodiments, an electrical contact on a light engine module can be in contact with a conductive element located on a protrusion like the protrusion 73 shown in FIG. 7, or with a conductive element located in any other suitable place.

Figure 8:
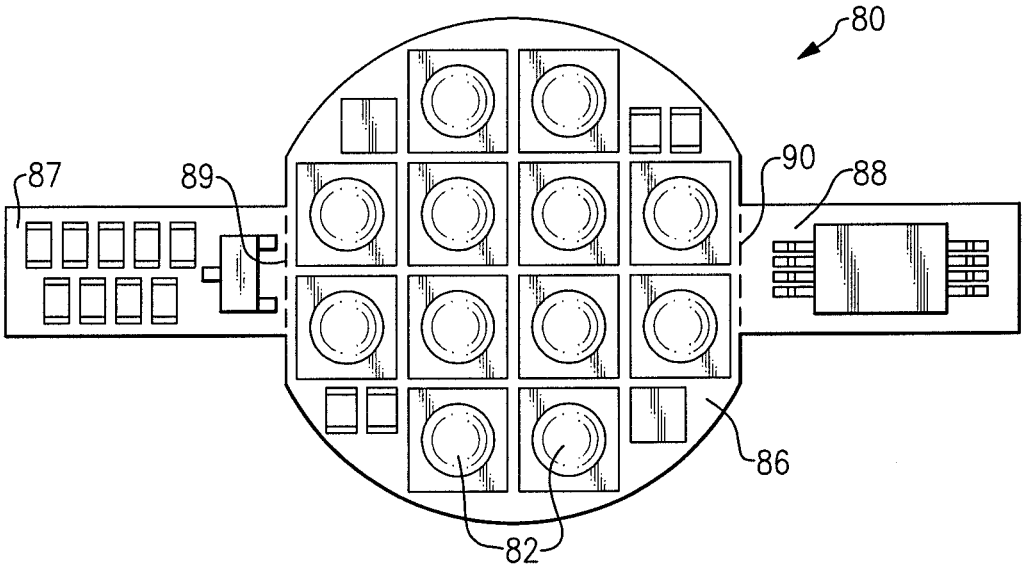
FIG. 8 illustrates a light engine module 80.

FIG. 8 illustrates a light engine module 80 that is similar to the light engine module 10 illustrated in FIGS. 1-3, except that the light engine module 80 comprises (1) a generally circular first surface 86 on which the solid state light emitters 82 are mounted, the first surface 86 being is smaller than the surface on which the plurality of solid state light emitters 12 are mounted in the light engine module 10, (2) a first extended portion 87 (on which circuitry components are mounted), and (3) a second extended portion 88 (on which circuitry components are mounted), and in which the first and second extended portions 87 and 88 can be bent (along dotted lines 89 and 90 respectively) so that the light aperture can be reduced and/or minimized (i.e., to increase and/or maximize the spaces between the perimeter of the light engine module 80 and the inside wall of a housing in which the light engine module 80 is placed.

FIG. 9 is a cross-sectional view of a lighting device 90 in accordance with the present inventive subject matter. Referring to FIG. 9, there is shown a lighting device 90 that comprises a lens 91, a housing member 92 and an electrical connector 93. Positioned within the lighting device 90 is a light engine module 94 that comprises a solid state light emitter support member 95 in the form of a printed circuit board (on which a plurality of solid state light emitters 96 are mounted), a heat spreader 97, a compensation circuit 98 and a temperature sensor 99. The heat spreader 97 can be made of any suitable material, e.g., copper. The temperature sensor 99 can be any suitable temperature sensor, e.g., a thermistor. As shown in FIG. 9, in this embodiment, the temperature sensor 99 is positioned between the heat spreader 97 and the compensation circuit 98. In addition, as shown in FIG. 9, in this embodiment, the heat spreader 97, the compensation circuit 98 and the temperature sensor 99 are all mounted on a surface of the solid state light emitter support member 95 that is opposite to the surface of the solid state light emitter support member 95 on which the solid state light emitters 96 are mounted.

In addition, as shown in FIG. 9, in the embodiment shown in FIG. 9, a substantial entirety of the light engine module 94 is located on a first side (i.e., below in the orientation shown in FIG. 9) of an emission plane of the solid state light emitters 96, substantially all of the light emitted by the solid state light emitters 96 is emitted into a second side of the emission plane of the solid state light emitters 96 (i.e., in the orientation shown in FIG. 9, above the emission plane of the solid state light emitters 96). In addition, in this embodiment, the largest dimension of the light engine module 94 (i.e., its diameter in a plane perpendicular to the page) is at least as large as any other dimension of the light engine module 94 extending in any other plane that is parallel to the emission plane of the solid state light emitters 96, i.e., starting from the solid state light emitter support member 95 and moving downward, the periphery of the light engine module 94 in any horizontal (in the orientation shown in FIG. 9) plane is either equal to or smaller than the periphery of the solid state light emitter support member 95 in a horizontal plane. In fact, in FIG. 9, moving downward, the periphery of the light engine module 94 in any horizontal plane is either equal to or smaller than the periphery of the solid state light emitter support member 95 in any horizontal plane that is closer to the solid state light emitter support member 95 (in other words, the light engine module 94 tapers as it extends downward, thereby enabling it to fit more easily within many form factors, e.g., A lamps).

In the embodiment shown in FIG. 9, the heat spreader 97 can move heat away from the solid state light emitters 96 to one or more heat sink regions and/or one or more heat dissipation regions, and/or the heat spreader 97 can itself provide surface area from which heat can be dissipated (e.g., the heat spreader 97 can comprise fins that extend from the housing member 92).

In the embodiment shown in FIG. 9, the compensation circuit 98 is positioned in contact with the heat spreader 97, i.e., the heat spreader 97 is located between the solid state light emitter support member 95 and the compensation circuit 98, and the heat spreader 97 has a recess that opens to a surface of the heat spreader 97 that is remote from the solid state light emitter support member 95, and the compensation circuit 98 is located within that recess.

In the embodiment shown in FIG. 9, (1) the heat spreader 97 is in contact with a second surface of the solid state light emitter support member 95, and the solid state light emitters 96 are mounted on a first surface of the solid state light emitter support member 95, with the first surface and the second surface being on opposite sides of the solid state light emitter support member 95, (2) a compensation circuit 98 is in contact with the heat spreader 97, i.e., the heat spreader 97 is located between the solid state light emitter support member 95 and the compensation circuit 98, and the heat spreader 97 has a recess that opens to a surface of the heat spreader 97 that is remote from the solid state light emitter support member 95, and (3) the temperature sensor 99 is in contact with the heat spreader 97, between the heat spreader 97 and the compensation circuit 98.

Figure 10:
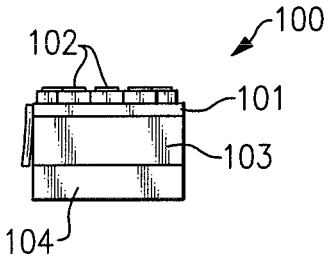
FIG. 10 illustrates a light engine module 100.

FIG. 10 illustrates a light engine module 100 that comprises a solid state light emitter support member 101 (on which a plurality of solid state light emitters 102 are mounted), a heat spreader 103, and a compensation circuit 104. Referring to FIG. 10, the heat spreader 103 and the compensation circuit 104 are mounted on a surface of the solid state light emitter support member 101 that is opposite to the surface of the solid state light emitter support member 101 on which the solid state light emitters 102 are mounted. In addition, the heat spreader 103 is located between the solid state light emitter support member 101 and the compensation circuit 104.

Figure 11:
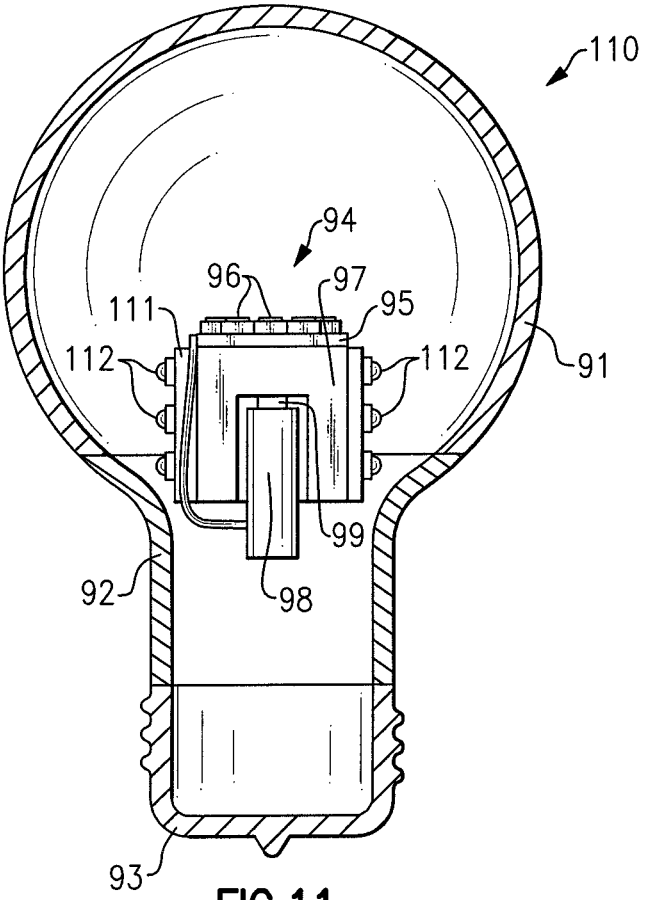
FIG. 11 illustrates a lighting device 110.

FIG. 11 illustrates a lighting device 110 which is similar to the lighting device 90 shown in FIG. 9, except that in the lighting device 110, the light engine module 94 is located higher (in the orientation shown in FIGS. 9 and 11) relative to the housing member 92, at least one additional solid state light emitter support member 111 (e.g., of an annular shape) is provided and additional solid state light emitters 112 are mounted on the solid state light emitter support member 111, and the housing member 92 (none of which, a portion of which, or all of which can be transparent, substantially transparent or partially transparent) extends higher than it does in the lighting device 90. The solid state light emitters 112 in the lighting device 110 provide light in a lower hemisphere (i.e., below a horizontal plane extending through the solid state light emitters 96, and/or assist in increasing the intensity of light in the lower hemisphere.

In the lighting device 110, the light engine module 94 extends from one side of an interface between the housing element 92 and the lens 91 to the other side of such interface. In the orientation shown in FIG. 11, the lens 91 is above the interface and the housing element 92 is below the interface, and the solid state light emitter support members 111 extends from below the interface to above the interface. Some of the solid state light emitters 112 are mounted on a portions of the solid state light emitter support member 111 that is on the side of the interface on which the lens 91 is located, and others of the solid state light emitter 112 are mounted on a portions of the solid state light emitter support member 111 that is on the side of the interface on which the housing element 92 is located. In this embodiment, the light engine module 94 is shaped and oriented as a pedestal, with solid state light emitters positioned on the top and the sides of the pedestal.

Figure 12:
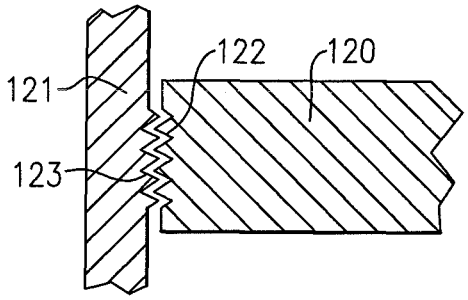
FIG. 12 is a partial cross-sectional view depicting a portion of a solid state light emitter support member that is held in place relative to a housing member.

FIG. 12 is a partial cross-sectional view depicting a portion of a solid state light emitter support member 120 that is held in place relative to a housing member 121 by providing threads 122 on an edge surface of the solid state light emitter support member 120 which are threadedly engaged in corresponding threads 123 provided in the interior of the housing member.

Figure 13:
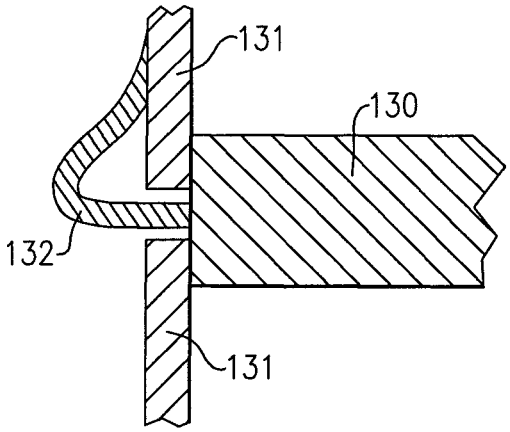
FIG. 13 is a partial cross-sectional view depicting a portion of a solid state light emitter support member that is held in place relative to a housing member.

FIG. 13 is a partial cross-sectional view depicting a portion of a solid state light emitter support member 130 that is held in place relative to a housing member 131 by providing clips 132 (only one being visible in FIG. 13) on the housing member 131 which engage the solid state light emitter support member 130.

Figure 14:
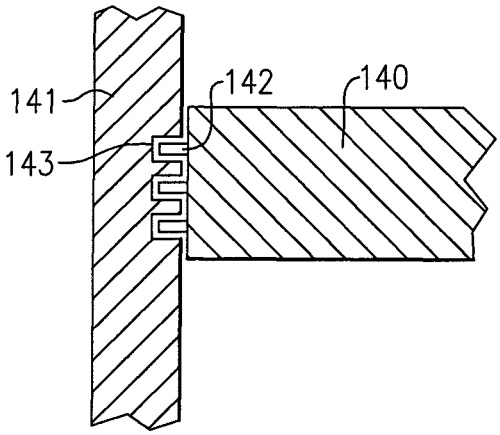
FIG. 14 is a partial cross-sectional view depicting a portion of a solid state light emitter support member that is held in place relative to a housing member.

FIG. 14 is a partial cross-sectional view depicting a portion of a solid state light emitter support member 140 that is held in place relative to a housing member 141 by providing pins 142 (which can be rigid or which can be retractable and spring biased outward) on the solid state light emitter support member 140 which fit into recesses 143 provided on the housing member 141.

Figure 15:
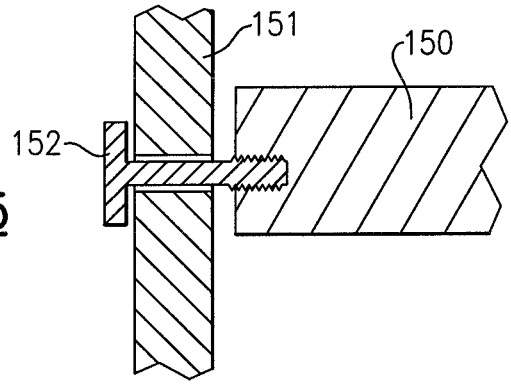
FIG. 15 is a partial cross-sectional view depicting a portion of a solid state light emitter support member that is held in place relative to a housing member.

FIG. 15 is a partial cross-sectional view depicting a portion of a solid state light emitter support member 150 that is held in place relative to a housing member 151 using screws 152 that extend through the housing member 151 and through a portion of the solid state light emitter support member 150.

Figure 16:
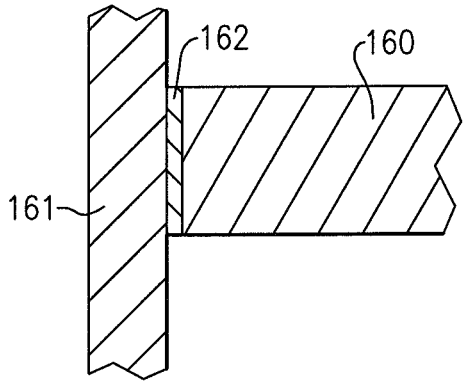
FIG. 16 is a partial cross-sectional view depicting a portion of a solid state light emitter support member that is held in place relative to a housing member.

FIG. 16 is a partial cross-sectional view depicting a portion of a solid state light emitter support member 160 that is held in place relative to a housing member 161 using adhesive 162.

Figure 17:
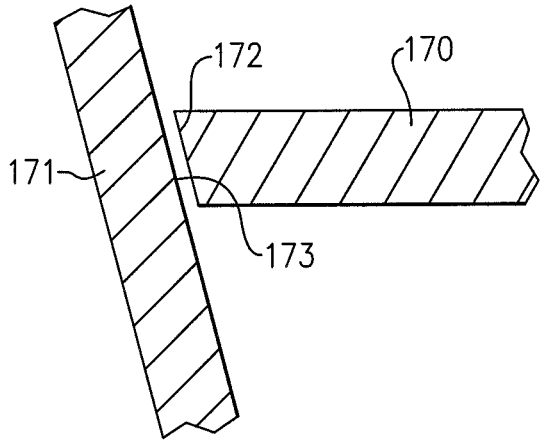
FIG. 17 is a partial cross-sectional view depicting a portion of a solid state light emitter support member that is held in place relative to a housing member.

FIG. 17 is a partial cross-sectional view depicting a portion of a solid state light emitter support member 170 that is held in place relative to a housing member 171 through geometry, wherein an external frustoconical surface 172 on the solid state light emitter support member 170 engages an internal frustoconical surface 173 on the housing member 171.

Figure 19:
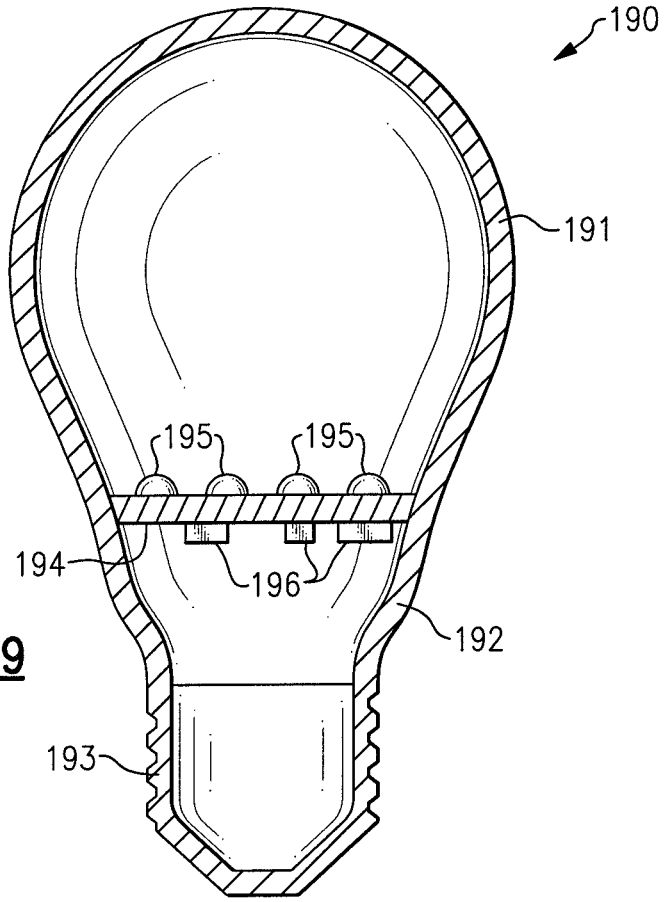
FIG. 19 is a sectional view of a lighting device 190 in accordance with the present inventive subject matter.

FIG. 19 is a sectional view of a lighting device 190 that comprises a lens 191, a housing member 192, an electrical connector 193 and a solid state light emitter support member 194, in which the solid state light emitter support member 194 consists of a circuit board. A plurality of solid state light emitters 195 are mounted on a first surface of the solid state light emitter support member 194 and circuitry 196 (including a compensation circuit) is mounted on a second surface of the solid state light emitter support member 194 (in this embodiment, the first surface and the second surface are on opposite sides of the solid state light emitter support member 194).

Many lighting devices (e.g., many A lamps) have form factors such that the outer dimension of the lighting device tapers, e.g., in the example depicted in FIG. 19 (and in the orientation depicted in FIG. 19), the outer dimension can be progressively smaller at lower portions, such that in many of such devices, the space inside the lighting device (in which there can be positioned components such as those included in light engine modules described herein, e.g., a first circuit board (on which one or more solid state light emitters are mounted), a second circuit board (on which at least one compensation circuit is mounted), a first support structure (to which the first and second circuit boards are attached), a second support structure (to which the first support structure is attached and which is attached to a lighting device element), one or more solid state light emitters, and/or one or more compensation circuit components) can likewise be progressively smaller at lower portions, so that the walls of light engine modules according to the present inventive subject matter can in some situations be of larger overall dimension (e.g., width), the higher up (in the orientation depicted in FIG. 19) the light engine module sits relative to the lighting device element (e.g., the housing member and/or the lens).

Figure 20:
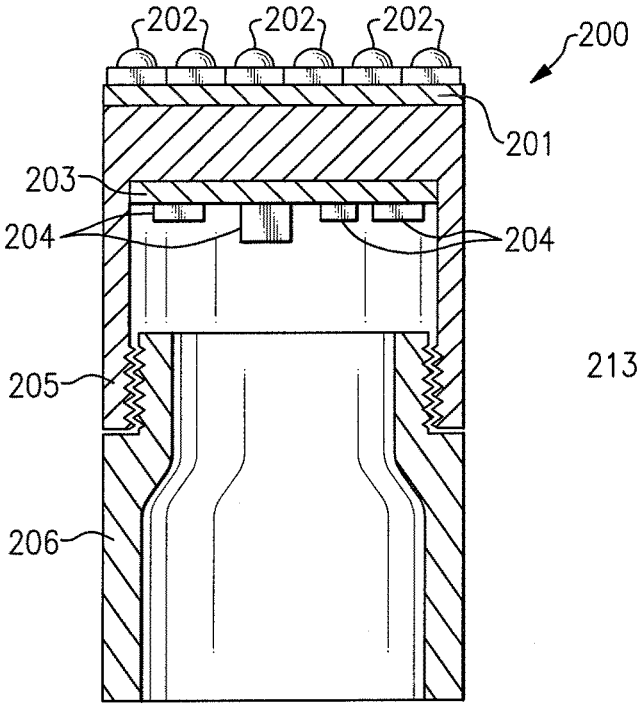
FIG. 20 is a sectional view of a light engine module 200.

FIG. 20 is a sectional view of a light engine module 200 that comprises four support elements, namely, a first circuit board 201 (e.g., a metal core circuit board) on which a plurality of solid state light emitters 202 are mounted, a second circuit board 203 (e.g., a metal core circuit board or an FR4 circuit board) on which circuitry 204 (including a compensation circuit) is mounted, a first support structure 205 (e.g., of a material that has high heat conductivity, such as aluminum or copper) to which the first circuit board 201 and the second circuit board 203 are attached (permanently or removably) on opposite sides and a second support structure 206 (e.g., of a material that has high heat conductivity, such as aluminum or copper) to which the first support structure 205 is removably attached with screw threading.

Figure 21:
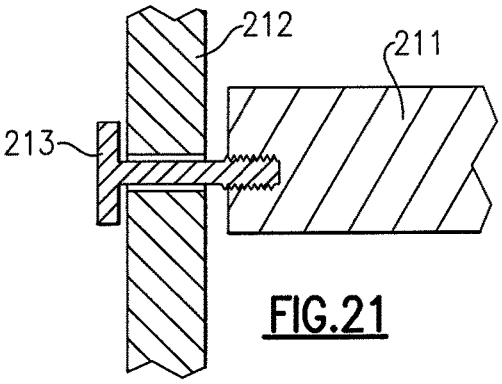
FIG. 21 is a sectional view depicting a portion of a circuit board that is attached to a support structure in an embodiment of a light engine module.

FIG. 21 is a sectional view depicting a portion of a circuit board 211 that is attached to a support structure 212 (only a portion of which is shown) with a screw 213.

Figure 22:
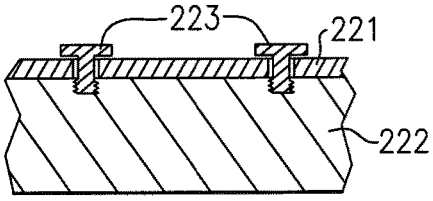
FIG. 22 is a sectional view depicting a portion of a circuit board that is attached to a support structure in an embodiment of a light engine module.

FIG. 22 is a sectional view depicting a portion of a circuit board 221 that is attached to a support structure 222 (only a portion of which is shown) with screws 223.

FIG. 23 is a sectional view depicting a portion of a circuit board 231 that includes an integral clip 233, and a support structure 232 that includes a protrusion 234 that is engageable with the clip 233, and the end of the circuit board 231 that is depicted in FIG. 23 is attached to the support structure 222 by engagement of the clip 233 with the protrusion 234.

FIG. 24 is a sectional view depicting a portion of a light engine module 240 that comprises a first circuit board 241 which is attached to a first support structure 245 (only a portion of which is shown) with adhesive 246, and a second circuit board 243 (on which components 247 are mounted), also attached to the first support structure 245 with adhesive 246.

FIG. 25 is a sectional view depicting a first circuit board 251 (1) which is positioned in (and which fits snugly within) a recess 257 in a first support structure 255 (only a portion of which is shown) and which is attached to the first support structure 255 by compression, or (2) which is press fit in the recess 257 (optionally with adhesive).

FIG. 26 is a sectional view depicting a first circuit board 261 that has a ridge 262 (on an edge thereof) that fits into a groove 264 in a first support structure 263 (only a portion of which is shown).

FIG. 27 is a sectional view depicting a first circuit board 271 that has two tabs 272 (only one of which is visible) on an edge thereof, that fit into respective slots 274 in a first support structure 273.

FIG. 28 is a top view depicting a first circuit board 281 that has tabs 282 (on an edge thereof) that fit into respective grooves 284 in a first support structure 283.

FIG. 29 is a sectional view depicting a portion of a light engine module 290 that comprises a first circuit board 291 which is attached to one side of a first support structure 295 (only a portion of which is shown), and a second circuit board 293 which is attached to an opposite side of the first support structure 295. Electrical connections are provided between contacts on the first and second circuit boards 291 and 293 with four pins 296 (only two pins 296 are visible in FIG. 29), the pins 296 extending through holes 297 in the first support structure 295. A first insulating layer 298 is provided between the first circuit board 291 and the first support structure 295, and a second insulating layer 299 is provided between the second circuit board 293 and the first support structure 295. The pins 296 comprise indentations 292 and ribs 294 order to assist in holding the pin 296 in place relative to the first support structure 295.

FIG. 30 is a sectional view depicting a portion of a light engine module 300 that comprises a first circuit board 301 which is attached to one side of a first support structure 305 (only a portion of which is shown), and a second circuit board 303 which is attached to an opposite side of the first support structure 305. Electrical connections are provided between contacts on the first and second circuit boards 301 and 303 with insulated wires 306 that extend through a hole 307 in the first support structure 305. A first insulating layer 308 is provided between the first circuit board 301 and the first support structure 305, and a second insulating layer 309 is provided between the second circuit board 303 and the first support structure 305.

FIG. 31 is a sectional view depicting a portion of a light engine module 310 that comprises a first circuit board 311 which is attached to one side of a first support structure 315 (only a portion of which is shown), and a second circuit board 313 which is attached to an opposite side of the first support structure 315. Electrical connections are provided between contacts on the first and second circuit boards 311 and 313 with ribbon cable 316 that extend through a hole 317 in the first support structure 315. A first insulating layer 318 is provided between the first circuit board 311 and the first support structure 315, and a second insulating layer 319 is provided between the second circuit board 313 and the first support structure 315.

FIG. 32 is a sectional view depicting a portion of a light engine module 320 that comprises a first circuit board 321 which is attached to one side of a first support structure 325 (only a portion of which is shown), and a second circuit board 323 which is attached to an opposite side of the first support structure 325. Electrical connections are provided between contacts on the first and second circuit boards 321 and 323 with four interconnects 326 (only two are visible in FIG. 32) that each comprise a conductive portion 322 and an insulating region 324 (which surrounds the corresponding conductive portion), and that extend through the first support structure 325. A first insulating layer 328 is provided between the first circuit board 321 and the first support structure 325, and a second insulating layer 329 is provided between the second circuit board 323 and the first support structure 325.

FIG. 33 is a sectional view depicting a portion of a light engine module 330 that comprises a first circuit board 331 which is attached to one side of a first support structure 335 (only a portion of which is shown), and a second circuit board 333 which is attached to an opposite side of the first support structure 335. Electrical connections are provided between contacts 332 on the first and second circuit boards 331 and 333 with spring conductors 336 that extend through respective holes 337 in the first support structure 335. A first insulating layer 338 is provided between the first circuit board 331 and the first support structure 335, and a second insulating layer 339 is provided between the second circuit board 333 and the first support structure 335. FIG. 33 further depicts a power supply module 345 positioned within a cavity defined inside the first support structure 335.

FIG. 34 is a sectional view of a pin 340 that comprises a conductive portion 341 and an insulating portion 342, and in which the conductive portion 341 and the insulating portion 342 each include ribs 343 and indentations 344 to assist in holding the pin 340 in place relative to the structure in which it is positioned, and to assist in holding the conductive portion 341 in place relative to the insulating portion 342.

FIG. 35 is a top view of a light engine module 350 that comprises a first circuit board 353 and eleven solid state light emitters (351 and 352), and in which a slot 354 is provided in the first circuit board 353 (and which extends through a first support structure and a second circuit board, not visible in FIG. 35, located beneath the first circuit board 353), through which one or more electrical conductor can be passed (e.g., one or more electrical conductor that is electrically connected to one or more components on a second circuit board and/or one or more components on a power supply, etc.). In comparison with the light engine module 180 depicted in FIG. 18, one solid state light emitter has been removed to make space for the slot 354.

In embodiments that comprise two or more support structures, any of the support structures can be connected to in any suitable way, e.g., with connecting structures analogous to the connecting structures depicted in FIGS. 20-27. In addition, in any such embodiment, the first support structure and the second support structure can include respective structures that assist in properly aligning the first support structure relative to the second support structure, e.g., with structures analogous to the structures depicted in FIG. 28.

In some embodiments, an electrical connector can be attached to one or more other components of the lighting device in any suitable way, e.g., with connecting structures analogous to the connecting structures depicted in FIGS. 20-27. In addition, in any such embodiment, the first support structure and the second support structure can include respective structures that assist in properly aligning the first support structure relative to the second support structure, e.g., with structures analogous to the structures depicted in FIG. 28.

FIG. 36 is a perspective cross-sectional view of a portion of a light engine module 360 that comprises a first circuit board 361 which is attached to one side of a first support structure 365 (only a portion of which is shown), and a second circuit board 363 which is positioned such that its major surfaces are substantially perpendicular to those of the first circuit board 361. A portion 364 of the second circuit board 363 extends through a notch in the first circuit board 361. Contacts on the portion 364 of the second circuit board 363 are soldered (i.e., with solder 366) to contacts on the first circuit board 361.

FIG. 37 is a perspective cross-sectional view of a portion of a light engine module 370 that is similar to the light engine module 360 shown in FIG. 36, except that contacts on the portion 364 of the second circuit board 363 are electrically connected to contacts on the first circuit board 361 with conductive clips 371 (only one is shown) instead of solder.

FIG. 38 is a perspective cross-sectional view of a portion of a light engine module 380 that is similar to the light engine module 360 shown in FIG. 36, except that contacts on the portion 364 of the second circuit board 363 are electrically connected to contacts on the first circuit board 361 with wire bonds 381 (only one is shown) instead of solder.

FIG. 39 is a sectional view of a lighting device 390 that comprises a light engine module 391, a housing member 392, a lens 393 (in the form of a diffuser) and an electrical connector 394. The lighting device 390 has a form factor corresponding to an A lamp.

FIG. 40 is a sectional view of a lighting device 400 that comprises a light engine module 401, a housing member 402, a reflector 403 (which can be a diffuse reflector or a specular reflector) and an electrical connector 404. The lighting device 400 has a form factor corresponding to a PAR lamp or a BR lamp.

FIG. 41 is a sectional view of a lighting device 410 that comprises a light engine module 411, a housing member 412, a lens 413 (in the form of a diffuser) and an electrical connector 414.

FIG. 42 is a sectional view of a lighting device 420 that comprises first and second light engine modules 421, first and second housing members 422, a lens 423 (in the form of a diffuser) and a pair of electrical connectors 424. The lighting device 420 has a form factor corresponding to a fluorescent tube. Alternatively, the lighting device can have any other suitable form factor, e.g., it can be toroidal (e.g., doughnut-shaped), with radial projections in which light engine modules can be positioned.

FIG. 43 is a sectional view of a lighting device 430 that comprises a light engine module 431, a housing member 432, a first reflector 433 (which can be a diffuse reflector or a specular reflector), a second reflector 434 (which can be a diffuse reflector or a specular reflector) and an electrical connector 435. The lighting device 430 has a form factor corresponding to an AR lamp or an MR lamp.

Light engine modules according to the present inventive subject matter can be of any suitable shape, e.g., having a circular cross-section of uniform size (i.e., cylindrical), having circular cross-section that varies in size (i.e., conical or frustoconical) having a square cross-section, having a rectangular cross-section, having an oval cross-section, etc, or combinations thereof, or having different cross-sectional shapes and/or sizes in different regions, or not being of any regular shape. For example, FIG. 44 is a front view of a light engine module 440 that comprises a solid state light emitter support member and a plurality of solid state light emitters 441, the solid state light emitter support member comprising a first circuit board 442 (on which the solid state light emitters 441 are mounted), a first support structure 443 (to which the first circuit board 442 is attached) and a second support structure 444 (to which the first support structure is attached and which can be attached to a lighting device element). The light engine module 440 may further comprise a second circuit board (on which at least one compensation circuit is mounted) positioned inside a cavity defined by the first support structure 443 and/or the second support structure 444.

FIG. 45 is a front view of a light engine module 450 that comprises a solid state light emitter support member and a plurality of solid state light emitters 451, the solid state light emitter support member comprising a first circuit board 452 (on which the solid state light emitters 451 are mounted), a first support structure 453 (to which the first circuit board 452 is attached) and a second support structure 454 (to which the first support structure is attached and which can be attached to a lighting device element). The light engine module 450 may further comprise a second circuit board (on which at least one compensation circuit is mounted) positioned inside a cavity defined by the first support structure 453 and/or the second support structure 454.

FIG. 46 is a front view of a light engine module 460 that comprises a solid state light emitter support member and a plurality of solid state light emitters 461, the solid state light emitter support member comprising a first circuit board 462 (on which the solid state light emitters 461 are mounted), a first support structure 463 (to which the first circuit board 462 is attached) and a second support structure 464 (to which the first support structure is attached and which can be attached to a lighting device element). The light engine module 460 may further comprise a second circuit board (on which at least one compensation circuit is mounted) positioned inside a cavity defined by the first support structure 463 and/or the second support structure 464.

FIG. 47 is a front view of a light engine module 470 that comprises a solid state light emitter support member and a plurality of solid state light emitters 471, the solid state light emitter support member comprising a first circuit board 472 (on which the solid state light emitters 471 are mounted), a first support structure 473 (to which the first circuit board 472 is attached) and a second support structure 474 (to which the first support structure is attached and which can be attached to a lighting device element). The light engine module 470 may further comprise a second circuit board (on which at least one compensation circuit is mounted) positioned inside a cavity defined by the first support structure 473 and/or the second support structure 474.

FIG. 48 is a front view of a light engine module 480 that comprises a solid state light emitter support member and a plurality of solid state light emitters 481, the solid state light emitter support member comprising a first circuit board 482

(on which the solid state light emitters 481 are mounted), a first support structure 483 (to which the first circuit board 482 is attached and which can be attached to a lighting device element). The light engine module 480 may further comprise a second circuit board (on which at least one compensation circuit is mounted) positioned inside a cavity defined by the first support structure 483.

FIG. 49 is a front view of a light engine module 490 that comprises a solid state light emitter support member and a plurality of solid state light emitters 491, the solid state light emitter support member comprising a first circuit board 492 (on which the solid state light emitters 491 are mounted), a first support structure 493 (to which the first circuit board 492 is attached and which can be attached to a lighting device element). The light engine module 490 may further comprise a second circuit board (on which at least one compensation circuit is mounted) positioned inside a cavity defined by the first support structure 493.

FIG. 50 is a front view of a light engine module 500 that comprises a solid state light emitter support member and a plurality of solid state light emitters 501, the solid state light emitter support member comprising a first circuit board 502 (on which the solid state light emitters 501 are mounted), a first support structure 503 (to which the first circuit board 502 is attached and which can be attached to a lighting device element). The light engine module 500 may further comprise a second circuit board (on which at least one compensation circuit is mounted) positioned inside a cavity defined by the first support structure 503.

FIG. 51 is a front view of a light engine module 510 that comprises a solid state light emitter support member and a plurality of solid state light emitters 511, the solid state light emitter support member comprising a first circuit board 512 (on which the solid state light emitters 511 are mounted), a first support structure 513 (to which the first circuit board 512 is attached and which can be attached to a lighting device element). The light engine module 510 may further comprise a second circuit board (on which at least one compensation circuit is mounted) positioned inside a cavity defined by the first support structure 513.

FIG. 52 is a front view of a light engine module 520 that comprises a solid state light emitter support member and a plurality of solid state light emitters 521, the solid state light emitter support member comprising a first circuit board 522 (on which the solid state light emitters 521 are mounted), a first support structure 523 (to which the first circuit board 522 is attached and which can be attached to a lighting device element). The light engine module 520 may further comprise a second circuit board (on which at least one compensation circuit is mounted) positioned inside a cavity defined by the first support structure 523.

FIG. 53 is a front view of a light engine module 530 that comprises a solid state light emitter support member and a plurality of solid state light emitters 531, the solid state light emitter support member comprising a first circuit board 532 (on which the solid state light emitters 531 are mounted), a first support structure 533 (to which the first circuit board 532 is attached and which can be attached to a lighting device element). The light engine module 530 may further comprise a second circuit board (on which at least one compensation circuit is mounted) positioned inside a cavity defined by the first support structure 533.

FIG. 54 is a front view of a light engine module 540 that comprises a solid state light emitter support member and a plurality of solid state light emitters 541, the solid state light emitter support member comprising a first circuit board 542 (on which the solid state light emitters 541 are mounted), a first support structure 543 (to which the first circuit board 542 is attached and which can be attached to a lighting device element). The light engine module 540 may further comprise a second circuit board (on which at least one compensation circuit is mounted) positioned inside a cavity defined by the first support structure 543.

FIG. 59 is a perspective view of a first support structure 591, and FIG. 60 is a sectional view of a light engine module 600 that comprises the first support structure 591, a first circuit board 601 which is attached to the first support structure 591 and a second circuit board 602 also attached to the first support structure 591.

FIG. 61 is a perspective view of a first support structure 611, and FIG. 62 is a sectional view of a light engine module 620 that comprises the first support structure 611, a first circuit board 621 which is attached to the first support structure 611 and a second circuit board 622 also attached to the first support structure 611.

FIG. 63 is a perspective view of a first support structure 631, and FIG. 64 is a sectional view of the first support structure 631.

FIG. 65 is a sectional view of a first support structure 651, and FIG. 66 is a perspective view of the first support structure 651.

FIG. 67 is a sectional view depicting a light engine module 670 that comprises a first circuit board 671 (attached to a first support structure 672), a second circuit board 673 (also attached to the first support structure 672) and a lens 675 (the lens 675 having optical characteristics). The circumferential side 674 of the light engine module 670 is substantially smooth. A plurality of solid state light emitters 676 are mounted on the first circuit board 671.

FIG. 68 is a sectional view depicting a light engine module 680 that comprises a first circuit board 681 (which is attached to a first support structure 682), a second circuit board 683 (also attached to the first support structure 682) and a lens 685 (the lens 685 having optical characteristics). A plurality of solid state light emitters 686 are mounted on the first circuit board 681.

FIG. 69 is a top view of the light engine module 680, showing that the light engine module 680 is in the shape of a frustopyramid with three side surfaces, a bottom surface and a top (domed) surface.

FIG. 70 is a sectional view depicting a light engine module 700 that comprises a first circuit board 701 (attached to a first support structure 702). A plurality of solid state light emitters 706 are mounted on the first circuit board 701.

FIG. 71 is a sectional view depicting a light engine module 710 that comprises a first circuit board 711 (which is attached to a first support structure 712), a second circuit board 713 (also attached to the first support structure 712), and a lens 715. The circumferential side 714 of the light engine module 710 is ridged. A plurality of solid state light emitters 716 are mounted on the first circuit board 711.

FIG. 72 is a sectional view depicting a light engine module 720 that comprises a first circuit board 721 (which is attached to a first support structure 722) and a second circuit board 723 (also attached to the first support structure 722). A plurality of solid state light emitters 726 are mounted on the first circuit board 721.

FIG. 73 is a sectional view depicting a light engine module 730 that comprises a first circuit board 731 (which is attached to a first support structure 732) a second circuit board 733 (also attached to the first support structure 732), and a second support structure 734 to which the first support structure 732 is removably attached with screw threading. The first support structure 732 comprises a reflective region 735.

Any of the light engine modules depicted in FIGS. 44-54 (and likewise for any other device described herein) can comprise one or more heat dissipating elements (e.g., one or more heat dissipating fins and/or one or more heat dissipation pins, one or more electrical connectors, one or more structures for mechanically connecting to a lighting device element (e.g., a housing member), one or more compensation circuit devices or components, one or more power supply devices or components, structures for aligning the light engine module with a lighting device element (e.g., a housing member) or for assisting in such alignment, one or more structures for facilitating mounting the light engine module to a particular form factor lighting device element or for electrically and/or mechanically connecting to a particular power supply. For example, FIG. 75 depicts a portion of a light engine module 750 that is similar to the light engine module 240 shown in FIG. 24, except that the light engine module 750 further comprises heat dissipation fins 751 (only one is visible in FIG. 75) and heat dissipation pins 752. For another example, FIG. 76 depicts a portion of a light engine module 760 that is similar to the light engine module 240 shown in FIG. 24, except that the light engine module 760 further comprises heat dissipation fins 761 (only one is visible in FIG. 76) and heat dissipation pins 762, and the light engine module 760 is positioned within a lighting device element that comprises a housing member 763 and a lens 764.

FIG. 55 is a front view of a light engine module 550 that comprises a solid state light emitter support member and a plurality of solid state light emitters 551, the solid state light emitter support member comprising a first circuit board 552 (on which the solid state light emitters 551 are mounted), a first support structure 553 (to which the first circuit board 552 is attached and which can be attached to a lighting device element). The light engine module 550 may further comprise a second circuit board (on which at least one compensation circuit is mounted) positioned inside a cavity defined by the first support structure 553. The light engine module 550 further comprises a plurality of alignment slots 554 and a pair of electrical contact elements 555.

FIG. 56 is a cross-sectional view of the light engine module 550 mounted in a lighting device element that comprises a housing member 561 and a lens 562 (only respective portions of the housing member 561 and the lens 562 are shown in FIG. 56). The housing member 561 comprises electrical contact elements 563 which are in electrical contact with respective electrical contact elements 555 on the light engine module 550. The housing member 561 also comprises a plurality of alignment fins 564 which fit in respective alignment slots 554 on the first support structure 553.

FIG. 57 is a top view of the light engine module 550 mounted in the housing member 561, showing the alignment fins 564 on the housing member 561 located within the respective alignment slots 554 on the first support structure 553.

FIG. 58 is a cross-sectional view of a light engine module 580 mounted in a lighting device element that comprises a housing member 581 and a lens 582 (only respective portions of the housing member 581 and the lens 582 are shown in FIG. 58). The housing member 581 comprises electrical contact elements 585 which are in electrical contact with respective electrical contact elements 583 on the light engine module 580. The light engine module 580 also comprises a plurality of alignment fins 587 which fit in respective alignment slots 584 (with respective ledges 586) in the housing member 581.

FIG. 74 is a sectional view of a lighting device 740 that comprises a first circuit board 741 on which a plurality of solid state light emitters 742 are mounted, a second circuit board 743 on which circuitry (including a compensation circuit) is mounted, a first support structure 744 (to which the first circuit board 741 and the second circuit board 743 are attached (permanently or removably) on opposite sides, a second support structure 745 (to which the first support structure 744 is removably attached with screw threading, the second structure 745 comprising an electrical connector (in the form of Edison screw threads), a lens 746 (e.g., in the form of a diffuser) and a power supply module in the form of a third circuit board 747 with power supply components mounted thereon.

FIG. 77 is a sectional view of a lighting device 770 that comprises a first circuit board 771 on which a plurality of solid state light emitters 772 are mounted, a second circuit board 773 on which circuitry (including a compensation circuit) is mounted, a first support structure 774 (to which the first circuit board 771 and the second circuit board 773 are attached (permanently or removably) on opposite sides, a second support structure 775 (to which the first support structure 774 is removably attached with screw threading, the second structure 775 comprising an electrical connector (in the form of Edison screw threads), a lens 776 (e.g., in the form of a diffuser) and a power supply module in the form of a third circuit board 777 with power supply components mounted thereon.

FIG. 78 is a sectional view of a portion of a light engine module 780 that comprises a first circuit board 781 on which a plurality of solid state light emitters 782 (only one is depicted in FIG. 78) are mounted, a first support structure 783 (to which the first circuit board 781 is attached permanently or removably), an electrical conductor 784 (in the form of a pin) and an insulation element 785. The first circuit board 781 is a metal core circuit board that comprises a conductive layer 786 (e.g., of aluminum), thin layers 787 of dielectric material positioned on the major surfaces of the conductive layer 786, conductive tracks 789 (e.g., of copper) formed on one or both exposed major surfaces of the layers 787, and a conductive pad 788. The electrical conductor 784 provides electrical connection between the conductive pad 788 and another circuitry component, e.g., a component on a second circuit board (that includes, e.g., compensation circuitry). The first support structure 783 can be made of a material (or materials) that provide high thermal conductivity (e.g., a metal such as aluminum or copper) in order to assist in dissipating heat generated by the solid state light emitters 782. As shown in FIG. 78, a region 790 of the first support structure 783 is indented, and the insulation element 785 fills at least a portion of the indented region 790. As also shown in FIG. 78, the insulation element 785 has an indented region 791 into which the first circuit board 781 extends. In such a way, the creepage distance between the electrical conductor 784 and the conductive layer 786 of the first circuit board 781 is increased (compared to if the first circuit board 781 did not extend into the indented region in the insulation element 785), the creepage distance between the electrical conductor 784 and the first support structure 783 (which can be made of an electrically conductive material) is increased (compared to if the first circuit board 781 did not extend into the indented region in the insulation element 785 and if the insulation element 785 did not extend into the indented region 790 in the first circuit board 781)

and the creepage distance between conductive layer 786 of the first circuit board 781 and the first support structure 783 is increased (compared to if the first circuit board 781 did not extend into the indented region 791 in the insulation element 785 and if the insulation element 785 did not extend into the indented region 790 in the first circuit board 781). As a result of all of these creepage distances increasing, higher voltages can be used without significant risk of undesired arcing or other conductivity between spaced electrically conductive components.

The light engine module 780 can be attached to one or more lighting device elements (e.g., a housing member, a lens and/or an electrical connector) in any suitable way, e.g., any of the ways of attaching a light engine module to a lighting device element as described herein.

While only a single an electrical conductor 784 and insulation element 785 combination is shown in FIG. 78, any suitable number of such combinations can be included, e.g., four of such structures could be positioned substantially evenly around the horizontal (in the orientation shown in FIG. 78) perimeter (which can be substantially circular or any other regular or irregular shape) of the light engine module.

In some embodiments, any space between the first circuit board 781 and the first support structure 783 can be filled with a suitable material (or materials), e.g., a material that is electrically insulating and thermally highly conductive, e.g., epoxy, a graphite sheet, mica, thermal grease, a silicon sheet with heat conducting powder such as alumina, aluminum nitride, silicon carbide, silver or graphite.

FIG. 79 is a sectional view of a portion of a light engine module 792 that comprises a first circuit board 781 on which a plurality of solid state light emitters 782 (only one is depicted in FIG. 78) are mounted, a second circuit board 793 (e.g., a fiberglass circuit board, such as FR4) on which a plurality of components 796 are mounted (e.g., compensation circuitry), a first support structure 783 (to which the first circuit board 781 is attached permanently or removably), an electrical conductor 784 and an insulation element 785. The first circuit board 781 is a metal core circuit board that comprises a conductive layer 786 (e.g., of aluminum), thin layers 787 of dielectric material positioned on the major surfaces of the conductive layer 786, conductive tracks 789 (e.g., of copper) formed on one or both exposed major surfaces of the layers 787, and a conductive pad 788. The electrical conductor 784 provides electrical connection between the conductive pad 788 and the second circuit board 793. In this embodiment, a surface mount thermistor 795 is mounted on the side of the second circuit board 793 that is facing the first support structure 783, and a compressible thermal gap pad 797 that is electrically insulating and thermally conductive (e.g., formed of silicone impregnated with a thermally conductive and electrically insulating material, e.g., alumina, aluminum nitride, silicon carbide, silver or graphite) is between the thermistor 795 and the first support structure 783. The thermal gap pad 797 can be omitted, if desired, e.g., if some other way to prevent damage to the thermistor 795 is provided. The remainder of the space between the second circuit board 793 and the first support structure 783 can be empty (e.g., filled with air), or any other suitable material (or materials) can be positioned there, e.g., a dielectric sheet (e.g., of Mylar® or Formex®) can be positioned therein, e.g., by providing a sheet, cutting a hole in the sheet to accommodate the thermistor 795 and positioning the sheet between the second circuit board 793 and the first support structure 783. As shown in FIG. 79, the insulation element 785 in this embodiment includes portions 798 that extend between the first support structure 783 and the second circuit board 793.

The light engine module 792 can be attached to one or more lighting device elements (e.g., a housing member, a lens and/or an electrical connector) in any suitable way, e.g., any of the ways of attaching a light engine module to a lighting device element as described herein.

FIG. 80 is an exploded perspective view of a portion of a light engine module 800 that comprises a first circuit board 801 on which a plurality of solid state light emitters 802 are mounted, a second circuit board 803 on which a compensation circuit is mounted, a first support structure 804 (to which the first circuit board 801 and the second circuit board 803 are attached permanently or removably), and four electrical connection structures 805 that provide electrical connection between the first circuit board 801 and the second circuit board 803. As can be seen in FIG. 80, the first circuit board 801, the first support structure 804 and the second circuit board 803 each have recessed regions 806 in which corresponding portions of the electrical connection structures 805 fit. As seen in FIG. 80, the first circuit board 801, the first support structure 804 and the second circuit board 803 each have approximately the same diameter.

FIG. 81 is a sectional view of the light engine module 800 shown in FIG. 80. As shown in FIG. 81, each of the electrical connection structures 805 includes an electrical conductor 809 and an insulation element 810. As also shown in FIG. 81, the recessed regions 806 in the first support structure 804 include indented regions 807, into which corresponding extended regions 808 of the insulation 810 in the electrical connection structures 805 extend. FIG. 81 also shows a header 811 mounted on the second circuit board 803 that can be readily connected to a power supply or a power source.

The light engine module 800 can be attached to one or more lighting device elements (e.g., a housing member, a lens and/or an electrical connector) in any suitable way, e.g., any of the ways of attaching a light engine module to a lighting device element as described herein.

FIG. 82 is an exploded perspective view of a portion of a light engine module 820 that comprises a first circuit board 821 on which a plurality of solid state light emitters 822 are mounted, a second circuit board 823 on which a compensation circuit is mounted, a first support structure 824 (to which the first circuit board 821 and the second circuit board 823 are attached permanently or removably), and four electrical connection structures 825 that provide electrical connection between the first circuit board 821 and the second circuit board 823. As can be seen in FIG. 82, the first circuit board 821, the first support structure 824 and the second circuit board 823 each have recessed regions 826 in which corresponding portions of the electrical connection structures 825 fit. As seen in FIG. 82, the first circuit board 821 and the second circuit board 803 each have approximately similar diameters, while the first support structure 824 has a slightly larger diameter.

FIG. 83 is a sectional view of the light engine module 820 shown in FIG. 82. As shown in FIG. 83, each of the electrical connection structures 825 includes an electrical conductor 829 and an insulation element 830. As also shown in FIG. 83, the recessed regions 826 in the first support structure 824 include indented regions 827, into which corresponding extended regions 828 of the insulation 830 in the electrical connection structures 825 extend.

The light engine module 820 can be attached to one or more lighting device elements (e.g., a housing member, a lens and/or an electrical connector) in any suitable way, e.g., any of the ways of attaching a light engine module to a lighting device element as described herein.

FIGS. 84 and 85 are perspective views of a light engine module 840 that comprises a first support member 841 having a plurality of solid state light emitters 842 mounted on one side, and a plurality of circuitry components 843 (e.g., including compensation circuitry and a header 844) on the other side. The first support member 841 can be any suitable structure, e.g., a circuit board, such as a metal core circuit board.

FIG. 86 is a sectional view of the light engine module 840. As shown in FIG. 86, the light engine module 840 comprises plural electrical connection structures, each including an electrical conductor 845 and an insulation element 846.

The light engine module 840 can be attached to one or more lighting device elements (e.g., a housing member, a lens and/or an electrical connector) in any suitable way, e.g., any of the ways of attaching a light engine module to a lighting device element as described herein.

FIG. 87 is a conceptual view of a light engine module 870 that includes a first support structure 871 (and which can optionally also include a first circuit board, on which a plurality of solid state light emitters is mounted, and/or a second circuit board, on which one or more circuitry components can be mounted) and heat sink fins 872 attached to the first support structure 871. Instead of or in addition to the heat sink fins 872 can be provided any suitable kind of heat sink and/or heat dissipation element.

The light engine module 870 can be attached to one or more lighting device elements (e.g., a housing member, a lens and/or an electrical connector) in any suitable way, e.g., any of the ways of attaching a light engine module to a lighting device element as described herein.

FIG. 88 is a perspective view of an electrical connection structure 880 that can be used in the light engine modules according to the present inventive subject matter. Referring to FIG. 88, the electrical connection structure 880 comprises an electrical conductor 881 and an insulation element 882 that includes protruding regions 883 for fitting into corresponding indented regions.

As noted above, as appropriate, any light engine module described herein can be attached to one or more lighting device elements (e.g., a housing member, a lens and/or an electrical connector) in any suitable way, e.g., any of the ways of attaching a light engine module to a lighting device element as described herein.

For instance, in the case of the embodiment depicted in FIGS. 80 and 81, the diameter of the first support structure can be smaller than the diameters of the first and second circuit boards, and during assembly, the light engine module can be positioned within a lighting device element by the respective diameters of the first support structure, the first circuit board and/or the second circuit board being accommodated in the lighting device element only if the light engine module is properly positioned relative to the lighting device element.

In some embodiments that include recessed regions (e.g., those depicted in FIGS. 80-83), the recessed regions can be of any desired size, e.g., large enough to accommodate electrical connection structures, so that the light engine module can fit within a tubular structure defining a cylindrical (or frustoconical, or any other shaped) space and having an internal diameter just slightly larger than the diameter of the support member and/or circuit boards (or within a space of any cross-sectional shape that may or may not taper or have ledges, etc.). Included among such embodiments are some embodiments in which the surface area of contact between a peripheral edge of a support structure and a tubular structure in which a light engine module (that comprises the support structure) is positioned is increased or maximized.

In some embodiments, there can be provided a light engine module that comprises a first support structure, a first circuit board and a second circuit board, in which the first support structure has a diameter (or, in cases where the first support structure is not round, at least one dimension) that is larger than the diameter of the first circuit board, so that the light engine module can be positioned within a lighting device element that has one or more ledge region, on which the first support structure can be supported.

In some embodiments, a light engine module (e.g., one as depicted in any of FIGS. 80-83) can be positioned within a lighting device element 890 as shown in FIG. 89 (which is a sectional front view of the lighting device element 890), in which a portion of the light engine module (e.g., a portion of a support element that extends farther than first and second circuit boards positioned on opposite sides of the support element) is supported on the ledge 891.

In some embodiments, a light engine module (e.g., one as depicted in any of FIGS. 80-83) can be positioned within a lighting device element 990 as shown in FIG. 90 (which is a sectional top view of the lighting device element 990), in which the electrical connection structures (e.g., the structures 805 in the light engine module shown in FIG. 80) are received in respective notches in the lighting device element 990, whereby a light engine module can be accurately positioned (during assembly) and securely held within the lighting device element 990.

FIG. 91 is a sectional view of a light engine element comprising a light engine module 901 and an interface element 902 connected to the light engine module. The interface element 902 comprises heat dissipation fins 903 that extend downwardly and to the sides (in the orientation depicted in FIG. 91).

FIG. 92 is a sectional view of a light engine element comprising a light engine module 901 and an interface element 904 connected to the light engine module. The interface element 904 comprises heat dissipation fins 905 that extend to the sides (in the orientation depicted in FIG. 92).

FIG. 93 is a sectional view of a light engine element comprising a light engine module 901 and an interface element 906 connected to the light engine module. The interface element 906 comprises heat dissipation fins 907 that extend downwardly (in the orientation depicted in FIG. 93).

FIG. 94 is a sectional view of a light engine element comprising a light engine module 901 and an interface element 908 connected to the light engine module. The interface element 908 comprises heat dissipation fins 909 that extend upwardly (in the orientation depicted in FIG. 94).

FIG. 95 is a sectional view of a light engine element comprising a light engine module 910 and an interface element 911 connected to the light engine module. An optional compressible thermal element 912 is compressed between the light engine module 910 and the interface element 911 to assist in providing heat conduction. The interface element 911 comprises mating surfaces 913 and interface surfaces 914.

FIG. 96 is a sectional view of a light engine element comprising a "standard" light engine module 915 and an interface element 916 connected to the light engine module.

The interface element 916 comprises attachment notches 917 and a tapered surface 918 (for engaging a lighting device element).

FIG. 97 is a sectional view of a light engine element comprising a light engine module 901 and an interface element 919 connected to the light engine module. The interface element 919 comprises inside threading 920 (or, alternatively, notches) for engaging a lighting device element.

FIG. 98 is a sectional view of a light engine element comprising a light engine module 901 and an interface element 921 connected to the light engine module. The interface element 921 comprises coarse pitch threads 923 for engaging a lighting device element. FIG. 99 is a front view of the light engine element shown in FIG. 98.

FIG. 100 is a sectional view of a light engine element comprising a light engine module 901 and an interface element 924 connected to the light engine module. The interface element 924 comprises notches 925 for engaging a lighting device element. FIG. 101 is a front view of the light engine element shown in FIG. 100.

FIG. 102 is a sectional view of a light engine element comprising a light engine module 901 and an interface element 926 connected to the light engine module. The interface element 926 comprises screw holes 927 through which screws (not shown) can be threaded to engage with a lighting device element.

FIG. 103 is a sectional view of a light engine element comprising a light engine module 901 and an interface element 928 connected to the light engine module. The interface element 928 comprises screw holes 929 through which screws (not shown) can be threaded to engage with a lighting device element.

FIG. 104 is a sectional view of a light engine element comprising a light engine module 901 and an interface element 930 connected to the light engine module. The interface element 930 comprises a heat pipe 931 (partially shown in FIG. 104) through which heat from the light engine module can be conducted.

FIG. 105 is a sectional view of a lighting device comprising a light engine module 901, an interface element 932 connected to the light engine module, a lighting device element 933 to which the interface element 932 is connected, and an electrical connector 939. The lighting device element 933 comprises a lens 934, a housing 935 and heat dissipation fins 936.

FIG. 106 is a sectional view of a lighting device comprising a light engine module 901, an interface element 937 connected to the light engine module, a lighting device element 938 to which the interface element 932 is connected, and an electrical connector 940. The lighting device element 938 comprises a reflector 941, a housing 942 and heat dissipation fins 943.

FIG. 107 is a sectional view of a light engine element comprising a plurality of light engine modules 901 and an interface element 944 connected to the light engine module. The interface element 944 comprises screw holes 946 through which screws can be threaded to connect the interface element 944 to a heat dissipation element 947 that comprises a plurality of heat dissipation pins 945.

FIG. 108 is a sectional view of a lighting device comprising a light engine module 901, an interface element 948 connected to the light engine module 901, a housing member 949 to which the interface element 948 is connected and an electrical connector 988. The light engine module 901 is press-fitted in a recess 950 in the interface element 948 (alternatively, the light engine module 901 can be connected to the interface element 948 in any other suitable way, including any of the ways of attaching elements as discussed herein, e.g., by providing screw-threading on the light engine module 901 that is engageable with screw-threading on the interface element 948). The interface element 948 has screw-threading 951 that is threadable in screw-threading 952 on the housing member 949 (alternatively, the interface element 948 can be connected to the housing member 949 in any other suitable way, including any of the ways of attaching elements as discussed herein). The electrical connector 988 comprises Edison screw threads which are receivable in an Edison socket. The interface element 948 can comprise one or more regions of high heat conductivity (e.g., a thermal contact), one or more electrically conducting regions (e.g., an electrical contact), one or more transparent, translucent or optically transmissive regions, and/or one or more mechanical contacts.

In the embodiment depicted in FIG. 108, the interface element 948 is shown as being connected to the light engine module 901 and connected to the housing member 949. Alternatively, the interface element 948 can further comprise the light engine module 901 (see FIG. 109) (i.e., the interface element 948 and the light engine module 901 can be integral), or the light engine module can extend farther (to any degree) from the array of solid state light emitters (e.g., as shown in FIG. 110). As another alternative, the light engine module can be connected to a light engine module housing member, whereby a lighting device can comprise a light engine module, a light engine module housing member, an interface element and a housing member (e.g., as in the embodiment depicted in FIG. 121). In addition, any element or structure in the lighting devices (or other components) described herein can be a single unitary structure, or can comprise two or more structures that can be connected permanently or removably (e.g., they can be screw-threaded to one another, etc.).

FIG. 109 is a sectional view of a lighting device comprising a light engine module 953 that comprises an array of solid state light emitters and an interface element (i.e., the array and the interface element are integral), a housing member 956 to which the light engine module/interface element 953 is connected, and an electrical connector 957. The light engine module/interface element 953 has screw-threading 954 that is threadable in screw-threading 955 on the housing member 956 (alternatively, the light engine module/interface element 953 can be connected to the housing member 956 in any other suitable way, including any of the ways of attaching elements as discussed herein). The electrical connector 957 comprises Edison screw threads which are receivable in an Edison socket. The light engine module/interface element 953 can comprise one or more regions of high heat conductivity (e.g., a thermal contact), one or more electrically conducting regions (e.g., an electrical contact), one or more transparent, translucent or optically transmissive regions, and/or one or more mechanical contacts.

FIG. 110 is a sectional view of a lighting device comprising a light engine module 958, an interface element 959 connected to the light engine module 958, a housing member 960 to which the interface element 959 is connected, and an electrical connector 965. The light engine module 958 has screw-threading 961 that is threadable in screw-threading 962 on the housing member 959 (alternatively, the light engine module 958 can be connected to the interface element 959 in any other suitable way, including any of the ways of attaching elements as discussed herein). The interface element 959 has screw-threading 963 that is threadable in screw-threading 964 on the housing member 960 (alternatively, the interface element 959 can be connected to the housing member 960 in any other suitable way, including any of the ways of attaching elements as discussed herein). The electrical connector 965 comprises Edison screw threads which are receivable in an Edison socket. The interface element 959 can comprise one or more regions of high heat conductivity (e.g., a thermal contact), one or more electrically conducting regions (e.g., an electrical contact), one or more transparent, translucent or optically transmissive regions, and/or one or more mechanical contacts.

FIG. 111 is a sectional view of a lighting device comprising a light engine module 901, an interface element 966 connected to the light engine module 901, a housing member 967 to which the interface element 966 is connected, a lens 972, and an electrical connector 971. The light engine module 901 is press-fitted in a recess 968 in the interface element 966 (alternatively, the light engine module 901 can be connected to the interface element 966 in any other suitable way, including any of the ways of attaching elements as discussed herein). The interface element 966 has a circumferential groove 969 into which an inner circumferential ridge 970 on the housing member 967 is receivable (alternatively, instead of the circumferential ridge 970, there can be provided a discontinuous circumferential ridge and/or a series of bumps that are receivable in the groove 969). Alternatively, the interface element 966 can be connected to the housing member 967 in any other suitable way, including any of the ways of attaching elements as discussed herein. To connect the interface element 966 to the housing member 967, the interface element 966 can be positioned within the upper portion of the housing member 967 (e.g., prior to the lens 972 having been connected to the housing member 967) and pushed downward (in the orientation depicted in FIG. 111) until the ridge 970 is received in the groove 969 (this can provide a permanent attachment, or the interface element 966 can be removable by pulling the interface element 966 upward (in the orientation depicted in FIG. 111) relative to the housing member 967). The electrical connector 971 comprises Edison screw threads which are receivable in an Edison socket. The interface element 966 can comprise one or more regions of high heat conductivity (e.g., a thermal contact), one or more electrically conducting regions (e.g., an electrical contact), one or more transparent, translucent or optically transmissive regions, and/or one or more mechanical contacts. As with other embodiments, the interface element 966 can further comprise the light engine module 901 (e.g., analogous to the embodiment depicted in FIG. 109, relative to the embodiment depicted in FIG. 108), and/or the light engine module can extend farther (to any degree) from the array of solid state light emitters (e.g., analogous to the embodiment depicted in FIG. 110, relative to the embodiment depicted in FIG. 108). Alternatively, the ridge can be provided on the interface element 966 and the groove can be provided on the housing member 967, or any suitable combination of placement of ridge regions and groove regions can be provided.

FIG. 112 is a sectional view of a lighting device comprising a light engine module 901, an interface element 973 connected to the light engine module 901, a housing member 974 to which the interface element 973 is connected, a lens 975 and an electrical connector 978. The light engine module 901 is glued to a surface of the interface element 973 (alternatively, the light engine module 901 can be connected to the interface element 973 in any other suitable way, including any of the ways of attaching elements as discussed herein).

The interface element 973 has a circumferential groove 976 into which an inner circumferential ridge 977 on the housing member 974 is receivable (alternatively, instead of the circumferential ridge 977, there can be provided a discontinuous circumferential ridge and/or a series of bumps that are receivable in the groove 976). Alternatively, the interface element 973 can be connected to the housing member 974 in any other suitable way, including any of the ways of attaching elements as discussed herein. To connect the interface element 973 to the housing member 974, the interface element 973 can be positioned within the upper part of the housing member 974 (e.g., prior to the lens 975 having been connected to the housing member 974) and pushed downward (in the orientation depicted in FIG. 112) until the ridge 977 is received in the groove 976 (this can provide a permanent attachment, or the interface element 973 can be removable by pulling the interface element 973 upward (in the orientation depicted in FIG. 112) relative to the housing member 974). The electrical connector 978 comprises Edison screw threads which are receivable in an Edison socket. The interface element 973 comprises a pair of electrically conducting regions 979. Alternatively or additionally, the interface element 973 can comprise one or more regions of high heat conductivity (e.g., a thermal contact), one or more additional electrically conducting regions (e.g., an electrical contact), one or more transparent, translucent or optically transmissive regions, and/or one or more mechanical contacts. As with other embodiments, the interface element 973 can further comprise the light engine module 901 (e.g., analogous to the embodiment depicted in FIG. 109, relative to the embodiment depicted in FIG. 108), and/or the light engine module can extend farther (to any degree) from the array of solid state light emitters (e.g., analogous to the embodiment depicted in FIG. 110, relative to the embodiment depicted in FIG. 108). Alternatively, the ridge can be provided on the interface element 973 and the groove can be provided on the housing member 974, or any suitable combination of placement of ridge regions and groove regions can be provided.

FIG. 113 is a sectional view of a lighting device comprising a light engine module 901, an interface element 980 connected to the light engine module 901, a housing member 981 to which the interface element 980 is connected, a lens 982, an electrical connector 987, and a spring element 986 (instead of or in addition to the spring element, any biasing device tending to move the interface element 980 upward (in the orientation shown in FIG. 113) relative to the housing member 981 can be employed). The light engine module 901 is press-fitted in a recess 983 in the interface element 980 (alternatively, the light engine module 901 can be connected to the interface element 980 in any other suitable way, including any of the ways of attaching elements as discussed herein). The interface element 980 has a circumferential ledge 984, which an inner circumferential latch 985 on the housing member 981 abuts as a result of the spring element 986 biasing the interface element 980 upward (alternatively, instead of the circumferential ledge 984, there can be provided a discontinuous circumferential ledge and/or a discontinuous circumferential latch, e.g., two or more ledges that extend only partially around the circumference of the interface element 980, and a discontinuous latch, whereby the interface element 980 can be positioned in the upper part of the housing member 981 (e.g., prior to the lens 982 having been connected to the housing member 981) and lowered (in the orientation depicted in FIG. 113) into the housing member 981 with the discontinuous ledge fitting through gaps in the discontinuous latch, and the interface element 980 can be further pushed downward against the bias of the spring element 986 so that the regions of the discontinuous ledge are below the discontinuous latch, and then the interface element 980 can be rotated about its axis to an orientation where the regions of the discontinuous ledge are directly beneath the regions of the discontinuous latch, whereby the interface element 980 can be readily disconnected from the housing member 981). Alternatively, the interface element 980 can be connected to the housing member 981 in any other suitable way, including any of the ways of attaching elements as discussed herein. The electrical connector 987 comprises Edison screw threads which are receivable in an Edison socket. The interface element 980 can comprise one or more regions of high heat conductivity (e.g., a thermal contact), one or more electrically conducting regions (e.g., an electrical contact), one or more transparent, translucent or optically transmissive regions, and/or one or more mechanical contacts. As with other embodiments, the interface element 980 can further comprise the light engine module 901 (e.g., analogous to the embodiment depicted in FIG. 109, relative to the embodiment depicted in FIG. 108), and/or the light engine module can extend farther (to any degree) from the array of solid state light emitters (e.g., analogous to the embodiment depicted in FIG. 110, relative to the embodiment depicted in FIG. 108).

FIG. 114 is a sectional view of a lighting device comprising a light engine module 901, an interface element 1141 connected to the light engine module 901, a housing member 1142 to which the interface element 1141 is connected, a lens 1143, and an electrical connector 1147. The light engine module 901 is press-fitted in a recess 1144 in the interface element 1141 (alternatively, the light engine module 901 can be connected to the interface element 1141 in any other suitable way, including any of the ways of attaching elements as discussed herein). The interface element 1141 has screw-threading 1145 that is threadable in screw-threading 1146 on the housing member 1142 (alternatively, the interface element 1141 can be connected to the housing member 1142 in any other suitable way, including any of the ways of attaching elements as discussed herein). The electrical connector 1147 comprises Edison screw threads which are receivable in an Edison socket. The interface element 1141 comprises an electrical contact 1148 and the housing member 1142 comprises an electrical contact 1149 which is in contact with the electrical contact 1148. Alternatively or additionally, the interface element 1141 and/or the housing member 1142 can comprise one or more regions of high heat conductivity (e.g., a thermal contact), one or more additional electrically conducting regions (e.g., an electrical contact), one or more transparent, translucent or optically transmissive regions, and/or one or more mechanical contacts. As with other embodiments, the interface element 1141 can further comprise the light engine module 901 (e.g., analogous to the embodiment depicted in FIG. 109, relative to the embodiment depicted in FIG. 108), and/or the light engine module can extend farther (to any degree) from the array of solid state light emitters (e.g., analogous to the embodiment depicted in FIG. 110, relative to the embodiment depicted in FIG. 108).

FIG. 115 is a front elevation view of a light engine element 1150 comprising a light engine module 901 and an interface element 1151 connected to the light engine module 901.

FIG. 116 is a sectional view of a lighting device element 1160 that comprises a housing member 1161, a lens 1162 and an electrical connector 1163. The light engine element 1150 is configured to be removably connected to the lighting device element 1160.

The light engine module 901 is glued to a surface of the interface element 1151 (alternatively, the light engine module 901 can be connected to the interface element 1151 in any other suitable way, including any of the ways of attaching elements as discussed herein). The interface element 1151 has a helical groove 1152 into which a helical ridge 1164 on the housing member 1161 is receivable (alternatively, instead of the helical ridge 1164, there can be provided a discontinuous helical ridge and/or a series of bumps and/or a single bump that are/is receivable in the groove 1152). Alternatively, the interface element 1151 can be connected to the housing member 1161 in any other suitable way, including any of the ways of attaching elements as discussed herein. To connect the light engine element 1150 to the lighting device element 1160, the interface element 1151 can be placed within the upper portion of the housing member 1161 (e.g., prior to the lens 1162 having been connected to the housing member 1161), and then screw-threaded, with the helical groove 1152 screw-threading with the helical ridge 1164. The interface element 1151 further comprises a pair of engagement elements 1153 that extend partially into the helical groove 1152, which can more securely hold a corresponding engagement portion 1165 of the helical ridge 1164, e.g., the slightly enlarged portion 1165 of the helical ridge 1164 can move relatively freely through most of the helical groove 1152, except the portion adjacent to the engagement elements 1153, which, once the enlarged portion 1165 is between the engagement elements 1153, restrict (but do not prevent) further movement of the enlarged portion 1165 along the helical ridge 1164, thereby removably connecting the light engine element 1150 to the lighting device element 1160, pivotally locating the light engine element 1150 relative to the lighting device element 1160 (and in some embodiments aligning thermal, electrical, mechanical and/or optical connections or features of the interface element 1151 and the lighting device element 1160) and maintaining the pivotal location of the light engine element 1150 relative to the lighting device element 1160, i.e., a "spin and click" connection can be made. The electrical connector 1163 comprises Edison screw threads which are receivable in an Edison socket. The interface element 1151 can comprise one or more regions of high heat conductivity (e.g., a thermal contact), one or more electrically conducting regions (e.g., an electrical contact), one or more transparent, translucent or optically transmissive regions, and/or one or more mechanical contacts. As with other embodiments, the interface element 1151 can further comprise the light engine module 901 (e.g., analogous to the embodiment depicted in FIG. 109, relative to the embodiment depicted in FIG. 108), and/or the light engine module can extend farther (to any degree) from the array of solid state light emitters (e.g., analogous to the embodiment depicted in FIG. 110, relative to the embodiment depicted in FIG. 108). Alternatively, the ridge can be provided on the interface element 1151 and the groove can be provided on the housing member 1161, or any suitable combination of placement of ridge regions and groove regions can be provided.

FIG. 117 is a sectional view of a light engine element 1170 comprising a light engine module 901 and an interface element 1171 connected to the light engine module 901. FIG. 118 is a sectional view of a lighting device element 1180 that comprises a housing member 1181, a lens 1182, an electrical connector 1183 and a spring element 1184. The light engine element 1170 is configured to be removably connected to the lighting device element 1180 (instead of or in addition to the spring element, any biasing device tending to push upward (in the orientation shown in FIG. 118) relative to the housing member 1181 can be employed).

The light engine module 901 is press-fitted in a recess 1172 in the interface element 1171 (alternatively, the light engine module 901 can be connected to the interface element 1171 in any other suitable way, including any of the ways of attaching elements as discussed herein). The interface element 1171 has a pair of slot/notch openings 1173 (only one is visible in FIG. 117) into which a pair of protrusions 1185 are respectively receivable. Alternatively, the interface element 1171 can be connected to the housing member 1181 in any other suitable way, including any of the ways of attaching elements as discussed herein. To connect the light engine element 1170 to the lighting device element 1180, the interface element 1171 can be placed within the upper portion of the housing member 1181 (e.g., prior to the lens 1182 having been connected to the housing member 1181), then the light engine element 1170 can be rotated about its axis until the protrusions 1185 are aligned with entry regions 1174 of the respective openings 1173, then the light engine element 1170 can be pushed downward (in the orientation depicted in FIG. 118) against the force of the spring element 1184 until the protrusions 1185 contact first edges 1175 of the respective openings 1173, then the light engine element 1170 can be rotated about its axis until the protrusions 1185 contact second edges 1176 of the respective openings 1173, and then the light engine element 1170 can be released, whereby the light engine element 1170 is pushed upward (and remains biased upward) with the protrusions 1185 in contact with third edges 1177 of the respective openings 1173, thereby removably connecting the light engine element 1170 to the lighting device element 1180, pivotally locating the light engine element 1170 relative to the lighting device element 1180 (and in some embodiments aligning thermal, electrical, mechanical and/or optical connections or features of the interface element 1171 and the lighting device element 1180) and maintaining the pivotal location of the light engine element 1170 relative to the lighting device element 1180. The electrical connector 1183 comprises Edison screw threads which are receivable in an Edison socket. The interface element 1171 can comprise one or more regions of high heat conductivity (e.g., a thermal contact), one or more electrically conducting regions (e.g., an electrical contact), one or more transparent, translucent or optically transmissive regions, and/or one or more mechanical contacts. As with other embodiments, the interface element 1171 can further comprise the light engine module 901 (e.g., analogous to the embodiment depicted in FIG. 109, relative to the embodiment depicted in FIG. 108), and/or the light engine module can extend farther (to any degree) from the array of solid state light emitters (e.g., analogous to the embodiment depicted in FIG. 110, relative to the embodiment depicted in FIG. 108). Alternatively, the protrusions can be provided on the interface element 1171 and the slot/notch openings 1173 can be provided on the housing member 1181 (e.g., as with the embodiment depicted in FIGS. 119 and 120), or any suitable combination of placement of ridge regions and groove regions can be provided.

FIG. 119 is a sectional view of a light engine element 1190 comprising a light engine module 901 and an interface element 1191 connected to the light engine module 901. FIG. 120 is a sectional view of a lighting device element 1200 that comprises a housing member 1201, a lens 1202, an electrical connector 1203 and a spring element 1204. The light engine element 1190 is configured to be removably connected to the lighting device element 1200 (instead of or in addition to the spring element, any biasing device tending to push upward (in the orientation shown in FIG. 120) relative to the housing member 1201 can be employed).

The embodiment depicted in FIGS. 119 and 120 is similar to the embodiment depicted in FIGS. 117 and 118, except that in the embodiment depicted in FIGS. 119 and 120, protrusions 1192 are provided on the interface element 1191 (rather than on the lighting device element, as in FIG. 118), and a pair of slot/notch openings 1205 (only one is visible in FIG. 120) are provided on the lighting device element 1201 (rather than on the interface element, as in FIG. 117). The protrusions 1192 interact with the slot/notch openings 1205 (with the aid of the bias of the spring element 1204) in a manner that is analogous to how the protrusions 1185 interact with the openings 1173.

FIG. 121 is a sectional view of a lighting device comprising a light engine module 901, a light engine module housing member 1211 which is connected to the light engine module 901, an interface element 1212 which is connected to the light engine module housing member 1211, a housing member 1213 to which the interface element 1212 is connected, and an electrical connector 1214. The light engine module 901 is press-fitted in a recess 1215 in the light engine module housing member 1211 (alternatively, the light engine module 901 can be connected to the light engine module housing member 1211 in any other suitable way, including any of the ways of attaching elements as discussed herein). The light engine module housing member 1211 has screw-threading 1216 that is threadable in screw-threading 1217 on the interface element 1212 (alternatively, the light engine module housing member can be connected to the interface element 1212 in any other suitable way, including any of the ways of attaching elements as discussed herein). The interface element 1212 has screw-threading 1218 that is threadable in screw-threading 1219 on the housing member 1213 (alternatively, the interface element 1212 can be connected to the housing member 1213 in any other suitable way, including any of the ways of attaching elements as discussed herein). The electrical connector 1214 comprises Edison screw threads which are receivable in an Edison socket. The interface element 1212 can comprise one or more regions of high heat conductivity (e.g., a thermal contact), one or more electrically conducting regions (e.g., an electrical contact), one or more transparent, translucent or optically transmissive regions, and/or one or more mechanical contacts.

As noted above, a lighting device element in any embodiment can be round or any other regular shape (e.g., square cross-section, oval cross-section, triangular cross-section, hexagonal cross-section, etc.) or irregular shape.

In some embodiments, a light engine module can be positioned within (and/or attached to) a lighting device element in any suitable way, e.g., by heating the lighting device element, inserting the light engine module in place, and then cooling the lighting device element (or allowing it to cool), so that it shrinks and comes into contact (and/or compresses) the light engine module; by positioning the light engine module in the lighting device element (e.g., loosely fitting) and then squeezing the lighting device element; by providing a lighting device element in two or more pieces and clamping them around the light engine module; by screw threading the light engine module into the lighting device element; by positioning the light engine module in the lighting device element (e.g., loosely fitting) and then crimping the lighting device element, etc. In any such assembly, any suitable material for providing a tight fit and/or for enhancing thermal coupling between the light engine module and the lighting device element can be employed, e.g., thermal grease, epoxy, etc., which can be positioned in any suitable location at any suitable stage during assembly (e.g., thermal grease can be positioned in the lighting device element before inserting the light engine module into the lighting device element and/or thermal grease can be applied after such positioning. In addition, in any such assembly, one or more of the light engine module and the lighting device element (and/or any other suitable component) can be malleable so that any press-fitting or thermal expansion fitting or the like can provide a more snug fit.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices or light engine modules described herein can be provided in two or more parts (which may be held together in any known way, e.g., with adhesive, screws, bolts, rivets, staples, etc.).

The invention claimed is:

1. A lighting device, comprising:
at least a first solid state light emitter support member;
at least a first solid state light emitter; and
at least a first housing element,
the first solid state light emitter on the first solid state light emitter support member,
the first solid state light emitter support member having at least a first alignment feature,
the first housing element having at least a second alignment feature,
the first alignment feature configured to engage the second alignment feature.

2. A lighting device as recited in claim 1, wherein one of the first alignment feature and the second alignment feature is a tab and the other of the first alignment feature and the second alignment feature is a groove.

3. A lighting device as recited in claim 1, wherein the first solid state light emitter support member is removable from the first housing member.

4. A lighting device as recited in claim 1, wherein the first solid state light emitter support member is configured to connect with any of a plurality of different housing elements.

5. A light engine module, comprising:
at least a first solid state light emitter support member; and
at least a first solid state light emitter,
the first solid state light emitter on a first surface of the first solid state light emitter support member,
a first cross-section of the first solid state light emitter support member parallel to the first surface,
a second cross-section of the first solid state light emitter support member parallel to the first surface,
the first cross-section closer to the first surface than the second cross-section,
the first cross-section having a largest dimension that is larger than a largest dimension of the second cross-section.

6. A light engine module as recited in claim 5, wherein the first surface of the first solid state light emitter support member is substantially perpendicular to an axis of the light engine module, and no cross-section of the light engine module perpendicular to the axis is larger than any other cross-section of the light engine module that is perpendicular to the axis and closer to the first solid state light emitter support member.

7. A light engine module as recited in claim 5, wherein at least a portion of the first solid state light emitter support member is substantially frustoconical.

8. A light engine module as recited in claim 5, wherein the light engine module is configured to connect with any of a plurality of different housing elements.

9. A light engine module, comprising:
at least a first solid state light emitter support member; and
at least a first solid state light emitter,
the first solid state light emitter on a first surface of the first solid state light emitter support member,
the first solid state light emitter support member comprising at least one structure that provides or enhances heat dissipation and/or that functions as a heat sink,
the first solid state light emitter support member configured to be connected to a housing member.

10. A light engine module as recited in claim 9, wherein the light engine module is configured to connect with any of a plurality of different housing elements.

11. A lighting device comprising a light engine module as recited in claim 9 and at least a first housing member, the light engine module structurally supported by the first housing member.

12. A lighting device as recited in claim 11, wherein the light engine module is removable from the first housing member.

13. A light engine module, comprising:
at least a first solid state light emitter support member; and
at least first and second solid state light emitters,
the first and second solid state light emitters on the first solid state light emitter support member,
the first solid state light emitter facing a first direction, the second solid state light emitter facing a second direction, the first direction different from the second direction.

14. A light engine module as recited in claim 13, wherein the light engine module is configured to connect with any of a plurality of different housing elements.

15. A light engine module, comprising:
at least a first solid state light emitter support member;
at least a first solid state light emitter; and
at least a first circuit board, the first solid state light emitter on the first circuit board, the first circuit board having at least a first alignment feature, the first solid state light emitter support member having at least a second alignment feature, the first alignment feature configured to engage the second alignment feature.

16. A light engine module as recited in claim 15, wherein one of the first alignment feature and the second alignment feature is a tab and the other of the first alignment feature and the second alignment feature is a groove.

17. A light engine module as recited in claim 15, wherein:

the first circuit board has a first electrical contact element, and the first solid state light emitter support member has a second electrical contact element, the first electrical contact element is in contact with the second electrical contact element.

18. A light engine module as recited in claim 15, wherein the light engine module is configured to connect with any of a plurality of different housing elements.

19. A light engine module, comprising:

at least a first solid state light emitter support member;

at least a first solid state light emitter; and at least one electronic component comprising compensation circuitry, the first solid state light emitter on the first solid state light emitter support member, the light engine module configured to be removably connected to a housing member.

20. A light engine module as recited in claim 19, wherein the light engine module is configured to connect with any of a plurality of different housing elements.

21. A lighting device comprising a light engine module as recited in claim 19 and a housing member, the light engine module removably connected to the housing member.

* * * * *